US008482496B2

(12) United States Patent
Lewis

(10) Patent No.: US 8,482,496 B2
(45) Date of Patent: Jul. 9, 2013

(54) CIRCUITS FOR CONTROLLING MEMS DISPLAY APPARATUS ON A TRANSPARENT SUBSTRATE

(75) Inventor: Stephen R. Lewis, Reading, MA (US)

(73) Assignee: Pixtronix, Inc., San Diego, CA (US)

( * ) Notice: Subject to any disclaimer, the term of this patent is extended or adjusted under 35 U.S.C. 154(b) by 1319 days.

(21) Appl. No.: 11/811,842

(22) Filed: Jun. 12, 2007

(65) Prior Publication Data

US 2008/0174532 A1 Jul. 24, 2008

Related U.S. Application Data

(63) Continuation-in-part of application No. 11/326,696, filed on Jan. 6, 2006.

(60) Provisional application No. 60/881,757, filed on Jan. 19, 2007.

(51) Int. Cl.
*G09G 3/34* (2006.01)

(52) U.S. Cl.
USPC ..... 345/84

(58) Field of Classification Search
USPC ..... 345/84–98, 108–110, 204–206, 208–210, 345/214–215; 359/237–324
See application file for complete search history.

(56) References Cited

U.S. PATENT DOCUMENTS 4,067,043 A 1/1978 Perry
4,074,253 A 2/1978 Nadir
4,421,381 A 12/1983 Ueda et al.
4,559,535 A 12/1985 Watkins et al.
4,563,836 A 1/1986 Woodruff et al.
4,564,836 A 1/1986 Vuilleumier et al.
4,582,396 A 4/1986 Bos et al.
4,673,253 A 6/1987 Tanabe et al.
4,728,936 A 3/1988 Guscott et al.
4,744,640 A 5/1988 Phillips
4,889,603 A 12/1989 DiSanto et al.
4,958,911 A 9/1990 Beiswenger et al.
4,991,941 A 2/1991 Kalmanash
5,005,108 A 4/1991 Pristash et al.
5,025,346 A 6/1991 Tang et al.
5,025,356 A 6/1991 Gawad
5,042,900 A 8/1991 Parker
5,044,734 A 9/1991 Sperl et al.
5,050,946 A 9/1991 Hathaway et al.
5,061,049 A 10/1991 Hornbeck
5,062,689 A 11/1991 Koehler
5,078,479 A 1/1992 Vuilleumier (Continued)

FOREIGN PATENT DOCUMENTS

CN 1309782 A 8/2001
CN 1390045 A 1/2003

(Continued)

OTHER PUBLICATIONS

U.S. Appl. No. 11/973,187, Unpublished, Kim et al.

(Continued)

*Primary Examiner* — Liliana Cerullo
(74) *Attorney, Agent, or Firm* — Ropes & Gray LLP

(57) ABSTRACT

The invention relates to methods and apparatus for forming images on a display utilizing a control matrix to control the movement of MEMs-based light modulators.

44 Claims, 24 Drawing Sheets

U.S. PATENT DOCUMENTS 5,093,652 A 3/1992 Bull et al.
5,096,279 A 3/1992 Hornbeck et al.
5,128,787 A 7/1992 Blonder
5,136,480 A 8/1992 Pristash et al.
5,136,751 A 8/1992 Coyne et al.
5,142,405 A 8/1992 Hornbeck
5,184,248 A 2/1993 De Vaan et al.
5,184,428 A 2/1993 Feldt et al.
5,198,730 A 3/1993 Vancil
5,202,950 A 4/1993 Arego et al.
5,233,385 A 8/1993 Sampsell
5,233,459 A 8/1993 Bozler et al.
5,245,454 A 9/1993 Blonder
5,266,612 A 11/1993 Kim et al.
5,278,652 A 1/1994 Urbanus et al.
5,280,277 A 1/1994 Hornbeck
5,319,061 A 6/1994 Ramaswamy
5,319,491 A 6/1994 Selbrede
5,339,116 A 8/1994 Urbanus et al.
5,339,179 A 8/1994 Rudisill et al.
5,359,345 A 10/1994 Hunter
5,379,135 A 1/1995 Nakagaki et al.
5,396,350 A 3/1995 Beeson et al.
5,416,631 A 5/1995 Yagi
5,440,197 A 8/1995 Gleckman
5,452,024 A 9/1995 Sampsell
5,461,411 A 10/1995 Florence et al.
5,465,175 A 11/1995 Woodgate et al.
5,467,104 A 11/1995 Furness, III et al.
5,477,086 A 12/1995 Rostoker et al.
5,479,279 A 12/1995 Barbier et al.
5,491,347 A * 2/1996 Allen et al. ..... 257/59
5,493,439 A 2/1996 Engle
5,497,172 A 3/1996 Doherty
5,497,258 A 3/1996 Ju et al.
5,499,127 A 3/1996 Tsubota et al.
5,504,389 A 4/1996 Dickey
5,504,614 A 4/1996 Webb et al.
5,510,824 A 4/1996 Nelson
5,517,341 A 5/1996 Kim et al.
5,517,347 A 5/1996 Sampsell
5,519,565 A 5/1996 Kalt et al.
5,523,803 A 6/1996 Urbanus et al.
5,526,051 A 6/1996 Gove et al.
5,528,262 A 6/1996 McDowall et al.
5,548,301 A 8/1996 Kornher et al.
5,548,670 A 8/1996 Koike
5,552,925 A 9/1996 Worley
5,559,389 A 9/1996 Spindt et al.
5,568,964 A 10/1996 Parker et al.
5,578,185 A 11/1996 Bergeron et al.
5,579,035 A 11/1996 Beiswenger
5,579,240 A 11/1996 Buus
5,596,339 A 1/1997 Furness, III et al.
5,596,369 A 1/1997 Chau
5,613,751 A 3/1997 Parker et al.
5,618,096 A 4/1997 Parker et al.
5,619,266 A 4/1997 Tomita et al.
5,622,612 A 4/1997 Mihara et al.
5,629,784 A 5/1997 Abileah et al.
5,629,787 A 5/1997 Tsubota et al.
5,655,832 A 8/1997 Pelka et al.
5,655,838 A 8/1997 Ridley et al.
5,659,327 A 8/1997 Furness, III et al.
5,663,917 A 9/1997 Oka et al.
5,666,226 A 9/1997 Ezra et al.
5,677,749 A 10/1997 Tsubota et al.
5,684,354 A 11/1997 Gleckman
5,687,465 A 11/1997 Hinata et al.
5,691,695 A 11/1997 Lahiff
5,694,227 A 12/1997 Starkweather
5,724,062 A 3/1998 Hunter
5,731,802 A 3/1998 Aras et al.
5,745,193 A 4/1998 Urbanus et al.
5,745,203 A 4/1998 Valliath et al.
5,745,281 A 4/1998 Yi et al.
5,745,284 A 4/1998 Goldberg et al.
5,771,321 A 6/1998 Stern
5,781,331 A 7/1998 Carr et al.
5,781,333 A 7/1998 Lanzillotta et al.
5,784,189 A 7/1998 Bozler et al.
5,794,761 A 8/1998 Renaud et al.
5,801,792 A 9/1998 Smith et al.
5,808,800 A 9/1998 Handschy et al.
5,810,469 A 9/1998 Weinreich
5,835,255 A 11/1998 Miles
5,835,256 A 11/1998 Huibers
5,854,872 A 12/1998 Tai
5,867,302 A 2/1999 Fleming
5,876,107 A 3/1999 Parker et al.
5,884,872 A 3/1999 Greenhalgh
5,889,625 A 3/1999 Chen et al.
5,894,686 A 4/1999 Parker et al.
5,895,115 A 4/1999 Parker et al.
5,917,692 A 6/1999 Schmitz et al.
5,921,652 A 7/1999 Parker et al.
5,936,596 A 8/1999 Yoshida et al.
5,943,223 A 8/1999 Pond
5,953,469 A 9/1999 Zhou
5,975,711 A 11/1999 Parker et al.
5,986,628 A 11/1999 Tuenge et al.
5,986,796 A 11/1999 Miles
5,986,828 A 11/1999 Wood et al.
5,990,990 A 11/1999 Crabtree
5,995,688 A 11/1999 Aksyuk et al.
6,008,781 A 12/1999 Furness, III et al.
6,008,929 A 12/1999 Akimoto et al.
6,028,656 A 2/2000 Buhrer et al.
6,030,089 A 2/2000 Parker et al.
6,034,807 A 3/2000 Little et al.
6,040,796 A 3/2000 Matsugatani et al.
6,040,937 A 3/2000 Miles
6,046,840 A 4/2000 Huibers
6,049,317 A 4/2000 Thompson et al.
6,055,090 A 4/2000 Miles
6,069,676 A 5/2000 Yuyama
6,079,838 A 6/2000 Parker et al.
6,111,560 A 8/2000 May
6,130,735 A 10/2000 Hatanaka et al.
6,137,313 A * 10/2000 Wong et al. ..... 326/83
6,154,586 A 11/2000 MacDonald et al.
6,158,867 A 12/2000 Parker et al.
6,162,657 A 12/2000 Schiele et al.
6,168,395 B1 1/2001 Quenzer et al.
6,172,657 B1 1/2001 Kamakura et al.
6,172,797 B1 1/2001 Huibers
6,174,064 B1 1/2001 Kalantar et al.
6,195,196 B1 2/2001 Kimura et al.
6,201,633 B1 3/2001 Peeters et al.
6,201,664 B1 3/2001 Le et al.
6,206,550 B1 3/2001 Fukushima et al.
6,219,119 B1 4/2001 Nakai
6,225,991 B1 5/2001 McKnight
6,227,677 B1 5/2001 Willis
6,249,169 B1 6/2001 Okada
6,249,269 B1 6/2001 Blalock et al.
6,249,370 B1 6/2001 Takeuchi et al.
6,266,240 B1 7/2001 Urban et al.
6,282,951 B1 9/2001 Loga et al.
6,285,270 B1 9/2001 Lane et al.
6,288,824 B1 9/2001 Kastalsky
6,288,829 B1 9/2001 Kimura
6,295,054 B1 9/2001 McKnight
6,296,383 B1 10/2001 Henningsen
6,296,838 B1 10/2001 Bindra et al.
6,300,154 B2 10/2001 Clark et al.
6,300,294 B1 10/2001 Robbins et al.
6,317,103 B1 11/2001 Furness, III et al.
6,323,834 B1 11/2001 Colgan et al.
6,329,967 B1 12/2001 Little et al.
6,329,974 B1 12/2001 Walker et al.
6,367,940 B1 4/2002 Parker et al.
6,388,661 B1 5/2002 Richards
6,392,736 B1 5/2002 Furukawa et al.
6,402,335 B1 6/2002 Kalantar et al.
6,402,355 B1 6/2002 Kinouchi
6,404,942 B1 6/2002 Edwards et al.

6,407,851 B1 6/2002 Islam et al.
6,411,423 B2 6/2002 Ham
6,424,329 B1 7/2002 Okita
6,429,625 B1 8/2002 LeFevre et al.
6,429,628 B2 8/2002 Nakagawa
6,459,467 B1 10/2002 Hashimoto et al.
6,471,879 B2 10/2002 Hanson et al.
6,473,220 B1 10/2002 Clikeman et al.
6,476,886 B2 11/2002 Krusius et al.
6,483,613 B1 11/2002 Woodgate et al.
6,498,685 B1 12/2002 Johnson
6,504,985 B2 1/2003 Parker et al.
6,507,138 B1 1/2003 Rodgers et al.
6,508,563 B2 1/2003 Parker et al.
6,514,111 B2 2/2003 Ebihara et al.
6,523,961 B2 2/2003 Ilkov et al.
6,529,250 B1 3/2003 Murakami et al.
6,529,265 B1 3/2003 Henningsen
6,531,329 B2 3/2003 Asakura et al.
6,531,947 B1 3/2003 Weaver et al.
6,532,044 B1 3/2003 Conner et al.
6,535,256 B1 3/2003 Ishihara et al.
6,535,311 B1 3/2003 Lindquist
6,556,258 B1 4/2003 Yoshida et al.
6,556,261 B1 4/2003 Krusius et al.
6,559,827 B1 5/2003 Mangerson
6,567,063 B1 5/2003 Okita
6,567,138 B1 5/2003 Krusius et al.
6,574,033 B1 6/2003 Chui et al.
6,576,887 B2 6/2003 Whitney et al.
6,582,095 B1 6/2003 Toyoda
6,583,915 B1 6/2003 Hong et al.
6,589,625 B1 7/2003 Kothari et al.
6,591,049 B2 7/2003 Williams et al.
6,593,677 B2 7/2003 Behin et al.
6,600,474 B1 7/2003 Heines et al.
6,626,540 B2 9/2003 Ouchi et al.
6,633,301 B1 10/2003 Dallas et al.
6,639,570 B2 10/2003 Furness, III et al.
6,639,572 B1 10/2003 Little et al.
6,650,455 B2 11/2003 Miles
6,650,822 B1 11/2003 Zhou
6,664,779 B2 12/2003 Lopes et al.
6,666,561 B1 12/2003 Blakley
6,671,078 B2 12/2003 Flanders et al.
6,674,562 B1 1/2004 Miles
6,677,709 B1 1/2004 Ma et al.
6,677,936 B2 1/2004 Jacobsen et al.
6,678,029 B2 1/2004 Suzuki
6,680,792 B2 1/2004 Miles
6,690,422 B1 2/2004 Daly et al.
6,697,035 B2 2/2004 Sugahara et al.
6,698,348 B1 3/2004 Bloss
6,698,349 B2 3/2004 Komata
6,701,039 B2 3/2004 Bourgeois et al.
6,707,176 B1 3/2004 Rodgers
6,710,008 B2 3/2004 Chang et al.
6,710,538 B1 3/2004 Ahn et al.
6,710,908 B2 3/2004 Miles et al.
6,710,920 B1 3/2004 Mashitani et al.
6,712,071 B1 3/2004 Parker
6,712,481 B2 3/2004 Parker et al.
6,731,355 B2 5/2004 Miyashita
6,731,492 B2 5/2004 Goodwin-Johansson
6,733,354 B1 5/2004 Cathey et al.
6,738,177 B1 5/2004 Gutierrez et al.
6,741,377 B2 5/2004 Miles
6,746,886 B2 6/2004 Duncan et al.
6,749,312 B2 6/2004 Parker et al.
6,750,930 B2 6/2004 Yoshii et al.
6,752,505 B2 6/2004 Parker et al.
6,755,534 B2 6/2004 Veligdan et al.
6,755,547 B2 6/2004 Parker
6,760,081 B2 7/2004 Takagi
6,760,505 B1 7/2004 Street et al.
6,762,743 B2 7/2004 Yoshihara et al.
6,762,868 B2 7/2004 Liu et al.
6,764,796 B2 7/2004 Fries
6,774,964 B2 8/2004 Funamoto et al.
6,775,048 B1 8/2004 Starkweather et al.
6,778,228 B2 8/2004 Murakami et al.
6,778,248 B1 8/2004 Ootaguro et al.
6,785,454 B2 8/2004 Abe
6,787,969 B2 9/2004 Grade et al.
6,788,371 B2 9/2004 Tanada et al.
6,794,119 B2 9/2004 Miles
6,795,064 B2 9/2004 Walker et al.
6,796,668 B2 9/2004 Parker et al.
6,798,935 B2 9/2004 Bourgeois et al.
6,800,996 B2 10/2004 Nagai et al.
6,809,851 B1 10/2004 Gurcan
6,819,386 B2 11/2004 Roosendaal et al.
6,819,465 B2 11/2004 Clikeman et al.
6,822,734 B1 11/2004 Eidelman et al.
6,825,470 B1 11/2004 Bawolek et al.
6,825,499 B2 11/2004 Nakajima et al.
6,827,456 B2 12/2004 Parker et al.
6,831,678 B1 12/2004 Travis
6,835,111 B2 12/2004 Ahn et al.
6,844,959 B2 1/2005 Huibers et al.
6,846,082 B2 1/2005 Glent-Madsen et al.
6,846,089 B2 1/2005 Stevenson et al.
6,847,425 B2 1/2005 Tanada et al.
6,847,428 B1 1/2005 Sekiguchi et al.
6,857,751 B2 2/2005 Penn et al.
6,862,072 B2 3/2005 Liu et al.
6,863,219 B1 3/2005 Jacobsen et al.
6,864,618 B2 3/2005 Miller et al.
6,867,192 B1 3/2005 Armour et al.
6,867,896 B2 3/2005 Miles
6,873,311 B2 3/2005 Yoshihara et al.
6,879,307 B1 4/2005 Stern
6,886,956 B2 5/2005 Parker et al.
6,887,202 B2 5/2005 Currie et al.
6,888,678 B2 5/2005 Nishiyama et al.
6,889,565 B2 5/2005 DeConde et al.
6,897,164 B2 5/2005 Baude et al.
6,897,843 B2 5/2005 Ayres et al.
6,900,072 B2 5/2005 Patel et al.
6,906,847 B2 6/2005 Huibers et al.
6,911,891 B2 6/2005 Qiu et al.
6,911,964 B2 6/2005 Lee et al.
6,912,082 B1 * 6/2005 Lu et al. ..... 359/295
6,919,981 B2 7/2005 Clikeman et al.
6,934,080 B2 8/2005 Saccomanno et al.
6,936,013 B2 8/2005 Pevoto
6,936,968 B2 8/2005 Cross et al.
6,939,013 B2 9/2005 Asao
6,940,631 B2 9/2005 Ishikawa
6,943,495 B2 9/2005 Ma et al.
6,947,107 B2 9/2005 Yoshii et al.
6,947,195 B2 9/2005 Ohtaka et al.
6,950,240 B2 9/2005 Matsuo
6,952,301 B2 10/2005 Huibers
6,953,375 B2 10/2005 Ahn et al.
6,961,167 B2 11/2005 Prins et al.
6,962,418 B2 11/2005 Utsumi et al.
6,962,419 B2 11/2005 Huibers
6,963,330 B2 11/2005 Sugahara et al.
6,965,375 B1 11/2005 Gettemy et al.
6,967,698 B2 11/2005 Tanoue et al.
6,967,763 B2 11/2005 Fujii et al.
6,969,635 B2 11/2005 Patel et al.
6,970,227 B2 11/2005 Kida et al.
6,977,710 B2 12/2005 Akiyama et al.
6,980,349 B1 12/2005 Huibers et al.
6,985,205 B2 1/2006 Chol et al.
6,992,375 B2 1/2006 Robbins et al.
6,996,306 B2 2/2006 Chen et al.
7,004,610 B2 2/2006 Yamashita et al.
7,004,611 B2 2/2006 Parker et al.
7,012,726 B1 3/2006 Miles
7,012,732 B2 3/2006 Miles
7,014,349 B2 3/2006 Shinohara et al.
7,019,809 B2 3/2006 Sekiguchi
7,026,821 B2 4/2006 Martin et al.
7,038,758 B2 5/2006 Suzuki
7,042,618 B2 5/2006 Selbrede et al.

7,042,643 B2 5/2006 Miles
7,046,221 B1 5/2006 Malzbender
7,046,905 B1 5/2006 Gardiner et al.
7,048,905 B2 5/2006 Paparatto et al.
7,050,035 B2 5/2006 Iisaka et al.
7,050,141 B2 5/2006 Yokoue et al.
7,050,219 B2 5/2006 Kimura
7,050,790 B2 5/2006 Yamaga
7,057,790 B2 6/2006 Selbrede
7,060,895 B2 6/2006 Kothari et al.
7,071,611 B2 7/2006 Yonekubo et al.
7,072,096 B2 7/2006 Holman et al.
7,075,702 B2 7/2006 Huibers et al.
7,092,142 B2 8/2006 Selebrede et al.
7,110,158 B2 9/2006 Miles
7,116,464 B2 10/2006 Osawa et al.
7,119,944 B2 10/2006 Patel et al.
7,123,216 B1 10/2006 Miles
7,123,796 B2 10/2006 Steckl et al.
7,126,738 B2 10/2006 Miles
7,140,751 B2 11/2006 Lin
7,156,548 B2 1/2007 Teng et al.
7,161,094 B2 1/2007 Kothari et al.
7,164,250 B2 1/2007 Boscolo et al.
7,164,520 B2 1/2007 Palmateer et al.
7,180,677 B2 2/2007 Fujii et al.
7,184,202 B2 2/2007 Miles et al.
7,196,837 B2 3/2007 Sampsell et al.
7,198,982 B2 4/2007 Patel et al.
7,199,916 B2 4/2007 Faase et al.
7,215,459 B2 5/2007 Huibers et al.
7,217,588 B2 5/2007 Hartzell et al.
7,218,437 B2 5/2007 Selbrede
7,227,677 B2 6/2007 Ravnkilde et al.
7,271,945 B2 9/2007 Hagood et al.
7,274,416 B2 9/2007 Feenstra et al.
7,291,363 B2 11/2007 Miller
7,292,235 B2 11/2007 Nose
7,298,448 B2 11/2007 Wu
7,304,785 B2 12/2007 Hagood et al.
7,304,786 B2 12/2007 Hagood et al.
7,315,294 B2 1/2008 Richards
7,359,108 B2 4/2008 Hayes et al.
7,365,897 B2 4/2008 Hagood et al.
7,374,328 B2 5/2008 Kuroda et al.
7,391,493 B2 6/2008 Kim
7,391,552 B2 6/2008 Barton et al.
7,405,852 B2 7/2008 Brosnihan et al.
7,417,735 B2 8/2008 Cummings et al.
7,417,782 B2 8/2008 Hagood et al.
7,460,290 B2 12/2008 Hagood, IV et al.
7,463,227 B2 12/2008 Van Gorkom
7,463,398 B2 12/2008 Feenstra et al.
7,502,159 B2 3/2009 Hagood, IV et al.
7,529,012 B2 5/2009 Hayes et al.
7,551,344 B2 6/2009 Hagood et al.
7,573,547 B2 8/2009 Palmateer et al.
7,616,368 B2 11/2009 Hagood, IV
7,619,806 B2 11/2009 Hagood, IV et al.
7,636,189 B2 12/2009 Hagood, IV et al.
7,666,049 B2 2/2010 Saito et al.
7,675,665 B2 3/2010 Hagood et al.
7,715,080 B2 5/2010 Natarajan et al.
7,729,037 B2 6/2010 Hagood, IV et al.
7,742,016 B2 6/2010 Hagood et al.
7,742,215 B2 6/2010 Hagood, IV
7,746,529 B2 6/2010 Hagood et al.
7,755,582 B2 7/2010 Hagood et al.
7,826,127 B2 11/2010 Khonsari et al.
7,839,356 B2 11/2010 Hagood et al.
7,852,546 B2 12/2010 Fijol et al.
7,876,489 B2 1/2011 Gandhi et al.
7,898,714 B2 3/2011 Hagood, IV et al.
7,927,654 B2 4/2011 Hagood et al.
7,975,665 B2 7/2011 Mori
7,999,994 B2 8/2011 Hagood, IV et al.
8,159,428 B2 4/2012 Hagood et al.
8,169,679 B2 5/2012 Wu et al.
8,310,442 B2 11/2012 Hagood et al.
2001/0001260 A1 5/2001 Parker et al.
2001/0028993 A1 10/2001 Sanford
2001/0040538 A1 11/2001 Quanrud
2001/0043177 A1 11/2001 Huston et al.
2001/0043208 A1 11/2001 Furness, III et al.
2001/0048265 A1 12/2001 Miller et al.
2001/0048431 A1 12/2001 Laffargue et al.
2001/0053075 A1 12/2001 Parker et al.
2002/0000959 A1 1/2002 Colgan et al.
2002/0001051 A1 1/2002 Krusius et al.
2002/0009275 A1 1/2002 Williams et al.
2002/0015215 A1 2/2002 Miles
2002/0024641 A1 2/2002 Ilkov et al.
2002/0024711 A1 2/2002 Miles
2002/0030566 A1 3/2002 Bozler et al.
2002/0047172 A1 4/2002 Reid
2002/0054424 A1 5/2002 Miles
2002/0054487 A1 5/2002 Parker et al.
2002/0056900 A1 5/2002 Liu et al.
2002/0063218 A1 5/2002 Maydanich et al.
2002/0063661 A1 5/2002 Comiskey et al.
2002/0070931 A1 6/2002 Ishikawa
2002/0075555 A1 6/2002 Miles
2002/0080598 A1 6/2002 Parker et al.
2002/0093722 A1* 7/2002 Chan et al. ..... 359/295
2002/0109903 A1 8/2002 Kaeriyama
2002/0113281 A1 8/2002 Cunningham et al.
2002/0126364 A1 9/2002 Miles
2002/0126387 A1 9/2002 Ishikawa et al.
2002/0132389 A1 9/2002 Patel et al.
2002/0141174 A1 10/2002 Parker et al.
2002/0149828 A1 10/2002 Miles et al.
2002/0150698 A1 10/2002 Kawabata
2002/0163482 A1 11/2002 Sullivan
2002/0163484 A1 11/2002 Furness, III et al.
2002/0163709 A1 11/2002 Mirza
2002/0171327 A1 11/2002 Miller et al.
2002/0181597 A1 12/2002 Okada
2002/0185699 A1 12/2002 Reid
2002/0191267 A1 12/2002 Flanders et al.
2002/0195423 A1 12/2002 Patel et al.
2002/0196522 A1 12/2002 Little et al.
2003/0001815 A1 1/2003 Cui
2003/0007344 A1 1/2003 Parker
2003/0009898 A1 1/2003 Slocum et al.
2003/0010894 A1 1/2003 Yoshihara et al.
2003/0029705 A1 2/2003 Qiu et al.
2003/0036215 A1 2/2003 Reid
2003/0043157 A1 3/2003 Miles
2003/0043337 A1 3/2003 Takabayashi
2003/0048036 A1 3/2003 Lemkin
2003/0058543 A1 3/2003 Sheedy et al.
2003/0063233 A1 4/2003 Takagi
2003/0063234 A1 4/2003 Oda et al.
2003/0068118 A1 4/2003 Bourgeois et al.
2003/0071686 A1* 4/2003 Lemkin ..... 330/253
2003/0072070 A1 4/2003 Miles
2003/0076649 A1 4/2003 Speakman
2003/0081315 A1 5/2003 Kobayashi
2003/0081402 A1 5/2003 Jeon et al.
2003/0085650 A1 5/2003 Cathey et al.
2003/0085867 A1 5/2003 Grabert
2003/0095081 A1 5/2003 Furness, III et al.
2003/0095398 A1 5/2003 Parker et al.
2003/0102810 A1 6/2003 Cross et al.
2003/0123245 A1 7/2003 Parker et al.
2003/0123246 A1 7/2003 Parker
2003/0123247 A1 7/2003 Parker et al.
2003/0128218 A1 7/2003 Struyk
2003/0133284 A1 7/2003 Chipchase et al.
2003/0137499 A1 7/2003 Iisaka
2003/0152872 A1 8/2003 Miles
2003/0156422 A1 8/2003 Tatewaki et al.
2003/0164814 A1 9/2003 Starkweather et al.
2003/0174422 A1 9/2003 Miller et al.
2003/0174931 A1 9/2003 Rodgers et al.
2003/0183008 A1 10/2003 Bang et al.
2003/0184189 A1 10/2003 Sinclair
2003/0190535 A1 10/2003 Fries 2003/0190536 A1 10/2003 Fries
2003/0196590 A1 10/2003 Hartzell
2003/0202338 A1 10/2003 Parker
2003/0210811 A1 11/2003 Dubowsky et al.
2003/0231160 A1 12/2003 Yoshihara et al.
2004/0001033 A1 1/2004 Goodwin-Johansson et al.
2004/0012946 A1 1/2004 Parker et al.
2004/0027636 A1 2/2004 Miles
2004/0051929 A1 3/2004 Sampsell et al.
2004/0058532 A1 3/2004 Miles et al.
2004/0076008 A1 4/2004 Ikeda
2004/0080240 A1 4/2004 Miller et al.
2004/0080484 A1 4/2004 Heines et al.
2004/0080927 A1 4/2004 Parker et al.
2004/0085749 A1 5/2004 Parker et al.
2004/0088629 A1 5/2004 Ott
2004/0090144 A1 5/2004 Miller et al.
2004/0095739 A1 5/2004 Parker et al.
2004/0100677 A1 5/2004 Huibers et al.
2004/0113903 A1* 6/2004 Mikami et al. ..... 345/204
2004/0114346 A1 6/2004 Parker et al.
2004/0122328 A1 6/2004 Wang et al.
2004/0125062 A1 7/2004 Yamamoto et al.
2004/0125346 A1 7/2004 Huibers
2004/0135273 A1 7/2004 Parker et al.
2004/0135951 A1 7/2004 Stumbo et al.
2004/0136204 A1 7/2004 Asao
2004/0145580 A1 7/2004 Perlman
2004/0145854 A1 7/2004 Tamura
2004/0157664 A1 8/2004 Link
2004/0165372 A1 8/2004 Parker
2004/0171206 A1 9/2004 Rodgers
2004/0173872 A1 9/2004 Park et al.
2004/0179146 A1 9/2004 Nilsson
2004/0196215 A1 10/2004 Duthaler et al.
2004/0196525 A1 10/2004 Fujii et al.
2004/0207768 A1 10/2004 Liu
2004/0207815 A1 10/2004 Allen et al.
2004/0212759 A1 10/2004 Hayashi
2004/0218149 A1 11/2004 Huibers
2004/0218154 A1 11/2004 Huibers
2004/0218292 A1 11/2004 Huibers
2004/0218293 A1 11/2004 Huibers
2004/0223088 A1 11/2004 Huibers
2004/0223240 A1 11/2004 Huibers
2004/0227428 A1 11/2004 Sinclair
2004/0233392 A1 11/2004 Huibers
2004/0233498 A1 11/2004 Starkweather
2004/0240032 A1 12/2004 Miles
2004/0240138 A1 12/2004 Martin et al.
2004/0246275 A1 12/2004 Yoshihara et al.
2004/0263076 A1 12/2004 De Zwart et al.
2004/0263502 A1* 12/2004 Dallas et al. ..... 345/204
2004/0263944 A1 12/2004 Miles et al.
2005/0002082 A1 1/2005 Miles
2005/0002086 A1 1/2005 Starkweather et al.
2005/0007759 A1 1/2005 Parker
2005/0012197 A1 1/2005 Smith et al.
2005/0024849 A1 2/2005 Parker et al.
2005/0059184 A1 3/2005 Sniegowski et al.
2005/0062708 A1 3/2005 Yoshihara et al.
2005/0063037 A1 3/2005 Selebrede et al.
2005/0072032 A1 4/2005 McCollum et al.
2005/0073471 A1 4/2005 Selbrede
2005/0088404 A1 4/2005 Heines et al.
2005/0093465 A1 5/2005 Yonekubo et al.
2005/0094240 A1 5/2005 Huibers et al.
2005/0094418 A1 5/2005 Parker
2005/0104804 A1 5/2005 Feenstra et al.
2005/0111238 A1 5/2005 Parker
2005/0111241 A1 5/2005 Parker
2005/0116798 A1 6/2005 Bintoro et al.
2005/0122560 A1 6/2005 Sampsell et al.
2005/0122591 A1 6/2005 Parker et al.
2005/0123243 A1 6/2005 Steckl et al.
2005/0123249 A1 6/2005 Yun et al.
2005/0123349 A1 6/2005 Koch
2005/0128370 A1 6/2005 Moon
2005/0134805 A1 6/2005 Conner et al.
2005/0140636 A1 6/2005 Chung et al.
2005/0141076 A1 6/2005 Bausenwein et al.
2005/0151940 A1 7/2005 Asao
2005/0157365 A1 7/2005 Ravnkilde et al.
2005/0157376 A1 7/2005 Huibers et al.
2005/0168431 A1 8/2005 Chui
2005/0168789 A1 8/2005 Glent-Madsen
2005/0171408 A1 8/2005 Parker
2005/0172625 A1 8/2005 Starkweather et al.
2005/0179977 A1 8/2005 Chui et al.
2005/0195467 A1 9/2005 Kothari et al.
2005/0195468 A1 9/2005 Sampsell
2005/0206991 A1 9/2005 Chui et al.
2005/0207154 A1 9/2005 Parker
2005/0207178 A1 9/2005 Parker
2005/0212734 A1 9/2005 Kimura
2005/0212738 A1 9/2005 Gally
2005/0213183 A9 9/2005 Miles
2005/0213322 A1 9/2005 Parker
2005/0213323 A1 9/2005 Parker
2005/0213349 A1 9/2005 Parker
2005/0219679 A1 10/2005 Ishikawa
2005/0219680 A1 10/2005 Ishikawa
2005/0225501 A1 10/2005 Srinivasan et al.
2005/0225519 A1 10/2005 Naugler, Jr.
2005/0225732 A1 10/2005 Conner et al.
2005/0225827 A1 10/2005 Kastalsky
2005/0231791 A1 10/2005 Sampsell et al.
2005/0237596 A1 10/2005 Selbrede
2005/0242710 A1 11/2005 Yamazaki et al.
2005/0243023 A1 11/2005 Reddy et al.
2005/0244099 A1 11/2005 Pasch et al.
2005/0244949 A1 11/2005 Miles
2005/0245313 A1 11/2005 Yoshino et al.
2005/0247477 A1 11/2005 Kothari et al.
2005/0249966 A1 11/2005 Tung et al.
2005/0253779 A1 11/2005 Feenstra et al.
2005/0254115 A1 11/2005 Palmateer et al.
2005/0258571 A1 11/2005 Dumond et al.
2005/0259198 A1 11/2005 Lubart et al.
2005/0263866 A1 12/2005 Wan
2005/0265029 A1 12/2005 Epstein et al.
2005/0275072 A1 12/2005 Haluzak et al.
2005/0285816 A1 12/2005 Glass
2005/0286113 A1 12/2005 Miles
2005/0286114 A1 12/2005 Miles
2006/0001942 A1 1/2006 Chui et al.
2006/0003676 A1 1/2006 Bernard et al.
2006/0007514 A1 1/2006 Desai
2006/0007701 A1 1/2006 Schoellmann et al.
2006/0012781 A1 1/2006 Fradkin et al.
2006/0023287 A1 2/2006 Przybyla et al.
2006/0028708 A1 2/2006 Miles
2006/0028817 A1 2/2006 Parker
2006/0028840 A1 2/2006 Parker
2006/0028841 A1 2/2006 Parker
2006/0028843 A1 2/2006 Parker
2006/0028844 A1 2/2006 Parker
2006/0033676 A1 2/2006 Faase et al.
2006/0033975 A1 2/2006 Miles
2006/0038766 A1* 2/2006 Morita ..... 345/100
2006/0038768 A1 2/2006 Sagawa et al.
2006/0044246 A1 3/2006 Mignard
2006/0044298 A1 3/2006 Mignard et al.
2006/0044508 A1 3/2006 Mochizuki
2006/0044928 A1 3/2006 Chui et al.
2006/0061559 A1 3/2006 King
2006/0066540 A1 3/2006 Hewlett et al.
2006/0066560 A1 3/2006 Gally et al.
2006/0066598 A1 3/2006 Floyd
2006/0066934 A1 3/2006 Selbrede
2006/0066937 A1 3/2006 Chui
2006/0077125 A1 4/2006 Floyd
2006/0077153 A1 4/2006 Cummings et al.
2006/0077533 A1 4/2006 Miles et al.
2006/0092490 A1 5/2006 McCollum et al.
2006/0104061 A1 5/2006 Lerner et al.
2006/0132383 A1 6/2006 Gally et al.
2006/0132404 A1 6/2006 Hayes et al.

| | | | |
|---|---|---|---|
| 2006/0139734 | A1 | 6/2006 | Selebrede et al. |
| 2006/0146389 | A1 | 7/2006 | Selbrede |
| 2006/0152476 | A1 | 7/2006 | Van Gorkom et al. |
| 2006/0154078 | A1 | 7/2006 | Watanabe et al. |
| 2006/0172745 | A1 | 8/2006 | Knowles |
| 2006/0187190 | A1 | 8/2006 | Hagood et al. |
| 2006/0187191 | A1 | 8/2006 | Hagood et al. |
| 2006/0187290 | A1 | 8/2006 | Nakashima |
| 2006/0187528 | A1 | 8/2006 | Hagood et al. |
| 2006/0209000 | A1 | 9/2006 | Sumiyoshi et al. |
| 2006/0209012 | A1 | 9/2006 | Hagood |
| 2006/0238443 | A1 | 10/2006 | Derichs |
| 2006/0250325 | A1 | 11/2006 | Hagood et al. |
| 2006/0250676 | A1 | 11/2006 | Hagood |
| 2006/0256039 | A1 | 11/2006 | Hagood et al. |
| 2006/0262060 | A1 | 11/2006 | Amundson |
| 2006/0262380 | A1 | 11/2006 | Miles |
| 2006/0268386 | A1 | 11/2006 | Selbrede et al. |
| 2006/0268568 | A1 | 11/2006 | Oku et al. |
| 2006/0270179 | A1 | 11/2006 | Yang |
| 2006/0280319 | A1 | 12/2006 | Wang et al. |
| 2006/0291034 | A1 | 12/2006 | Patry et al. |
| 2006/0291771 | A1 | 12/2006 | Braunisch et al. |
| 2006/0291774 | A1 | 12/2006 | Schoellmann et al. |
| 2007/0002156 | A1 | 1/2007 | Hagood et al. |
| 2007/0002413 | A1 | 1/2007 | Psaltis et al. |
| 2007/0003055 | A1 | 1/2007 | Bark et al. |
| 2007/0007889 | A1 | 1/2007 | Bongaerts et al. |
| 2007/0024701 | A1 | 2/2007 | Prechtl et al. |
| 2007/0030555 | A1 | 2/2007 | Barton et al. |
| 2007/0031097 | A1 | 2/2007 | Heikenfeld et al. |
| 2007/0035808 | A1 | 2/2007 | Amundson et al. |
| 2007/0040982 | A1 | 2/2007 | Nakano et al. |
| 2007/0047051 | A1 | 3/2007 | Selbrede et al. |
| 2007/0047887 | A1 | 3/2007 | Selbrede |
| 2007/0052660 | A1 | 3/2007 | Montbach et al. |
| 2007/0053652 | A1 | 3/2007 | Mignard et al. |
| 2007/0086078 | A1 | 4/2007 | Hagood |
| 2007/0091011 | A1 | 4/2007 | Selbrede |
| 2007/0091038 | A1 | 4/2007 | Hagood et al. |
| 2007/0103209 | A1 | 5/2007 | Lee |
| 2007/0127108 | A1 | 6/2007 | Hayes et al. |
| 2007/0150813 | A1 | 6/2007 | Selebrede et al. |
| 2007/0159679 | A1 | 7/2007 | Hagood et al. |
| 2007/0172171 | A1 | 7/2007 | Van Ostrand et al. |
| 2007/0190265 | A1 | 8/2007 | Aoki et al. |
| 2007/0195026 | A1 | 8/2007 | Hagood et al. |
| 2007/0205969 | A1 | 9/2007 | Hagood et al. |
| 2007/0216987 | A1 | 9/2007 | Hagood et al. |
| 2007/0223080 | A1 | 9/2007 | Hagood et al. |
| 2007/0247401 | A1 | 10/2007 | Sasagawa et al. |
| 2007/0279727 | A1 | 12/2007 | Gandhi et al. |
| 2007/0297747 | A1 | 12/2007 | Biernath et al. |
| 2008/0014557 | A1 | 1/2008 | Kuhn et al. |
| 2008/0026066 | A1 | 1/2008 | Roser |
| 2008/0030827 | A1 | 2/2008 | Hagood et al. |
| 2008/0037104 | A1 | 2/2008 | Hagood et al. |
| 2008/0062500 | A1 | 3/2008 | Hagood |
| 2008/0094853 | A1 | 4/2008 | Kim et al. |
| 2008/0123175 | A1 | 5/2008 | Hagood et al. |
| 2008/0129681 | A1 | 6/2008 | Hagood et al. |
| 2008/0145527 | A1 | 6/2008 | Hagood et al. |
| 2008/0158635 | A1 | 7/2008 | Hagood et al. |
| 2008/0158636 | A1 | 7/2008 | Hagood et al. |
| 2008/0165122 | A1 | 7/2008 | Duthaler et al. |
| 2008/0174532 | A1 | 7/2008 | Lewis |
| 2008/0278798 | A1 | 11/2008 | Hagood et al. |
| 2008/0279727 | A1 | 11/2008 | Haushalter |
| 2008/0283175 | A1 | 11/2008 | Hagood et al. |
| 2008/0297880 | A1 | 12/2008 | Steckl et al. |
| 2009/0034052 | A1 | 2/2009 | Hagood et al. |
| 2009/0103164 | A1 | 4/2009 | Fijol et al. |
| 2009/0103281 | A1 | 4/2009 | Koh |
| 2009/0141335 | A1 | 6/2009 | Feenstra et al. |
| 2009/0195855 | A1 | 8/2009 | Steyn et al. |
| 2009/0284824 | A1 | 11/2009 | Feenstra et al. |
| 2011/0122474 | A1 | 5/2011 | Payne et al. |
| 2011/0148948 | A1 | 6/2011 | Gandhi et al. |
| 2011/0164067 | A1 | 7/2011 | Lewis et al. |
| 2011/0205259 | A1 | 8/2011 | Hagood, IV |
| 2011/0255146 | A1 | 10/2011 | Brosnihan et al. |
| 2011/0267668 | A1 | 11/2011 | Hagood, IV et al. |
| 2012/0133006 | A1 | 5/2012 | Hasselbach et al. |
| 2012/0169795 | A1 | 7/2012 | Hagood et al. |
| 2012/0200906 | A1 | 8/2012 | Wu et al. |
| 2012/0229226 | A1 | 9/2012 | Oja et al. |
| 2012/0280971 | A1 | 11/2012 | Hagood et al. |
| 2012/0320111 | A1 | 12/2012 | Hagood, IV et al. |
| 2012/0320112 | A1 | 12/2012 | Hagood, IV et al. |
| 2012/0320113 | A1 | 12/2012 | Hagood, IV et al. |
| 2013/0010341 | A1 | 1/2013 | Hagood et al. |
| 2013/0010342 | A1 | 1/2013 | Hagood, IV et al. |
| 2013/0010344 | A1 | 1/2013 | Hagood et al. |

FOREIGN PATENT DOCUMENTS

| | | | |
|---|---|---|---|
| CN | 1402033 | A | 3/2003 |
| CN | 1542499 | A | 11/2004 |
| CN | 1555472 | A | 12/2004 |
| DE | 10332647 | A1 | 2/2005 |
| EP | 0366847 | A2 | 5/1990 |
| EP | 0438614 | A1 | 7/1991 |
| EP | 0 359 450 | B1 | 11/1994 |
| EP | 0 495 273 | B1 | 9/1996 |
| EP | 0 415 625 | B1 | 1/1997 |
| EP | 0757958 | | 2/1997 |
| EP | 0786679 | A2 | 7/1997 |
| EP | 0 884 525 | A2 | 12/1998 |
| EP | 0889458 | A2 | 1/1999 |
| EP | 0 751 340 | B1 | 5/2000 |
| EP | 1 091 342 | | 4/2001 |
| EP | 1091343 | A2 | 4/2001 |
| EP | 1091842 | | 4/2001 |
| EP | 1093142 | | 4/2001 |
| EP | 1 202 096 | A2 | 5/2002 |
| EP | 1202244 | A1 | 5/2002 |
| EP | 1 426 190 | A1 | 6/2004 |
| EP | 1 429 310 | | 6/2004 |
| EP | 1 471 495 | | 10/2004 |
| EP | 1533853 | A2 | 5/2005 |
| EP | 1551002 | A2 | 7/2005 |
| EP | 1674893 | A1 | 6/2006 |
| EP | 1734502 | A1 | 12/2006 |
| EP | 1757958 | A1 | 2/2007 |
| EP | 2263968 | | 12/2010 |
| EP | 1858796 | | 1/2011 |
| EP | 2287110 | | 2/2011 |
| EP | 1640770 | | 4/2012 |
| FR | 2 726 135 | | 10/1994 |
| GB | 2343980 | A | 5/2000 |
| JP | 57062028 | A | 4/1982 |
| JP | 57127264 | | 8/1982 |
| JP | 03-142409 | | 6/1991 |
| JP | 04-249203 | | 9/1992 |
| JP | 5045648 | A | 2/1993 |
| JP | 6194649 | A | 7/1994 |
| JP | 8334752 | A | 12/1996 |
| JP | 09-080386 | A | 3/1997 |
| JP | 09-189869 | A | 7/1997 |
| JP | 09-198906 | | 7/1997 |
| JP | 10-282474 | A | 10/1998 |
| JP | 11-015393 | | 1/1999 |
| JP | 11024038 | A | 1/1999 |
| JP | 2000105547 | | 4/2000 |
| JP | 2000121970 | | 4/2000 |
| JP | 2000172219 | | 6/2000 |
| JP | 2000214831 | | 8/2000 |
| JP | 2001125014 | | 5/2001 |
| JP | 2001154642 | | 6/2001 |
| JP | 2001175216 | A | 6/2001 |
| JP | 2001-201698 | A | 7/2001 |
| JP | 2001201767 | | 7/2001 |
| JP | 2001-281563 | A | 10/2001 |
| JP | 2001356327 | | 12/2001 |
| JP | 2002214543 | A | 7/2002 |
| JP | 2002528763 | A | 9/2002 |
| JP | 2002-318564 | A | 10/2002 |
| JP | 2002318564 | A | 10/2002 |
| JP | 2002365650 | A | 12/2002 |

| | | | |
|---|---|---|---|
| JP | 2003-036057 | | 2/2003 |
| JP | 2003-162904 | | 6/2003 |
| JP | 2003-248463 | | 9/2003 |
| JP | 2004-191736 | A | 7/2004 |
| JP | 2004287215 | A | 10/2004 |
| JP | 2004-317785 | A | 11/2004 |
| JP | 2004534280 | A | 11/2004 |
| JP | 2004347982 | | 12/2004 |
| JP | 2005512119 | A | 4/2005 |
| JP | 2006522360 | A | 9/2006 |
| WO | WO 94/01716 | | 1/1994 |
| WO | WO-97/04436 | | 2/1997 |
| WO | WO 98/04950 | | 2/1998 |
| WO | WO 99/01696 | | 1/1999 |
| WO | WO-9901696 | A1 | 1/1999 |
| WO | WO 00/50807 | | 8/2000 |
| WO | WO0052674 | A1 | 9/2000 |
| WO | WO0055916 | A1 | 9/2000 |
| WO | WO0169584 | A1 | 9/2001 |
| WO | WO0207482 | A2 | 1/2002 |
| WO | WO 03/008860 | A1 | 1/2003 |
| WO | WO03004836 | A1 | 1/2003 |
| WO | WO03007049 | | 1/2003 |
| WO | WO03040802 | A2 | 5/2003 |
| WO | WO03048836 | A2 | 6/2003 |
| WO | WO 03/050448 | A1 | 7/2003 |
| WO | WO 03/061329 | A2 | 7/2003 |
| WO | WO03069593 | A2 | 8/2003 |
| WO | WO03081315 | A1 | 10/2003 |
| WO | WO 2004/019120 | A1 | 3/2004 |
| WO | WO2004034136 | A1 | 4/2004 |
| WO | WO-2004/008629 | | 10/2004 |
| WO | WO 2004/086098 | A2 | 10/2004 |
| WO | WO-2004/088629 | | 10/2004 |
| WO | WO2004097506 | | 11/2004 |
| WO | WO 2005/001892 | A2 | 1/2005 |
| WO | WO 2005/062908 | A2 | 7/2005 |
| WO | WO-2005/073950 | | 8/2005 |
| WO | WO2005082908 | A1 | 9/2005 |
| WO | WO-2006017129 | | 2/2006 |
| WO | WO 2006/023077 | A2 | 3/2006 |
| WO | WO 2006/039315 | A2 | 4/2006 |
| WO | WO 2006/052755 | A2 | 5/2006 |
| WO | WO2006091738 | | 8/2006 |
| WO | WO2006091791 | | 8/2006 |
| WO | WO2006091904 | | 8/2006 |
| WO | WO2007075832 | | 7/2007 |
| WO | WO2007123173 | A1 | 11/2007 |
| WO | WO2007145973 | | 12/2007 |
| WO | WO2008026066 | A1 | 3/2008 |
| WO | WO2010062647 | | 6/2010 |

OTHER PUBLICATIONS

U.S. Appl. No. 11/975,397, Unpublished, Hagood et al.
U.S. Appl. No. 11/975,411, Unpublished, Hagood et al.
U.S. Appl. No. 11/975,622, Unpublished, Fijol et al.
U.S. Appl. No. 11/975,398, Unpublished, Hagood et al.
U.S. Appl. No. 11/528,191, Unpublished, Gandhi et al.
U.S. Appl. No. 11/906,542, Unpublished, Hagood et al.
U.S. Appl. No. 11/906,383, Unpublished, Hagood et al.
U.S. Appl. No. 11/978,829, Unpublished, Hagood et al.
U.S. Appl. No. 11/811,842, Unpublished, Lewis.
U.S. Appl. No. 11/973,002, Unpublished, Hagood et al.
"BLU," Heesung Precision Ltd., http://www.hspr.co.kr/eng/product/blu.asp Retrieved on Aug. 3, 2006.
"Electronic Display Lighting Tutorials," 3M Corporation, file?//D:/Optical\Vikuiti Tutorial.htm. retrieved on Aug. 10, 2006.
"Prism Brightness Enhancement Films," 3M Corporation, http://products3.3m.com/catalog/us/en001/electronics_mfg/vikuiti/node_V6G78RBQ5Tbe/root_GST1T4S9TCgv/vroot_S6Q2FD9X0Jge/gvel_GD378D0HGJgl/theme_us_vikuiti_3_0/command_AbcPageHandler/output_html Retrieved on Aug. 3, 2006.
"Prism Sheet," Mitsubishi Rayon America Inc., http://www.mrany.com/date/HTML/29.htm Retrieved on Aug. 4, 2006.
Alt et al, "A Gray-Scale Addressing Technique for Thin-Film-Transistor/Liquid Crystal Displays," IBM J. Res. Develop., 36(1):11-22(Jan. 1992).
AZ Displays, Inc. Complete LCD Solutions, ATM3224C-NC-FTH.
B. J. Feenstra et. al. "A Reflective Display Based on Electrowetting: Principle and Properties", International Display Research Conference Proceedings 2003, p. 322.
Blackstone, "Making MEMS Reliable," SPIE's OEMagazine, 32-34(Sep. 2002).
Bozler et al, "Arrays of gated field-emitter cones having 0.32 □m tip-to-tip spacing," J. Vec. Sci. Technol. B, 12(2):629-632 (Mar./Apr. 1994).
Davis, "Light Emitting Diode Source Modeling for Optical Design," Reflexite Display Optics(Oct. 2004).
den Boer, "Active Matrix Liquid Crystal Displays," Elsevier Science & Technology Books, ISBN #0750678135, Aug. 2005.
Doane, et al, "Display Technologies in Russia, Ukraine, and Belarus," World Technology Evaluation Center Panel Report (Dec. 1994).
Feenstra et al, "Electrowetting Displays," Liquavista BV, http://www.liquavista.com/documents/electrowetting_displays_whitepaper.pdf, Retrieved on Aug. 17, 2006.
Feng, "High Quality Light Guide Plates that Can Control the Illumination Angle Based on Microprism Structures," Applied Physics Letters, 85(24):6016-6018(Dec. 2004).
Goddhue et al, "Bright-field analysis of field-emission cones using high-resolution tranmission electron microscopy and the effect of structural properties on current stability," J. Vac. Sci. Technol. B, 12(2):693-696(Mar.Apr. 1994).
Koden et al, "Ferroelectric Liquid Crystal Display," (Sep. 17, 1997).
Legtenberg et al, "Electrostatic Curved Electrode Actuators," Journal of Microelectromechanical Systems, 6:3(257-265)(Sep. 1997).
Liang et al, "Observation of electric field gradients near field-emission cathode arrays," Appl Phys. Lett., 66(9):1147-1149(Feb. 1995).
Liu et al, "Scaling Laws of Microactuators and Potential Applications of Electroactive Polymers in MEMS," SPIE, 3669:345-354(Mar. 1999).
Mastrangelo et al, "Mechanical Stability and Adhesion of Microstructures Under Capillary Forces—Part I: Basic Theory," Journal of Microelectromechanical Systems, 2(1):33-43(Mar. 1993).
Mastrangelo et al, "Mechanical Stability and Adhesion of Microstructures Under Capillary Forces—Part II: Experiments," Journal of Microelectromechanical Systems, 2(1):44-55(Mar. 1993).
McLauǵhlin, "Progress in Projection and Large-Area Displays," Proceedings of the IEEE, 90(4):521-532(Apr. 2002).
Okumura et al, "Highly-efficient backlight for liquid crystal display having no optical films," Applied Physics Letters, 83(13):2515-2517(Sep. 2003).
Qiu et al, "A Curved-Beam Bistable Mechanism," Journal of Microelectromechanical Systems, 13(2):137-145(Apr. 2004).
Sharp Specification No. LCP-03015 for Mobile Liquid Crystal Display Group, Sharp Corporation, Jun. 13, 2003.
Shikida et al, "Fabrication fo an S-shaped Microactuator," Journal of Microelectromechanical Systems, 6(1):18-24(Mar. 1997).
Steyn, Lodewyck, "Electroquasistatic Zipper Actuators: A Technology Review", Dec. 2004.
Tagaya et al, "Thin Liquid-Crystal Display Backlight System with Highly Scattering Optical Transmission Polymers," Applied Optics, 40(34):6274-6280(Dec. 2001).
Teijido, J.M., "Conception and Design of Illumination Light Pipes," Thesis No. 1498 for University of Neuchatel, http://www.unige.ch/cyberdocuments/unine/theses2000/TeijidoJM/these_front.htm l:1-99 Retrieved on Aug. 3, 2006.
Underwood, "A review of microdisplay technologies," SID@EID, (Nov. 21 to 23, 2000).
Non Final Office Action dated Nov. 1, 2006, U.S. Appl. No. 11/218,690.
Final Office Action dated May 18, 2007, U.S. Appl. No. 11/218,690.
Final Office ActionDated Oct. 3, 2007, U.S. Appl. No. 11/218,690.
Non Final Office Action Dated Mar. 22, 2007, U.S. Appl. No. 11/546,937.
Final Office Action dated Sep. 21, 2007, U.S. Appl. No. 11/546,937.
International Search Report from PCT/US2007/013277.
Bouchina, M., et al, "Air-gam amorphous silicon thin film transistors," Applied Physics Letters, 73(4):502-4 (1998).

Conde, J.P., et al., "Low-temperature Thin-Film Silicon MEMS", Thin Solid Films 421:181-186 (2003).
Conde, J.P., et. al., "Amorphous and microcrystalline silicon deposited by hot-wire chemical vapor deposition at low substrate temperatures: application to devices and thin-film microelectromechanical systems," Thin Solid Films 395:105-111 (2001).
Judy, et al, "Self-Adjusting Microstructures(SAMS)," Proceedings of the Workshop on Micro Electro Mechanical Systems, New York, Jan. 30, 1991, vol. Workshop 4, pp. 51-56.
Kalantar, K., et al., "Backlight Unit with Dboule Surface Light Emission Using a Single Micro-structured Light-Guide Plate," p. 1182, Society for Information Display Digest (2004).
Kim et al. "Manufacturing Technologies for the Next Generation a-Si TFT-LCD," Proceedings of the Int'l. Display Mfg. Cnf. Seoul, Korea. (2000).
Markandey, V., et al., "Video Processing for DLP Display Systems," Texas Instruments Corporation, 2666:21-32 (Mar. 13, 1996).
Office Action dated Jul. 15, 2010 in Japanese Patent Application No. 2007-556428.
Office Action dated Oct. 14, 2010 in Japanese Patent Application No. 2008-058190.
Office Action dated Sep. 16, 2011 in Japanese Patent Application No. 2007-556428.
Park et al. P-70: Active Matrix OLED Displays Using Simple Poly-Si TFT Process. Society of Information Display, Digest. pp. 487-89 (2003).
Office Action dated Dec. 5, 2011 in Japanese Patent Application No. 2008-058190.
Doherty, D., et. al. "Pulse Width Modulation Control of DLP Projectors", TI Technical Journal, No. 3, pp. 115-121 (Jul.-Sep. 1998).
Jepsen, M. L., et al, "4.11: 0.9" SXGA Liquid Crystal on Silicon Panel with 450 Hz. Field Rate, SID MicroDisplay, pp. 106-109 (Sep. 2001).
"Optical Design Tools for Backlight Displays," Light Tools, Optical Engineering, Publication of ROCOES, 81:90-101 (Jun. 2003).
Akimoto, et al. "15.1: A 0.9-in UXGA/HDTV FLC Microdisplay," Society for Information Display, pp. 194-197 (2000).
Bergquist et. al. "Field Sequential Colour Display with Adaptive Gamut", Society for Information Display, Digest of Technical Papers 2006, pp. 1594-1597.
Birch et al, "31.1: SXGA Resolution FLC Microdisplays," SID 02 Digest, 954-957 (2002).
Bryan-Brown, "Ultra Low Power Bistable LCDs," SID 00, 76-79 (2000).
Chino, E., et al., "25.1: Invited Paper: Development of Wide-Color-Gamut Mobile Displays with Four-primary-color LCDs," Society for Information Display, 37 (2): 1221-1224 (2006).
Clark et al, "FLC Microdisplays," Ferroelectrics, 246: 97-110 (2000).
Davis, A., "Microstructured Optics for LED Applications," Reflexite Display Optics (2002).
Feng, et al, "Novel Integrated Light-Guide Plates for Liquid Crystal Display Backlight," Journal of optics a Pure and applied optics, 2005, 7, 111-117.
Foley, "NE04-21: Microstructured Plastic Optics for Display, Lighting, and Telecommunications Applications," Fresnel Optics (2001).
Funamoto et al, "Diffusive-sheetless Backlight System for Mobile Phone," IDW/AD, 1277-1280 (2005).
Funamoto et. al. "LED Backlight System with Double-Prism Pattern", Journal of the Society for Information Display v. 14, pp. 1045-1051 (2006).
Hartman, "4.1: Invited paper: Two-Terminal Devices Technologies for AMLCDs," SID 95 Digest, 7-10 (1995).
Hewlett et al, "DLP CinemaTM projection: a hybrid frame-rate technique for flicker-free performance," Journ of the SID 9/3, 221-226 (2001).
Heikenfeld, J., et. al., "Contrast Enhancement in Black Dielectric Electroluminescent Devices", IEEE Transactions on Electron Devices, 49: 8, 1348-52 (2002).
Jones et al, "29-1: Addressing TVmin Ferroelectric Liquid Crystal Displays," (1998).
Judy, M. W., "Micromechanisms Using Sidewall Beams," Dissertation, University of California at Berkeley, 1994.
Kalantar et al, "Optical Micro Deflector Based Functional Light-Guide Plate for Backlight Unit," SID 00 Digest, 1029-1031 (2000).
Kalantar, "Modulation of viewing angle on an LCD surface through backlight optics," Journal of the SID, 11 (4): 647-652 (2003).
Kuang et al., "Dynamic characteristics of shaped micro-actuators solved using the differential quadrature method," Journal of Micromechanics and Microengineering, 14: 647-655, (2004).
Kunzman, A., et al., "10.3 White Enhancement for Color Sequential DLP" Society for Information Display, Digest of Technical Papers 1998.
Lee et. al. "40.1: Distinguished Contributed Paper: Integrated Amorphous Silicon Color Sensor on LCD Panel for LED Backlight Feedback Control System", Society for Information Display, Digest of Technical Papers, pp. 1376-1379 (2005).
Lee et al, "P-25: A LCOS Microdisplay Driver with Frame Buffering Pixels," SID 02 Digest, 292-295 (2002).
Li, J., et al., "DRIE-Fabricated Curved-Electrode Zipping Actuators with Low Pull-In Voltage," 12th International Conference on Solid State Sensors, Actuators and Microsystems, IEE, 480-483 (2003).
Maboudian et al., "Stiction reduction processes for surface micromachines," Tribology Letters, 3: 215-221 (1997).
"Microprism Technology for Luminaires," Reflexite Corporation, Technical Publication RLO-181, Rev. 2 (2004).
Perregaux, G., et al, "Arrays of Addressable High-Speed Optical Microshutters," CSEM Swiss Center for Electronics and Microtechnology Inc., Microsystems Division, pp. 232-235 (2001).
Ravnkilde, J., et al. "Fabrication of Nickel Microshutter Arrays for Spatial Light Modulation," Mesomechanics, pp. 161-165 (2002). Also on their web site: http://www2.mic.dtu.dk/research/mems/publications/Papers/Dicon_Meso2002.pdf (2002).
Roosendaal et al, "25.2: A Wide Gamut, High Aperture Mobile Spectrum Sequential Liquid Crystal Display," SID 05 Digest, 1116-1119 (2005).
Pasricha, S., et. al. "Dynamic Backlight Adaptation for Low Power Handheld Devices" IEEE Design and Test v. 21, p. 398 (2004).
Saeedi, et. al. "Molten-Alloy Driven Self-Assembly for Nano and Micro Scale System Integration" Fluid Dynamics and Materials Processing, vol. 2, No. 4, pp. 221-245 (2006).
Sato, "Research on Flexible Display Systems," Broadcast Technology, 21: 10-15 (Winter, 2005).
Takatori et al., "6.3: Field-Sequential Smectic LCD with TFT Pixel Amplifier," SID 01 Digest, 48-51 (2001).
Tan et al "Soldering Technology for Optoelectronics Packaging", 1996 Electronic Components and Technology Conference, pp. 26-36 (1996).
Tien et al, "MEMS Actuators for Silicon Micro-Optical Elements," Proc. of SPIE, 4178: 256-269, (2000).
Underwood, "LCoS through the looking glass," SID (2001).
van de Biggelaar, et. al. "Passive and Active Matrix Addressed Polymer Light-emitting Diode Displays", Proc. SPIE vol. 4295, p. 134 (2001).
Vangbo et al, "A lateral symmetrically bistable buckled beam," J. Micromech. Microeng., 8: 29-32 (1998).
Yamada et al, "52.2: Invited Paper: Color Sequential LCD Based on OCB with an LED Backlight," SID 00 Digest, 1180-1183 (2000).
Yasumura et al, "Fluid Damping of an Electrostatic Actuator for Optical Switching Applications," Transducers Research Foundation (2002).
Boeuf, J.P., "Plasma display panels: physics,recent deveopments and key issues," J. Phys. D: Appl. Phys. 36 (2003) R53-R79 (received Aug. 29, 2002: published Feb. 26, 2003).
Hornbeck, J., "Digital Light Processing TM: A New MEMS-Based Display Technology," Technical Digest of the IEEJ 14th Sensor Symposium, pp. 297-304 (Jun. 4-5, 1996).
Johnstone et al, "Theoretical limits on the freestanding length of cantilevers produced by surface micromachining technology," J. Micromech. Microeng. 12: 855-861 (Published Oct. 3, 2002).
"MicroLensTm—Re-Inventing LCD Backlighting," Global Lighting Technologies Inc., http://www.glthome.com/tech.htm, 1-2; retrieved on Aug. 3, 2006.

Qui et al, "A High-Current Electrothermal Bistable MEMS Relay," Micro Electro Mechanical Systems, MEMS-03 Kyoto, pp. 64-67 (Jan. 19-23, 2003).

"Two Proprietary Technologies Supporting OMRON Backlight," OMRON Electronics Corporation, OMRON Electronics Components Web, www.omron.co.jp/ecb/products/bklight/english/genri/index.html, retrieved on Aug. 3, 2006.

Wang, K., et al, "Highly Space-Efficient Electrostatic Zigzag Transmissive Micro-Optic Switches for an Integrated MEMS Optical Display System", Transducers 03 Conference, 1: 575-575 (Jun. 8-12, 2003).

Joaquirn, M., "Polyphenyl Ether Lubricants" Synthetic Lubricants and High-performance Functional Fluids, R. L. Rudnick and R. L. Shubkin, Eds., p. 239, Marcel Dekker, Inc., NY, 1999.

Wang et al., "A highly efficient system for automatic face region detection in MPEG video." IEEE Trans. on Circuits and Systems for Video Technology, vol. 7 Issue 4, Aug. 1997, pp. 615-628.

Notice of Allowance and Fee(s) Due, mailed Jan. 31, 2008 (U.S. Appl. No. 11/361,785).

Office Action dated Mar. 28, 2012 in European Patent Office Application No. 07795777.7.

* cited by examiner

CIRCUITS FOR CONTROLLING MEMS DISPLAY APPARATUS ON A TRANSPARENT SUBSTRATE

CROSS-REFERENCE TO RELATED APPLICATIONS

This application claims the benefit of U.S. Provisional Patent Application No. 60/881,757 filed Jan. 19, 2007 and entitled "High Voltage Protection Circuitry for Control Matrices in Active Matrix Displays," and is a continuation-in-part of U.S. patent application Ser. No. 11/326,696 filed Jan. 6, 2006 and entitled "Display Methods and Apparatus," the entirety of which is incorporated herein by reference.

FIELD OF THE INVENTION

In general, the invention relates to the field of imaging displays, in particular, the invention relates to controller circuits and processes for controlling light modulators incorporated into imaging displays.

BACKGROUND OF THE INVENTION

Displays built from mechanical light modulators are an attractive alternative to displays based on liquid crystal technology. Mechanical light modulators are fast enough to display video content with good viewing angles and with a wide range of color and grey scale. Mechanical light modulators have been successful in projection display applications. Direct-view displays using mechanical light modulators have not yet demonstrated sufficiently attractive combinations of brightness and low power. There is a need in the art for fast, bright, low-powered mechanically actuated direct-view displays. Specifically there is a need for direct-view displays that can be driven at high speeds and at low voltages for improved image quality and reduced power consumption.

In contrast to projection displays in which switching circuitry and light modulators can be built on relatively small die cut from silicon substrates, most direct-view displays require the fabrication of light modulators on much larger substrates. In addition, in many cases, particularly for backlit direct view displays, both the control circuitry and the light modulators are preferably formed on transparent substrates. As a result, many typical semiconductor manufacturing processes are inapplicable. New switching circuits and control algorithms often need to be developed to address the fundamental differences in materials, process technology, and performance characteristics of MEMS devices built on transparent substrates. A need remains for MEMS direct-view displays that incorporate modulation processes in conjunction with switching circuitry that yield detailed images along with rich levels of grayscale and contrast.

SUMMARY OF THE INVENTION

The invention relates to display apparatuses having an array of pixels, a substrate, and a control matrix formed on the substrate. The array may include light modulators that each correspond to pixels in the array. The substrate may be transparent. The control matrix may have at least one switch or cascode corresponding to each pixel in the array.

According to one aspect of the invention, a display apparatus includes an array of pixels, a transparent substrate, and a control matrix formed on the transparent substrate. The array of pixels includes a plurality of MEMS light modulators each corresponding to a pixel in the array. The control matrix has, for each pixel in the array, a set of switches comprising a first switch and a second switch directly connected in series. The first and second switches may include a first transistor and a second transistor, respectively.

In one embodiment, the set of switches connects an energy source to a MEMS light modulator of the respective pixel. The set of switches may include a first transistor and a second transistor that share a common gate voltage. A gate of the first transistor and a gate of the second transistor may be substantially at a first voltage and a second voltage, respectively, where the first and second voltages are different for at least one moment in time. The second voltage may be substantially equal to half of the first voltage while the first and second transistors are each in an off state. A cascode interconnect may supply the second voltage to the gate of the second transistor. The energy source may be connected to an actuation voltage interconnect for supplying an actuation voltage to the MEMS light modulator of the respective pixel. The second voltage may be substantially equal to half of the actuation voltage while the first and second transistors are each in an off state. The actuation voltage interconnect may be a global common interconnect for supplying the actuation voltage to multiple pixels in the array. The respective pixel may include a first actuator and/or a second actuator for driving the MEMS light modulator of the respective pixel into a first state and/or second state, respectively. A second actuation voltage interconnect may supply an actuation voltage to the second actuator. The second actuator may be connected to the energy source via at least one switch.

In another embodiment, current flows through the set of switches from a MEMS light modulator of the respective pixel to a current drain interconnect. The set of switches may include a first transistor and a second transistor that share a common gate voltage. A gate of the first transistor and a gate of the second transistor may be substantially at a first voltage and a second voltage, respectively, where the first and second voltages are different for at least one moment in time. The first voltage may be substantially equal to half of an actuation voltage supplied to the MEMS light modulator of the respective pixel while the first and second transistors are each in an off state. A data voltage interconnect may supply a data voltage to the respective pixel, where the data voltage is applied to the gate of the second transistor. A cascode interconnect may supply the first voltage to the gate of the first transistor. The respective pixel may include a first actuator and/or second actuator for driving the MEMS light modulator of the respective pixel into a first state and/or second state, respectively. The control matrix may include a first actuation voltage interconnect for supplying a first actuation voltage to the first actuator. The first actuation voltage interconnect may be a global common interconnect for supplying the actuation voltage to multiple pixels in the array. A second actuation voltage interconnect may supply a second actuation voltage to the second actuator. The second actuator may be connected to the first actuation voltage interconnect via at least one switch.

According to another aspect of the invention, a display apparatus includes an array of pixels, a transparent substrate, and a control matrix formed on the transparent substrate. The array of pixels includes a plurality of light modulators each corresponding to a pixel in the array. The control matrix has, for each pixel in the array, a charging cascode and a discharging cascode. The charging cascode connects an energy source to a light modulator of the respective pixel. Current flows through the discharging cascode from the light modulator of the respective pixel to a current drain interconnect, where the charging and discharging cascodes are connected to a common interconnect. The control matrix may be a CMOS control matrix.

The charging cascode may include a first switch and a second switch directly connected in series and the discharging cascode may include a third switch and a fourth switch directly connected in series. The first switch may include a first transistor connecting the energy source and the second switch. The second switch may include a second transistor connecting the first switch and the light modulator of the respective pixel. The third switch may include a third transistor connecting the light modulator of the respective pixel and the fourth switch. The fourth switch may include a fourth transistor connecting the third switch and the current drain interconnect.

In one embodiment, the energy source is connected to an actuation voltage interconnect for supplying an actuation voltage to the light modulator of the respective pixel. The actuation voltage interconnect may be a global common interconnect for supplying the actuation voltage to multiple pixels in the array. The common interconnect may be at a voltage that is substantially half of the actuation voltage.

In one embodiment, the plurality of light modulators includes a plurality of MEMS light modulators each corresponding to a pixel in the array. The respective pixel may include a first actuator and/or second actuator for driving a MEMS light modulator of the respective pixel into a first state and/or second state, respectively. A second actuation voltage interconnect may supply a second actuation voltage to the second actuator. The second actuator may be connected to the first actuation voltage interconnect via at least one switch.

BRIEF DESCRIPTION OF THE DRAWINGS

The foregoing discussion will be understood more readily from the following detailed description of the invention with reference to the following drawings.

DESCRIPTION OF CERTAIN ILLUSTRATIVE EMBODIMENTS

To provide an overall understanding of the invention, certain illustrative embodiments will now be described, including apparatus and methods for displaying images. However, it will be understood by one of ordinary skill in the art that the systems and methods described herein may be adapted and modified as is appropriate for the application being addressed and that the systems and methods described herein may be employed in other suitable applications, and that such other additions and modifications will not depart from the scope hereof.

Figure 1A:
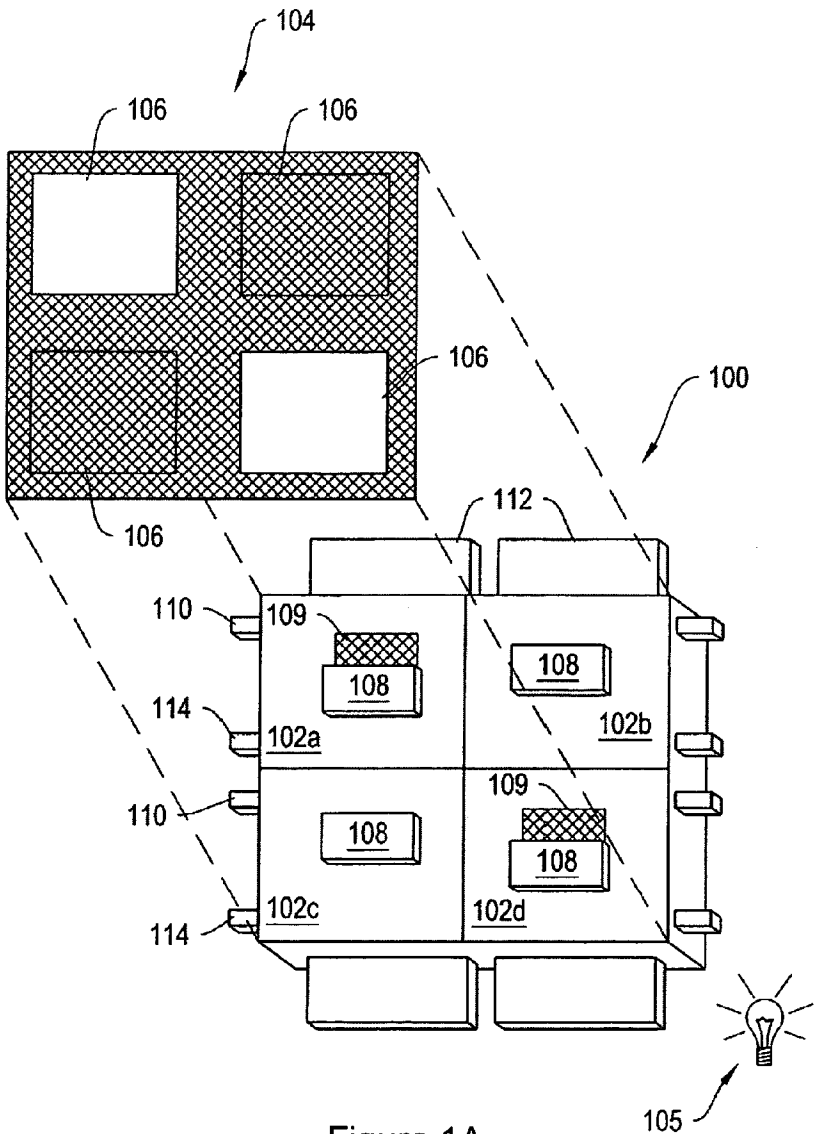
FIG. 1A is an isometric view of display apparatus, according to an illustrative embodiment of the invention.

FIG. 1A is a schematic diagram of a direct-view MEMS-based display apparatus 100, according to an illustrative embodiment of the invention. The display apparatus 100 includes a plurality of light modulators 102*a*-102*d* (generally "light modulators 102") arranged in rows and columns. In the display apparatus 100, light modulators 102*a* and 102*d* are in the open state, allowing light to pass. Light modulators 102*b* and 102*c* are in the closed state, obstructing the passage of light. By selectively setting the states of the light modulators 102*a*-102*d*, the display apparatus 100 can be utilized to form an image 104 for a backlit display, if illuminated by a lamp or lamps 105. In another implementation, the apparatus 100 may form an image by reflection of ambient light originating from the front of the apparatus. In another implementation, the apparatus 100 may form an image by reflection of light from a lamp or lamps positioned in the front of the display, i.e. by use of a frontlight. In one of the closed or open states, the light modulators 102 interfere with light in an optical path by, for example, and without limitation, blocking, reflecting, absorbing, filtering, polarizing, diffracting, or otherwise altering a property or path of the light.

In the display apparatus 100, each light modulator 102 corresponds to a pixel 106 in the image 104. In other implementations, the display apparatus 100 may utilize a plurality of light modulators to form a pixel 106 in the image 104. For example, the display apparatus 100 may include three color-specific light modulators 102. By selectively opening one or more of the color-specific light modulators 102 corresponding to a particular pixel 106, the display apparatus 100 can generate a color pixel 106 in the image 104. In another example, the display apparatus 100 includes two or more light modulators 102 per pixel 106 to provide grayscale in an image 104. With respect to an image, a "pixel" corresponds to the smallest picture element defined by the resolution of the image. With respect to structural components of the display apparatus 100, the term "pixel" refers to the combined mechanical and electrical components utilized to modulate the light that forms a single pixel of the image.

Display apparatus 100 is a direct-view display in that it does not require imaging optics. The user sees an image by looking directly at the display apparatus 100. In alternate embodiments the display apparatus 100 is incorporated into a projection display. In such embodiments, the display forms an image by projecting light onto a screen or onto a wall. In projection applications the display apparatus 100 is substantially smaller than the projected image 104.

Direct-view displays may operate in either a transmissive or reflective mode. In a transmissive display, the light modulators filter or selectively block light which originates from a lamp or lamps positioned behind the display. The light from the lamps is optionally injected into a light guide or "backlight". Transmissive direct-view display embodiments are often built onto transparent or glass substrates to facilitate a sandwich assembly arrangement where one substrate, containing the light modulators, is positioned directly on top of the backlight. In some transmissive display embodiments, a color-specific light modulator is created by associating a color filter material with each modulator 102. In other transmissive display embodiments colors can be generated, as described below, using a field sequential color method by alternating illumination of lamps with different primary colors.

Each light modulator 102 includes a shutter 108 and an aperture 109. To illuminate a pixel 106 in the image 104, the shutter 108 is positioned such that it allows light to pass through the aperture 109 towards a viewer. To keep a pixel 106 unlit, the shutter 108 is positioned such that it obstructs the passage of light through the aperture 109. The aperture 109 is defined by an opening patterned through a reflective or light-absorbing material.

The display apparatus also includes a control matrix connected to the substrate and to the light modulators for controlling the movement of the shutters. The control matrix includes a series of electrical interconnects (e.g., interconnects 110, 112, and 114), including at least one write-enable interconnect 110 (also referred to as a "scan-line interconnect") per row of pixels, one data interconnect 112 for each column of pixels, and one common interconnect 114 providing a common voltage to all pixels, or at least to pixels from both multiple columns and multiples rows in the display apparatus 100. In response to the application of an appropriate voltage (the "write-enabling voltage, $V_{we}$"), the write-enable interconnect 110 for a given row of pixels prepares the pixels in the row to accept new shutter movement instructions. The data interconnects 112 communicate the new movement instructions in the form of data voltage pulses. The data voltage pulses applied to the data interconnects 112, in some implementations, directly contribute to an electrostatic movement of the shutters. In other implementations, the data voltage pulses control switches, e.g., transistors or other non-linear circuit elements that control the application of separate actuation voltages, which are typically higher in magnitude than the data voltages, to the light modulators 102. The application of these actuation voltages then results in the electrostatic driven movement of the shutters 108.

Figure 1B:
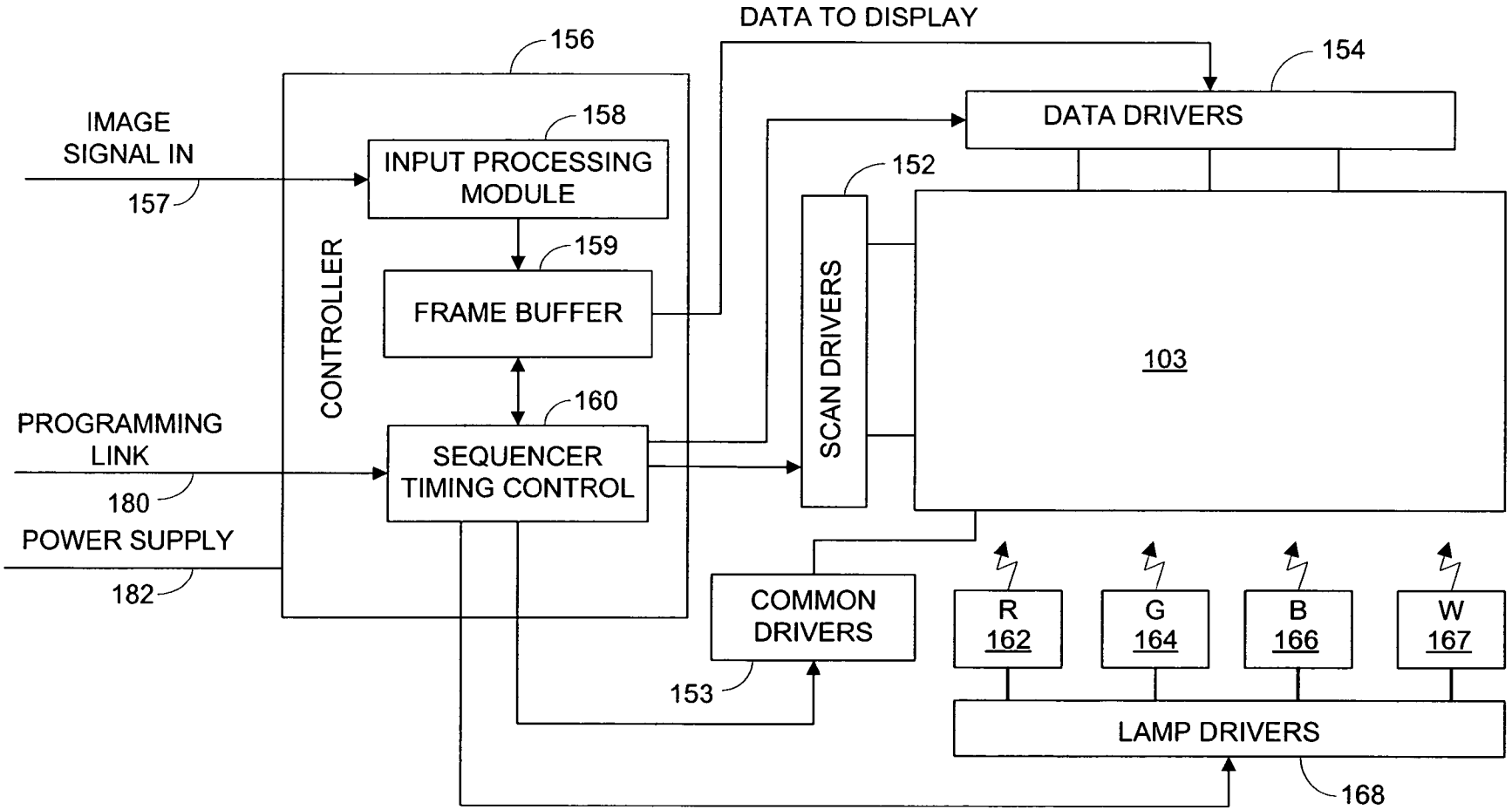
FIG. 1B is a block diagram of the display apparatus of FIG. 1A, according to an illustrative embodiment of the invention.

FIG. 1B is a block diagram 150 of the display apparatus 100. Referring to FIGS. 1A and 1B, in addition to the elements of the display apparatus 100 described above, as depicted in the block diagram 150, the display apparatus 100 includes a plurality of scan drivers 152 (also referred to as "write enabling voltage sources") and a plurality of data drivers 154 (also referred to as "data voltage sources"). The scan drivers 152 apply write enabling voltages to scan-line interconnects 110. The data drivers 154 apply data voltages to the data interconnects 112. In some embodiments of the display apparatus, the data drivers 154 are configured to provide analog data voltages to the light modulators, especially where the gray scale of the image 104 is to be derived in analog fashion. In analog operation the light modulators 102 are designed such that when a range of intermediate voltages is applied through the data interconnects 112 there results a range of intermediate open states in the shutters 108 and therefore a range of intermediate illumination states or gray scales in the image 104.

In other cases the data drivers 154 are configured to apply only a reduced set of 2, 3, or 4 digital voltage levels to the control matrix. These voltage levels are designed to set, in digital fashion, either an open state or a closed state to each of the shutters 108.

The scan drivers 152 and the data drivers 154 are connected to digital controller circuit 156 (also referred to as the "controller 156"). The controller 156 includes an input processing module 158, which processes an incoming image signal 157 into a digital image format appropriate to the spatial addressing and the gray scale capabilities of the display 100. The pixel location and gray scale data of each image is stored in a frame buffer 159 so that the data can be fed out as needed to the data drivers 154. The data is sent to the data drivers 154 in mostly serial fashion, organized in predetermined sequences grouped by rows and by image frames. The data drivers 154 can include series to parallel data converters, level shifting, and for some applications digital to analog voltage converters.

The display 100 apparatus optionally includes a set of common drivers 153, also referred to as common voltage sources. In some embodiments the common drivers 153 provide a DC common potential to all light modulators within the array of light modulators 103, for instance by supplying voltage to a series of common interconnects 114. In other embodiments the common drivers 153, following commands from the controller 156, issue voltage pulses or signals to the array of light modulators 103, for instance global actuation pulses which are capable of driving and/or initiating simultaneous actuation of all light modulators in multiple rows and columns of the array 103.

All of the drivers (e.g., scan drivers 152, data drivers 154, and common drivers 153) for different display functions are time-synchronized by a timing-control module 160 in the controller 156. Timing commands from the module 160 coordinate the illumination of red, green and blue and white lamps (162, 164, 166, and 167 respectively) via lamp drivers 168, the write-enabling and sequencing of specific rows within the array of pixels 103, the output of voltages from the data drivers 154, and the output of voltages that provide for light modulator actuation.

The controller 156 determines the sequencing or addressing scheme by which each of the shutters 108 in the array 103 can be re-set to the illumination levels appropriate to a new image 104. Details of suitable addressing, image formation, and gray scale techniques can be found in U.S. patent application Ser. Nos. 11/326,696 and 11/643,042, incorporated herein by reference. New images 104 can be set at periodic intervals. For instance, for video displays, the color images 104 or frames of video are refreshed at frequencies ranging from 10 to 300 Hertz. In some embodiments the setting of an image frame to the array 103 is synchronized with the illumination of the lamps 162, 164, and 166 such that alternate image frames are illuminated with an alternating series of colors, such as red, green, and blue. The image frames for each respective color is referred to as a color sub-frame. In this method, referred to as the field sequential color method, if the color sub-frames are alternated at frequencies in excess of 20 Hz, the human brain will average the alternating frame images into the perception of an image having a broad and continuous range of colors. In alternate implementations, four or more lamps with primary colors can be employed in display apparatus 100, employing primaries other than red, green, and blue.

In some implementations, where the display apparatus 100 is designed for the digital switching of shutters 108 between open and closed states, the controller 156 determines the addressing sequence and/or the time intervals between image frames to produce images 104 with appropriate gray scale. The process of generating varying levels of grayscale by controlling the amount of time a shutter 108 is open in a particular frame is referred to as time division gray scale. In one embodiment of time division gray scale, the controller 156 determines the time period or the fraction of time within each frame that a shutter 108 is allowed to remain in the open state, according to the illumination level or gray scale desired of that pixel. In other implementations, for each image frame, the controller 156 sets a plurality of sub-frame images in multiple rows and columns of the array 103, and the controller alters the duration over which each sub-frame image is illuminated in proportion to a gray scale value or significance value employed within a coded word for gray scale. For instance, the illumination times for a series of sub-frame images can be varied in proportion to the binary coding series 1,2,4,8 . . . The shutters 108 for each pixel in the array 103 are then set to either the open or closed state within a sub-frame image according to the value at a corresponding position within the pixel's binary coded word for gray level.

In other implementations, the controller alters the intensity of light from the lamps 162, 164, and 166 in proportion to the gray scale value desired for a particular sub-frame image. A number of hybrid techniques are also available for forming colors and gray scale from an array of shutters 108. For instance, the time division techniques described above can be combined with the use of multiple shutters 108 per pixel, or the gray scale value for a particular sub-frame image can be established through a combination of both sub-frame timing and lamp intensity. Details of these and other embodiments can be found in U.S. patent application Ser. No. 11/643,042, referenced above.

In some implementations the data for an image state 104 is loaded by the controller 156 to the modulator array 103 by a sequential addressing of individual rows, also referred to as scan lines. For each row or scan line in the sequence, the scan driver 152 applies a write-enable voltage to the write enable interconnect 110 for that row of the array 103, and subsequently the data driver 154 supplies data voltages, corresponding to desired shutter states, for each column in the selected row. This process repeats until data has been loaded for all rows in the array. In some implementations the sequence of selected rows for data loading is linear, proceeding from top to bottom in the array. In other implementations the sequence of selected rows is pseudo-randomized, in order to minimize visual artifacts. And in other implementations the sequencing is organized by blocks, where, for a block, the data for only a certain fraction of the image state 104 is loaded to the array, for instance by addressing only every $5^{th}$ row of the array in sequence.

In some implementations, the process for loading image data to the array 103 is separated in time from the process of actuating the shutters 108. In these implementations, the modulator array 103 may include data memory elements for each pixel in the array 103 and the control matrix may include a global actuation interconnect for carrying trigger signals, from common driver 153, to initiate simultaneous actuation of shutters 108 according to data stored in the memory elements. Various addressing sequences, many of which are described in U.S. patent application Ser. No. 11/643,042, can be coordinated by means of the timing control module 160.

In alternative embodiments, the array of pixels 103 and the control matrix that controls the pixels may be arranged in configurations other than rectangular rows and columns. For example, the pixels can be arranged in hexagonal arrays or curvilinear rows and columns. In general, as used herein, the term scan-line shall refer to any plurality of pixels that share a write-enabling interconnect.

The display 100 is comprised of a plurality of functional blocks including the timing control module 160, the frame buffer 159, scan drivers 152, data drivers 154, and drivers 153 and 168. Each block can be understood to represent either a distinguishable hardware circuit and/or a module of executable code. In some implementations the functional blocks are provided as distinct chips or circuits connected together by means of circuit boards and/or cables. Alternately, many of these circuits can be fabricated along with the pixel array 103 on the same substrate of glass or plastic. In other implementations, multiple circuits, drivers, processors, and/or control functions from block diagram 150 may be integrated together within a single silicon chip, which is then bonded directly to the transparent substrate holding pixel array 103.

The controller 156 includes a programming link 180 by which the addressing, color, and/or gray scale algorithms, which are implemented within controller 156, can be altered according to the needs of particular applications. In some embodiments, the programming link 180 conveys information from environmental sensors, such as ambient light or temperature sensors, so that the controller 156 can adjust imaging modes or backlight power in correspondence with environmental conditions. The controller 156 also comprises a power supply input 182 which provides the power needed for lamps as well as light modulator actuation. Where necessary, the drivers 152 153, 154, and/or 168 may include or be associated with DC-DC converters for transforming an input voltage at 182 into various voltages sufficient for the actuation of shutters 108 or illumination of the lamps, such as lamps 162, 164, 166, and 167.

MEMS Light Modulators

Figure 2A:
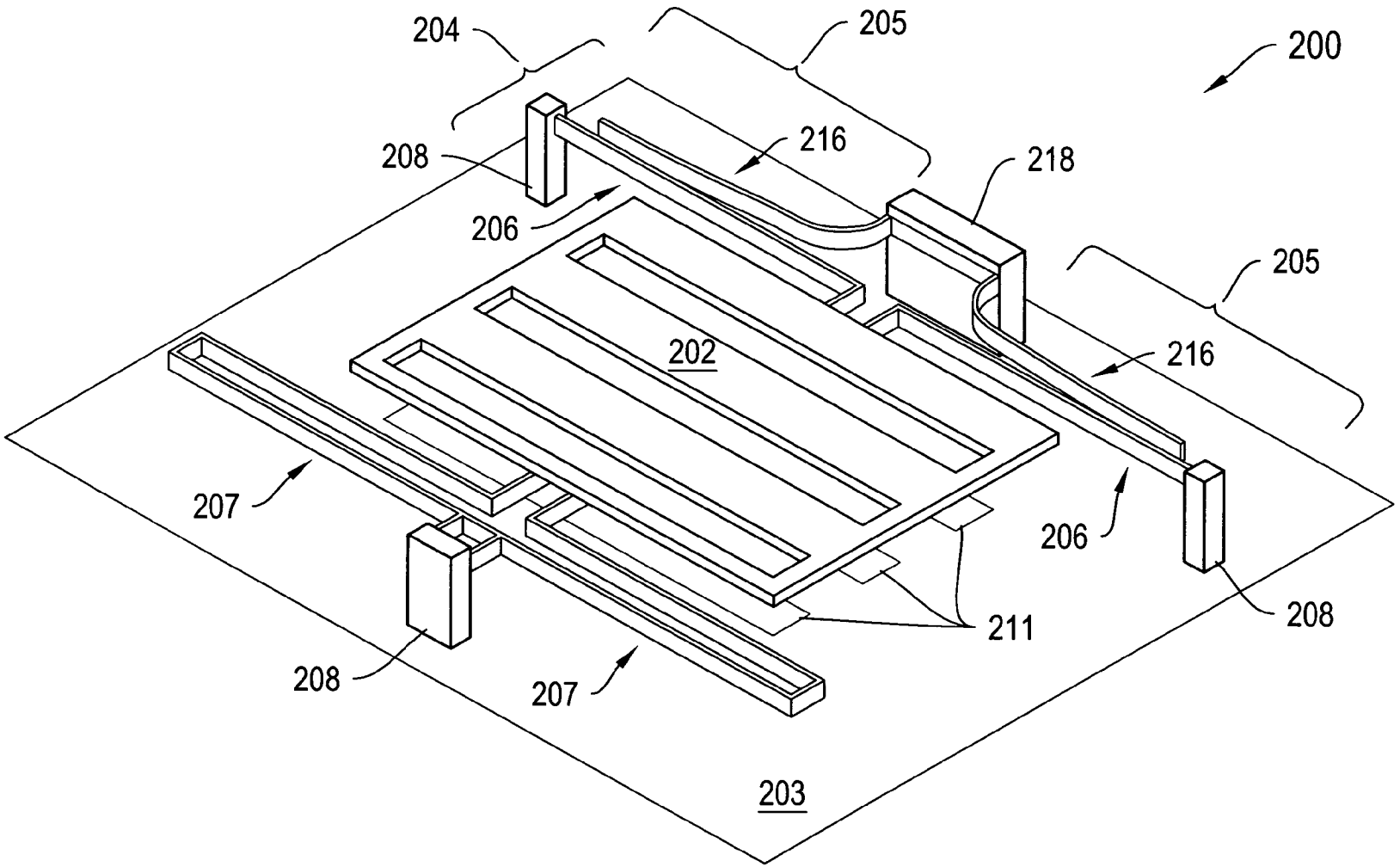
FIG. 2A is a perspective view of an illustrative shutter-based light modulator suitable for incorporation into the MEMS-based display of FIG. 1A, according to an illustrative embodiment of the invention.

FIG. 2A is a perspective view of an illustrative shutter-based light modulator 200 suitable for incorporation into the MEMS-based display apparatus 100 of FIG. 1A, according to an illustrative embodiment of the invention. The shutter-based light modulator 200 (also referred to as shutter assembly 200) includes a shutter 202 coupled to an actuator 204. The actuator 204 is formed from two separate compliant electrode beam actuators 205 (the "actuators 205"), as described in U.S. patent application Ser. No. 11/251,035, filed on Oct. 14, 2005. The shutter 202 couples on one side to the actuators 205. The actuators 205 move the shutter 202 transversely over a surface 203 in a plane of motion which is substantially parallel to the surface 203. The opposite side of the shutter 202 couples to a spring 207 which provides a restoring force opposing the forces exerted by the actuator 204.

Each actuator 205 includes a compliant load beam 206 connecting the shutter 202 to a load anchor 208. The load anchors 208 along with the compliant load beams 206 serve as mechanical supports, keeping the shutter 202 suspended proximate to the surface 203. The load anchors 208 physically connect the compliant load beams 206 and the shutter 202 to the surface 203 and electrically connect the load beams 206 to a bias voltage, in some instances, ground.

Each actuator 205 also includes a compliant drive beam 216 positioned adjacent to each load beam 206. The drive beams 216 couple at one end to a drive beam anchor 218 shared between the drive beams 216. The other end of each drive beam 216 is free to move. Each drive beam 216 is curved such that it is closest to the load beam 206 near the free end of the drive beam 216 and the anchored end of the load beam 206.

The surface 203 includes one or more apertures 211 for admitting the passage of light. If the shutter assembly 200 is formed on an opaque substrate, made, for example, from silicon, then the surface 203 is a surface of the substrate, and the apertures 211 are formed by etching an array of holes through the substrate. If the shutter assembly 200 is formed on a transparent substrate, made, for example, of glass or plastic, then the surface 203 is a surface of a light blocking layer deposited on the substrate, and the apertures are formed by etching the surface 203 into an array of holes 211. The apertures 211 can be generally circular, elliptical, polygonal, serpentine, or irregular in shape.

In operation, a display apparatus incorporating the light modulator 200 applies an electric potential to the drive beams 216 via the drive beam anchor 218. A second electric potential may be applied to the load beams 206. The resulting potential difference between the drive beams 216 and the load beams 206 pulls the free ends of the drive beams 216 towards the anchored ends of the load beams 206, and pulls the shutter ends of the load beams 206 toward the anchored ends of the drive beams 216, thereby driving the shutter 202 transversely towards the drive anchor 218. The compliant members 206 act as springs, such that when the voltage across the beams 206 and 216 is removed, the load beams 206 push the shutter 202 back into its initial position, releasing the stress stored in the load beams 206.

The shutter assembly 200, also referred to as an elastic shutter assembly, incorporates a passive restoring force, such as a spring, for returning a shutter to its rest or relaxed position after voltages have been removed. A number of elastic restore mechanisms and various electrostatic couplings can be designed into or in conjunction with electrostatic actuators, the compliant beams illustrated in shutter assembly 200 being just one example. Other examples are described in U.S. patent application Ser. Nos. 11/251,035 and 11/326,696, incorporated herein by reference. For instance, a highly non-linear voltage-displacement response can be provided which favors an abrupt transition between "open" vs "closed" states of operation, and which, in many cases, provides a bi-stable or hysteretic operating characteristic for the shutter assembly. Other electrostatic actuators can be designed with more incremental voltage-displacement responses and with considerably reduced hysteresis, as may be preferred for analog gray scale operation.

The actuator 205 within the elastic shutter assembly is said to operate between a closed or actuated position and a relaxed position. The designer, however, can choose to place apertures 211 such that shutter assembly 200 is in either the "open" state, i.e. passing light, or in the "closed" state, i.e. blocking light, whenever actuator 205 is in its relaxed position. For illustrative purposes, it is assumed below that elastic shutter assemblies described herein are designed to be open in their relaxed state.

In many cases it is preferable to provide a dual set of "open" and "closed" actuators as part of a shutter assembly so that the control electronics are capable of electrostatically driving the shutters into each of the open and closed states.

Figure 2B:
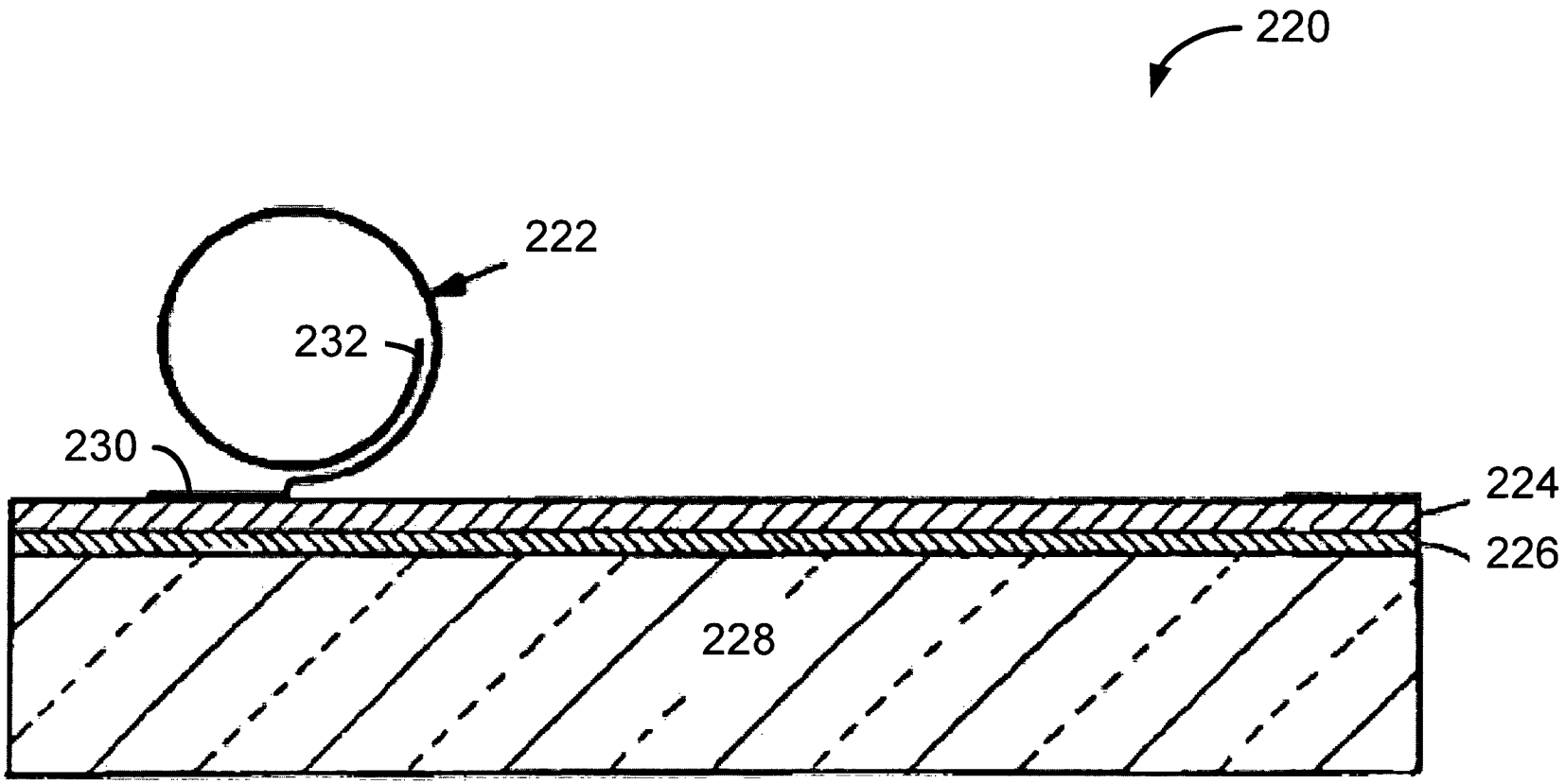
FIG. 2B is a cross-sectional view of a rollershade-based light modulator suitable for incorporation into the MEMS-based display of FIG. 1A, according to an illustrative embodiment of the invention.

Display apparatus 100, in alternative embodiments, includes light modulators other than transverse shutter-based light modulators, such as the shutter assembly 200 described above. For example, FIG. 2B is a cross-sectional view of a rolling actuator shutter-based light modulator 220 suitable for incorporation into an alternative embodiment of the MEMS-based display apparatus 100 of FIG. 1A, according to an illustrative embodiment of the invention. As described further in U.S. Pat. No. 5,233,459, entitled "Electric Display Device," and U.S. Pat. No. 5,784,189, entitled "Spatial Light Modulator," the entireties of which are incorporated herein by reference, a rolling actuator-based light modulator includes a moveable electrode disposed opposite a fixed electrode and biased to move in a preferred direction to produce a shutter upon application of an electric field. In one embodiment, the light modulator 220 includes a planar electrode 226 disposed between a substrate 228 and an insulating layer 224 and a moveable electrode 222 having a fixed end 230 attached to the insulating layer 224. In the absence of any applied voltage, a moveable end 232 of the moveable electrode 222 is free to roll towards the fixed end 230 to produce a rolled state. Application of a voltage between the electrodes 222 and 226 causes the moveable electrode 222 to unroll and lie flat against the insulating layer 224, whereby it acts as a shutter that blocks light traveling through the substrate 228. The moveable electrode 222 returns to the rolled state by means of an elastic restoring force after the voltage is removed. The bias towards a rolled state may be achieved by manufacturing the moveable electrode 222 to include an anisotropic stress state.

Figure 2C:
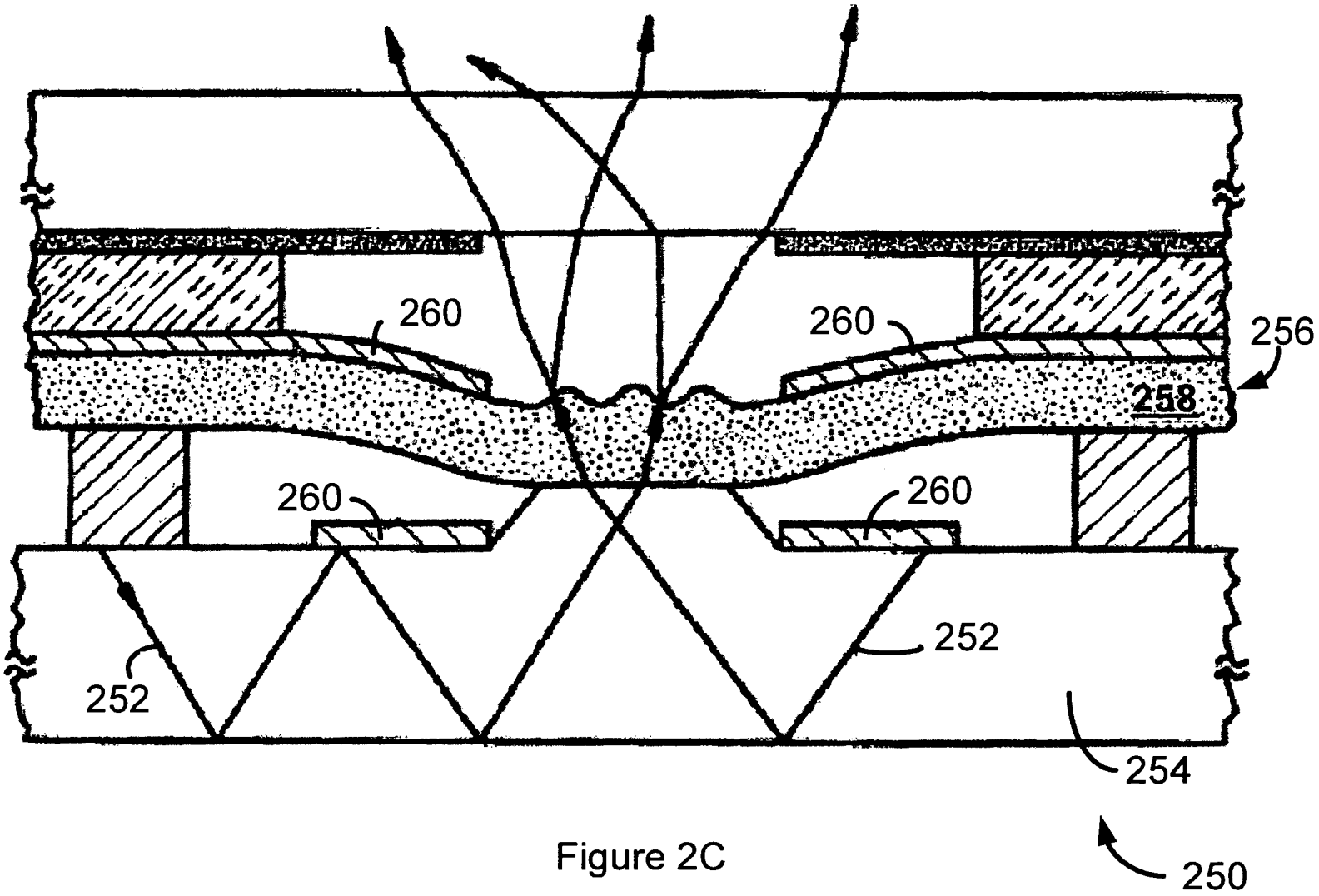
FIG. 2C is a cross sectional view of a light-tap-based light modulator suitable for incorporation into an alternative embodiment of the MEMS-based display of FIG. 1A, according to an illustrative embodiment of the invention.

FIG. 2C is a cross-sectional view of an illustrative non shutter-based MEMS light modulator 250. The light tap modulator 250 is suitable for incorporation into an alternative embodiment of the MEMS-based display apparatus 100 of FIG. 1A, according to an illustrative embodiment of the invention. As described further in U.S. Pat. No. 5,771,321, entitled "Micromechanical Optical Switch and Flat Panel Display," the entirety of which is incorporated herein by reference, a light tap works according to a principle of frustrated total internal reflection. That is, light 252 is introduced into a light guide 254, in which, without interference, light 252 is for the most part unable to escape the light guide 254 through its front or rear surfaces due to total internal reflection. The light tap 250 includes a tap element 256 that has a sufficiently high index of refraction that, in response to the tap element 256 contacting the light guide 254, light 252 impinging on the surface of the light guide 254 adjacent the tap element 256 escapes the light guide 254 through the tap element 256 towards a viewer, thereby contributing to the formation of an image.

In one embodiment, the tap element 256 is formed as part of beam 258 of flexible, transparent material. Electrodes 260 coat portions of one side of the beam 258. Opposing electrodes 260 are disposed on the light guide 254. By applying a voltage across the electrodes 260, the position of the tap element 256 relative to the light guide 254 can be controlled to selectively extract light 252 from the light guide 254.

Figure 2D:
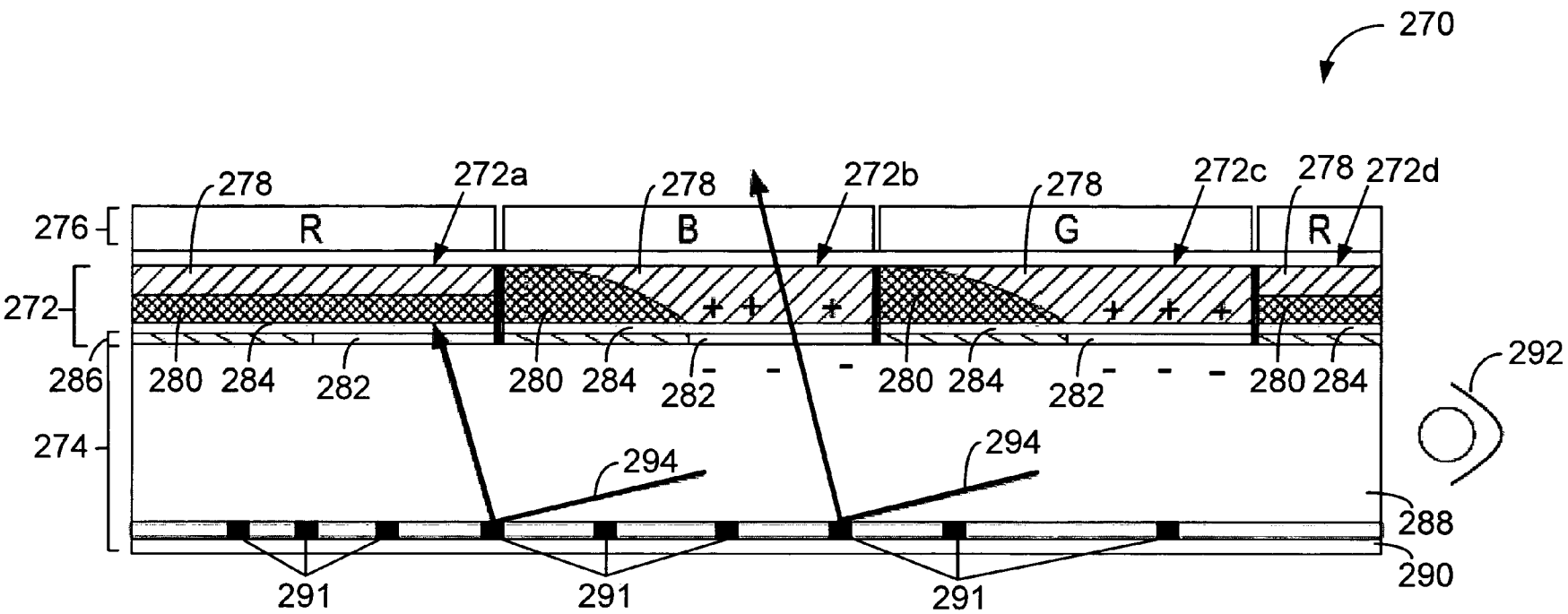
FIG. 2D is a cross sectional view of an electrowetting-based light modulator suitable for incorporation into an alternative embodiment of the MEMS-based display of FIG. 1A, according to an illustrative embodiment of the invention.

FIG. 2D is a cross sectional view of a second illustrative non-shutter-based MEMS light modulator suitable for inclusion in various embodiments of the invention. Specifically, FIG. 2D is a cross sectional view of an electrowetting-based light modulation array 270. The electrowetting-based light modulator array 270 is suitable for incorporation into an alternative embodiment of the MEMS-based display apparatus 100 of FIG. 1A, according to an illustrative embodiment of the invention. The light modulation array 270 includes a plurality of electrowetting-based light modulation cells 272*a*-272*d* (generally "cells 272") formed on an optical cavity 274. The light modulation array 270 also includes a set of color filters 276 corresponding to the cells 272.

Each cell 272 includes a layer of water (or other transparent conductive or polar fluid) 278, a layer of light absorbing oil 280, a transparent electrode 282 (made, for example, from indium-tin oxide) and an insulating layer 284 positioned between the layer of light absorbing oil 280 and the transparent electrode 282. Illustrative implementations of such cells are described further in U.S. Patent Application Publication No. 2005/0104804, published May 19, 2005 and entitled "Display Device." In the embodiment described herein, the electrode takes up a portion of a rear surface of a cell 272.

The light modulation array 270 also includes a light guide 288 and one or more light sources 292 which inject light 294 into the light guide 288. A series of light redirectors 291 are formed on the rear surface of the light guide, proximate a front facing reflective layer 290. The light redirectors 291 may be either diffuse or specular reflectors. The modulation array 270 includes an aperture layer 286 which is patterned into a series of apertures, one aperture for each of the cells 272, to allow light rays 294 to pass through the cells 272 and toward the viewer.

In one embodiment the aperture layer 286 is comprised of a light absorbing material to block the passage of light except through the patterned apertures. In another embodiment the aperture layer 286 is comprised of a reflective material which reflects light not passing through the surface apertures back towards the rear of the light guide 288. After returning to the light guide, the reflected light can be further recycled by the front facing reflective layer 290.

In operation, application of a voltage to the electrode 282 of a cell causes the light absorbing oil 280 in the cell to move into or collect in one portion of the cell 272. As a result, the light absorbing oil 280 no longer obstructs the passage of light through the aperture formed in the reflective aperture layer 286 (see, for example, cells 272*b* and 272*c*). Light escaping the light guide 288 at the aperture is then able to escape through the cell and through a corresponding color (for example, red, green, or blue) filter in the set of color filters 276 to form a color pixel in an image. When the electrode 282 is grounded, the light absorbing oil 280 returns to its previous position (as in cell 272*a*) and covers the aperture in the reflective aperture layer 286, absorbing any light 294 attempting to pass through it.

The roller-based light modulator 220, light tap 250, and electrowetting-based light modulation array 270 are not the only examples of MEMS light modulators suitable for inclusion in various embodiments of the invention. It will be understood that other MEMS light modulators can exist and can be usefully incorporated into the invention.

U.S. patent applications Ser. Nos. 11/251,035 and 11/326,696 have described a variety of methods by which an array of shutters can be controlled via a control matrix to produce images, in many cases moving images, with appropriate gray scale. In some cases, control is accomplished by means of a passive matrix array of row and column interconnects connected to driver circuits on the periphery of the display. In other cases it is appropriate to include switching and/or data storage elements within each pixel of the array (the so-called active matrix) to improve either the speed, the gray scale and/or the power dissipation performance of the display.

Figure 3A:
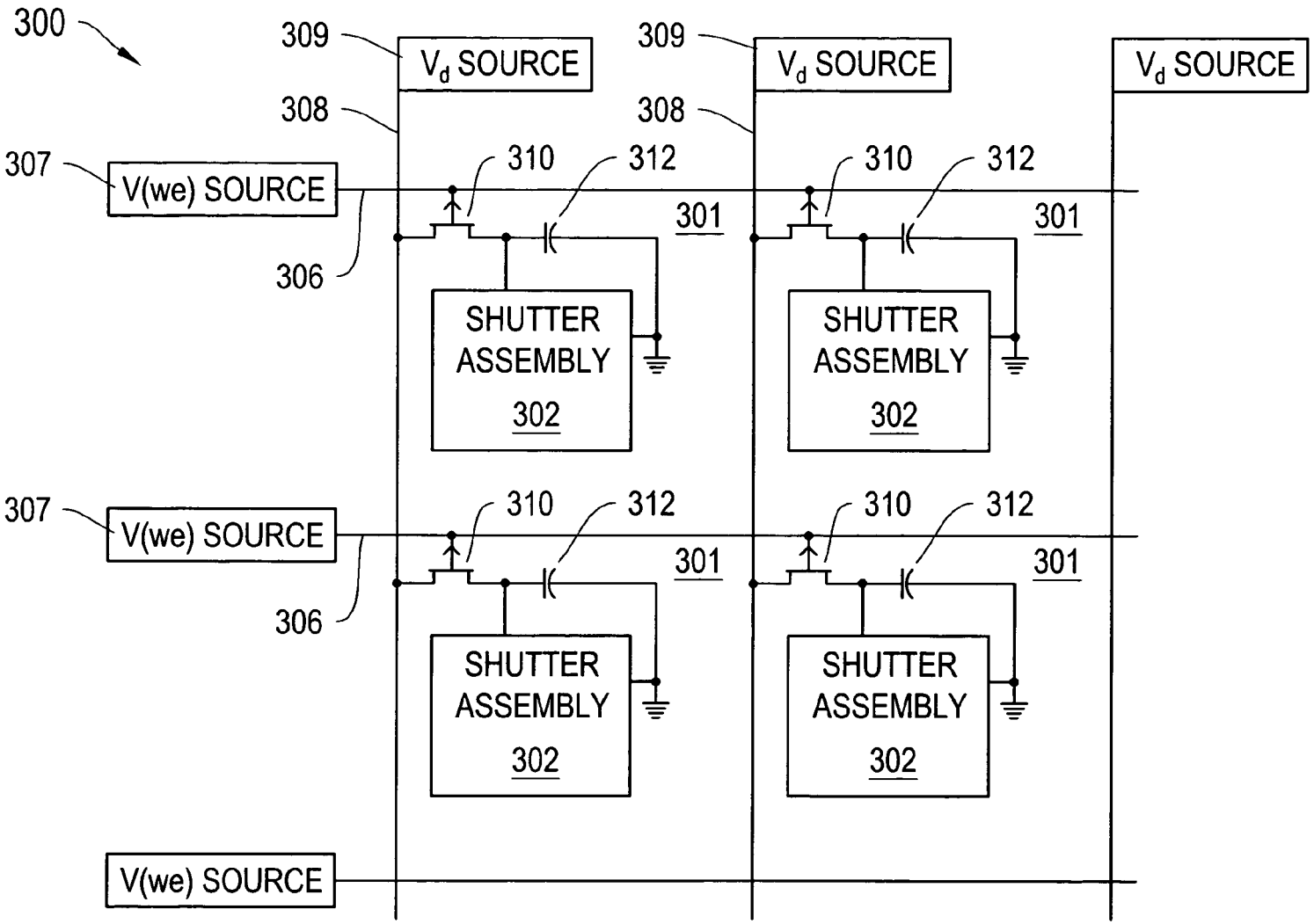
FIG. 3A is a schematic diagram of a control matrix suitable for controlling the light modulators incorporated into the MEMS-based display of FIG. 1A, according to an illustrative embodiment of the invention.
Figure 3B:
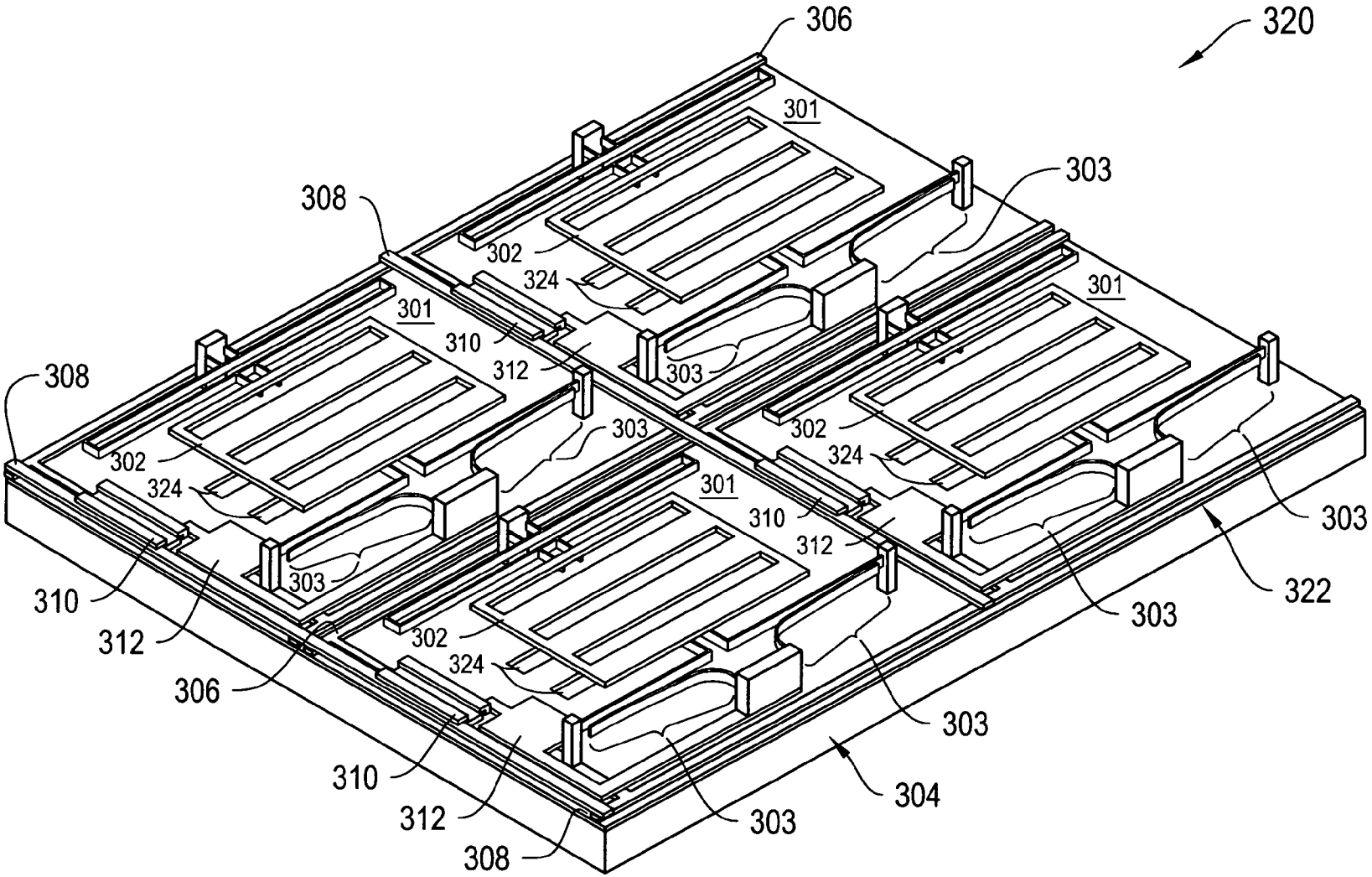
FIG. 3B is a perspective view of an array of shutter-based light modulators connected to the control matrix of FIG. 3A, according to an illustrative embodiment of the invention.

FIG. 3A is a schematic diagram of a control matrix 300 suitable for controlling the light modulators incorporated into the MEMS-based display apparatus 100 of FIG. 1A, according to an illustrative embodiment of the invention. FIG. 3B is a perspective view of an array 320 of shutter-based light modulators connected to the control matrix 300 of FIG. 3A, according to an illustrative embodiment of the invention. The control matrix 300 may address an array of pixels 320 (the "array 320"). Each pixel 301 includes an elastic shutter assembly 302, such as the shutter assembly 200 of FIG. 2A, controlled by an actuator 303. Each pixel also includes an aperture layer 322 that includes apertures 324. Further electrical and mechanical descriptions of shutter assemblies such as shutter assembly 302, and variations thereon, can be found in U.S. patent application Ser. Nos. 11/251,035 and 11/326,696. Descriptions of alternate control matrices can also be found in U.S. patent application Ser. No. 11/607,715.

The control matrix 300 is fabricated as a diffused or thin-film-deposited electrical circuit on the surface of a substrate 304 on which the shutter assemblies 302 are formed. The control matrix 300 includes a scan-line interconnect 306 for each row of pixels 301 in the control matrix 300 and a data-interconnect 308 for each column of pixels 301 in the control matrix 300. Each scan-line interconnect 306 electrically connects a write-enabling voltage source 307 to the pixels 301 in a corresponding row of pixels 301. Each data interconnect 308 electrically connects a data voltage source, ("Vd source") 309 to the pixels 301 in a corresponding column of pixels 301. In control matrix 300, the data voltage $V_d$ provides the majority of the energy necessary for actuation of the shutter assemblies 302. Thus, the data voltage source 309 also serves as an actuation voltage source.

Referring to FIGS. 3A and 3B, for each pixel 301 or for each shutter assembly 302 in the array of pixels 320, the control matrix 300 includes a transistor 310 and a capacitor 312. The gate of each transistor 310 is electrically connected to the scan-line interconnect 306 of the row in the array 320 in which the pixel 301 is located. The source of each transistor 310 is electrically connected to its corresponding data interconnect 308. The actuators 303 of each shutter assembly 302 include two electrodes. The drain of each transistor 310 is electrically connected in parallel to one electrode of the corresponding capacitor 312 and to one of the electrodes of the corresponding actuator 303. The other electrode of the capacitor 312 and the other electrode of the actuator 303 in shutter assembly 302 are connected to a common or ground potential. In alternate implementations, the transistors 310 can be replaced with semiconductor diodes and or metal-insulator-metal sandwich type switching elements.

In operation, to form an image, the control matrix 300 write-enables each row in the array 320 in a sequence by applying $V_{we}$ to each scan-line interconnect 306 in turn. For a write-enabled row, the application of $V_{we}$ to the gates of the transistors 310 of the pixels 301 in the row allows the flow of current through the data interconnects 308 through the transistors 310 to apply a potential to the actuator 303 of the shutter assembly 302. While the row is write-enabled, data voltages $V_d$ are selectively applied to the data interconnects 308. In implementations providing analog gray scale, the data voltage applied to each data interconnect 308 is varied in relation to the desired brightness of the pixel 301 located at the intersection of the write-enabled scan-line interconnect 306 and the data interconnect 308. In implementations providing digital control schemes, the data voltage is selected to be either a relatively low magnitude voltage (i.e., a voltage near ground) or to meet or exceed $V_{at}$ (the actuation threshold voltage). In response to the application of $V_{at}$ to a data interconnect 308, the actuator 303 in the corresponding shutter assembly 302 actuates, opening the shutter in that shutter assembly 302. The voltage applied to the data interconnect 308 remains stored in the capacitor 312 of the pixel 301 even after the control matrix 300 ceases to apply $V_{we}$ to a row. It is not necessary, therefore, to wait and hold the voltage $V_{we}$ on a row for times long enough for the shutter assembly 302 to actuate; such actuation can proceed after the write-enabling voltage has been removed from the row. The capacitors 312 also function as memory elements within the array 320, storing actuation instructions for periods as long as is necessary for the illumination of an image frame.

The pixels 301 as well as the control matrix 300 of the array 320 are formed on a substrate 304. The array includes an aperture layer 322, disposed on the substrate 304, which includes a set of apertures 324 for respective pixels 301 in the array 320. The apertures 324 are aligned with the shutter assemblies 302 in each pixel. In one implementation the substrate 304 is made of a transparent material, such as glass or plastic. In another implementation the substrate 304 is made of an opaque material, but in which holes are etched to form the apertures 324.

Components of shutter assemblies 302 are processed either at the same time as the control matrix 300 or in subsequent processing steps on the same substrate. The electrical components in control matrix 300 are fabricated using many thin film techniques in common with the manufacture of thin film transistor arrays for liquid crystal displays. Available techniques are described in Den Boer, *Active Matrix Liquid Crystal Displays* (Elsevier, Amsterdam, 2005), incorporated herein by reference. The shutter assemblies are fabricated using techniques similar to the art of micromachining or from the manufacture of micromechanical (i.e., MEMS) devices. Many applicable thin film MEMS techniques are described in Rai-Choudhury, ed., Handbook of Microlithography, Micromachining & Microfabrication (SPIE Optical Engineering Press, Bellingham, Wash. 1997), incorporated herein by reference. Fabrication techniques specific to MEMS light modulators formed on glass substrates can be found in U.S. patent application Ser. Nos. 11/361,785 and 11/731,628, incorporated herein by reference. For instance, as described in those applications, the shutter assembly 302 can be formed from thin films of amorphous silicon, deposited by a chemical vapor deposition process.

The shutter assembly 302 together with the actuator 303 can be made bi-stable. That is, the shutters can exist in at least two equilibrium positions (e.g. open or closed) with little or no power required to hold them in either position. More particularly, the shutter assembly 302 can be mechanically bi-stable. Once the shutter of the shutter assembly 302 is set in position, no electrical energy or holding voltage is required to maintain that position. The mechanical stresses on the physical elements of the shutter assembly 302 can hold the shutter in place.

The shutter assembly 302 together with the actuator 303 can also be made electrically bi-stable. In an electrically bi-stable shutter assembly, there exists a range of voltages below the actuation voltage of the shutter assembly, which if applied to a closed actuator (with the shutter being either open or closed), holds the actuator closed and the shutter in position, even if an opposing force is exerted on the shutter. The opposing force may be exerted by a spring such as spring 207 in shutter-based light modulator 200, or the opposing force may be exerted by an opposing actuator, such as an "open" or "closed" actuator.

The light modulator array 320 is depicted as having a single MEMS light modulator per pixel. Other embodiments are possible in which multiple MEMS light modulators are provided in each pixel, thereby providing the possibility of more than just binary "on" or "off" optical states in each pixel. Certain forms of coded area division gray scale are possible where multiple MEMS light modulators in the pixel are provided, and where apertures 324, which are associated with each of the light modulators, have unequal areas.

In other embodiments the roller-based light modulator 220, the light tap 250, or the electrowetting-based light modulation array 270, as well as other MEMS-based light modulators, can be substituted for the shutter assembly 302 within the light modulator array 320.

Figure 4B:
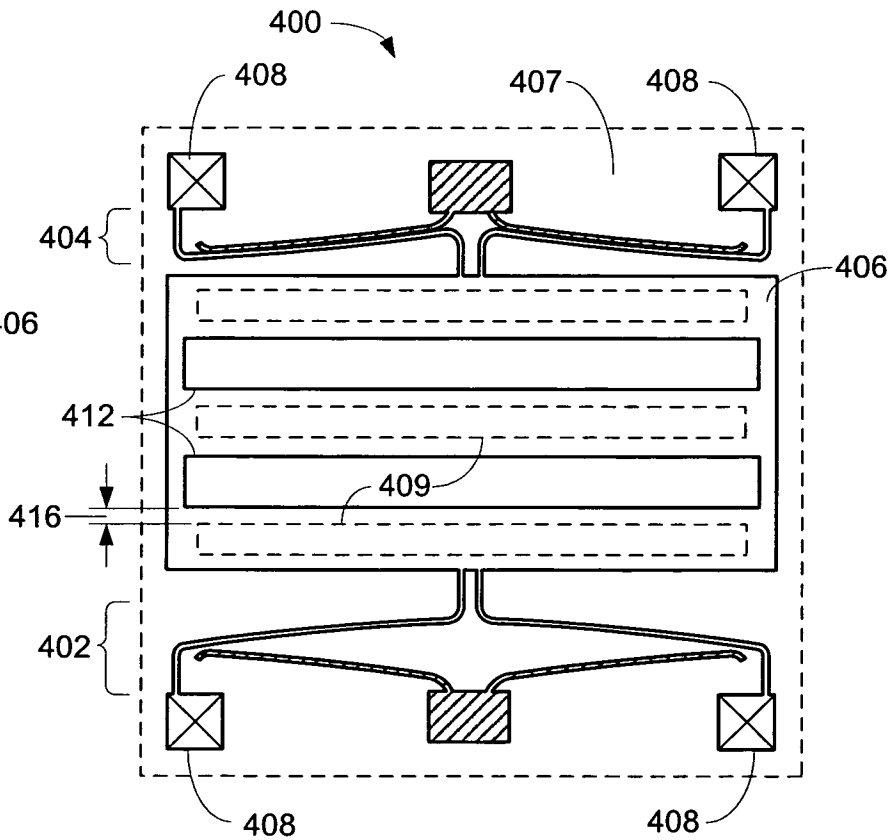
FIGS. 4A and 4B are plan views of a dual-actuated shutter assembly in the open and closed states respectively, according to an illustrative embodiment of the invention.
Figure 4A:
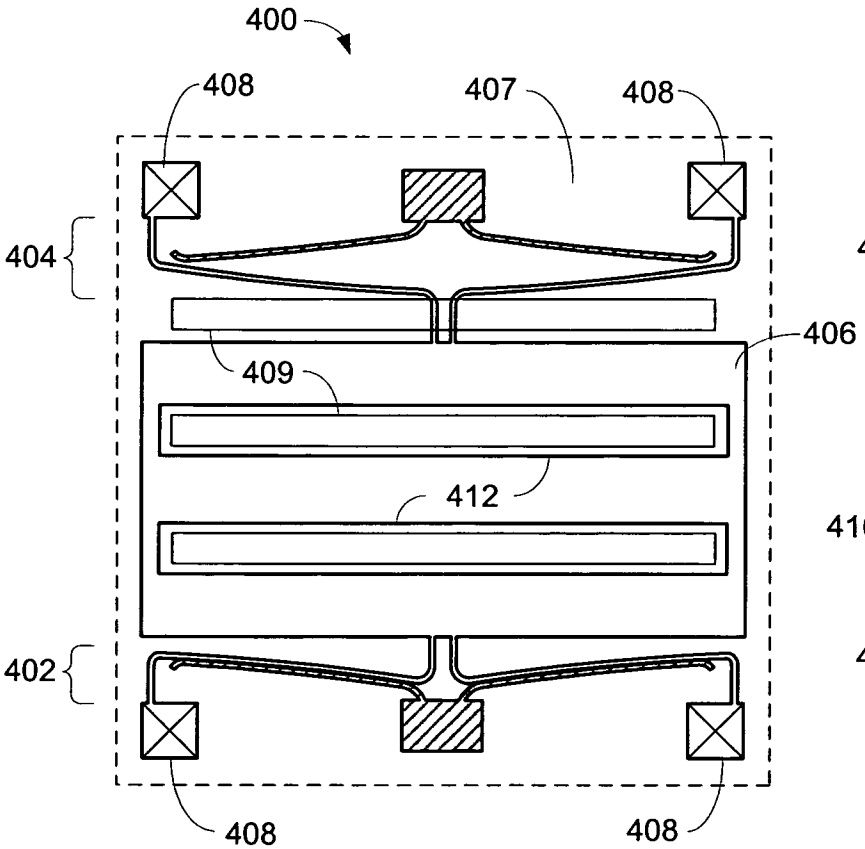

FIGS. 4A and 4B illustrate an alternative shutter-based light modulator (shutter assembly) 400 suitable for inclusion in various embodiments of the invention. The light modulator 400 is an example of a dual actuator shutter assembly, and is shown in FIG. 4A in an open state. FIG. 4B is a view of the dual actuator shutter assembly 400 in a closed state. Shutter assembly 400 is described in further detail in U.S. patent application Ser. No. 11/251,035, referenced above. In contrast to the shutter assembly 200, shutter assembly 400 includes actuators 402 and 404 on either side of a shutter 406. Each actuator 402 and 404 is independently controlled. A first actuator, a shutter-open actuator 402, serves to open the shutter 406. A second opposing actuator, the shutter-close actuator 404, serves to close the shutter 406. Both actuators 402 and 404 are compliant beam electrode actuators. The actuators 402 and 404 open and close the shutter 406 by driving the shutter 406 substantially in a plane parallel to an aperture layer 407 over which the shutter is suspended. The shutter 406 is suspended a short distance over the aperture layer 407 by anchors 408 attached to the actuators 402 and 404. The inclusion of supports attached to both ends of the shutter 406 along its axis of movement reduces out of plane motion of the shutter 406 and confines the motion substantially a plane parallel to the substrate. By analogy to the control matrix 300 of FIG. 3A, a control matrix suitable for use with shutter assembly 400 might include one transistor and one capacitor for each of the opposing shutter-open and shutter-close actuators 402 and 404.

The shutter 406 includes two shutter apertures 412 through which light can pass. The aperture layer 407 includes a set of three apertures 409. In FIG. 4A, the shutter assembly 400 is in the open state and, as such, the shutter-open actuator 402 has been actuated, the shutter-close actuator 404 is in its relaxed position, and the centerlines of apertures 412 and 409 coincide. In FIG. 4B the shutter assembly 400 has been moved to the closed state and, as such, the shutter-open actuator 402 is in its relaxed position, the shutter-close actuator 404 has been actuated, and the light blocking portions of shutter 406 are now in position to block transmission of light through the apertures 409 (shown as dotted lines). Each aperture has at least one edge around its periphery. For example, the rectangular apertures 409 have four edges. In alternative implementations in which circular, elliptical, oval, or other curved apertures are formed in the aperture layer 407, each aperture may have only a single edge. In other implementations the apertures need not be separated or disjoint in the mathematical sense, but instead can be connected. That is to say, while portions or shaped sections of the aperture may maintain a correspondence to each shutter, several of these sections may be connected such that a single continuous perimeter of the aperture is shared by multiple shutters.

In order to allow light with a variety of exit angles to pass through apertures 412 and 409 in the open state, it is advantageous to provide a width or size for shutter apertures 412 which is larger than a corresponding width or size of apertures 409 in the aperture layer 407. In order to effectively block light from escaping in the closed state, it is preferable that the light blocking portions of the shutter 406 overlap the apertures 409. FIG. 4B shows a predefined overlap 416 between the edge of light blocking portions in the shutter 406 and one edge of the aperture 409 formed in aperture layer 407.

The electrostatic actuators 402 and 404 are designed so that their voltage—displacement behavior provides a bi-stable characteristic to the shutter assembly 400. For each of the shutter-open and shutter-close actuators there exists a range of voltages below the actuation voltage, which if applied while that actuator is in the closed state (with the shutter being either open or closed), will hold the actuator closed and the shutter in position, even after an actuation voltage is applied to the opposing actuator. The minimum voltage needed to maintain a shutter's position against such an opposing force is referred to as a maintenance voltage $V_m$.

Figure 4C:
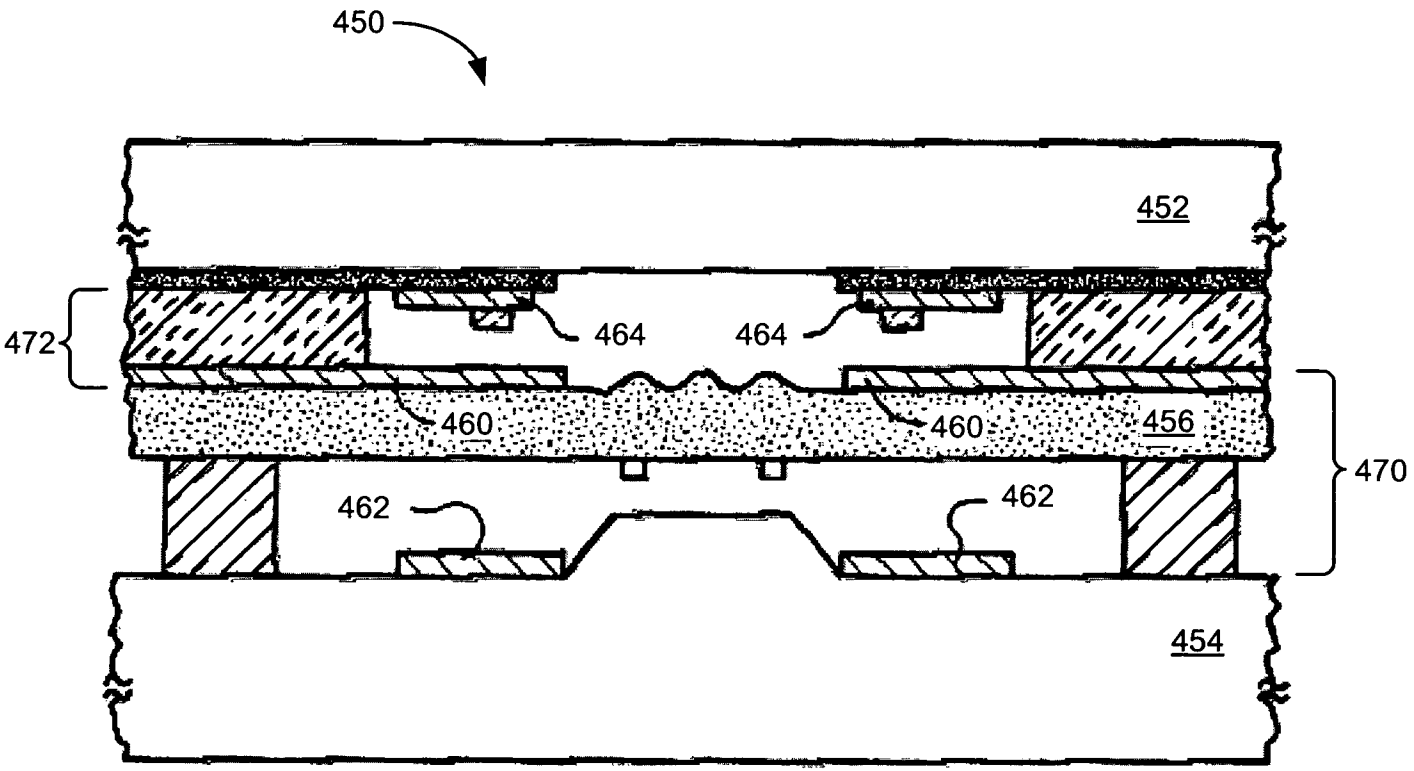
FIG. 4C is a cross sectional view of a dual actuator light tap-based light modulator suitable for incorporation into the MEMS-based display, according to an illustrative embodiment of the invention.

FIG. 4C is a cross-sectional view of a non shutter-based MEMS light modulator 450, which includes first and second opposing actuators. The light modulator 450 is also referred to as a dual actuator light tap, which operates according to the principle of frustrated total internal reflection. The dual actuator light tap is a variation of light tap modulator 250 as described in U.S. Pat. No. 5,771,321, referred to above. The dual actuator light tap 450 comprises a light guide 454, in which, without interference, light is for the most part unable to escape through its front or rear surfaces due to total internal reflection. The light tap 450 also includes a cover sheet 452 and a flexible membrane or tap element 456. The tap element 456 has a sufficiently high index of refraction such that, in response to the tap element 456 contacting the light guide 454, light impinging on the surface of the light guide 454 adjacent the tap element 456 escapes the light guide 454 through the tap element 456 towards a viewer, thereby contributing to the formation of an image.

The tap element 456 is formed from a flexible transparent material. Electrodes 460 are coupled to the tap element 456. The light tap 450 also includes electrodes 462 and 464. The combination of electrodes 460 and 462 comprise a first actuator 470 and the combination of electrodes 460 and 464 comprise a second opposing actuator 472. By applying a voltage to the first actuator 470 the tap element 456 can be moved toward the light guide 454, allowing light to be extracted from the light guide 454. By applying a voltage to the second actuator 472 the tap element can be moved away from the light guide 454 thereby restricting the extraction of light from the light guide 454.

The actuators 470 and 472 are designed so that their voltage—displacement behavior provides an electrically bi-stable characteristic to the light tap 450. For each of the first and second actuators there exists a range of voltages below the actuation voltage, which if applied while that actuator is in the closed state, will hold the actuator closed and the tap element in position, even after an actuation voltage is applied to the opposing actuator. The minimum voltage needed to maintain the tap element's position against such an opposing force is referred to as a maintenance voltage $V_m$.

Electrical bi-stability arises from the fact that the electrostatic force across an actuator is a strong function of position as well as voltage. The beams of the actuators in the light modulators 400 and 450 act as capacitor plates. The force between capacitor plates is proportional to $1/d^2$ where d is the local separation distance between capacitor plates. In a closed actuator, the local separation between actuator beams is very small. Thus, the application of a small voltage can result in a relatively strong force between the actuator beams of a closed actuator. As a result, a relatively small voltage, such as $V_m$, can keep the actuator closed, even if other elements exert an opposing force on the closed actuator.

In light modulators, such as 400 and 450, that provide two opposing actuators (e.g. for the purpose of opening and closing a shutter respectively), the equilibrium position of the modulator will be determined by the combined effect of the voltage differences across each of the actuators. In other words, the electrical potentials of all three terminals (e.g. the shutter open drive beam, the shutter close drive beam, and the shutter/load beams), as well as modulator position, must be considered to determine the equilibrium forces on the modulator.

For an electrically bi-stable system, a set of logic rules can describe the stable states and can be used to develop reliable addressing or digital control schemes for the modulator. Referring to the shutter-based light modulator 400 as an example, these logic rules are as follows:

Let $V_s$ be the electrical potential on the shutter or load beam. Let $V_o$ be the electrical potential on the shutter-open drive beam. Let $V_c$ be the electrical potential on the shutter-close drive beam. Let the expression/$V_o$-$V_s$/refer to the absolute value of the voltage difference between the shutter and the shutter-open drive beam. Let $V_m$ be the maintenance voltage. Let $V_{at}$ be the actuation threshold voltage, i.e., the voltage necessary to actuate an actuator absent the application of $V_m$ to an opposing drive beam. Let $V_{max}$ be the maximum allowable potential for $V_o$ and $V_c$. Let $V_m<V_{at}<V_{max}$. Then, assuming $V_o$ and $V_c$ remain below $V_{max}$:

1. If $/V_o-V_s/<V_m$ and $/V_c-V_s/<V_m$

Then the shutter will relax to the equilibrium position of its mechanical spring.

2. If $/V_o-V_s/>V_m$ and $/V_c-V_s/>V_m$

Then the shutter will not move, i.e. it will hold in either the open or the closed state, whichever position was established by the last actuation event.

3. If $/V_o-V_s/>V_{at}$ and $/V_c-V_s/<V_m$

Then the shutter will move into the open position.

4. If $/V_o-V_s/<V_m$ and $/V_c-V_s/>V_{at}$

Then the shutter will move into the closed position.

Following rule 1, with voltage differences on each actuator near to zero, the shutter will relax. In many shutter assemblies the mechanically relaxed position is only partially open or closed, and so this voltage condition is preferably avoided in an addressing scheme.

The condition of rule 2 makes it possible to include a global actuation function into an addressing scheme. By maintaining a shutter voltage which provides beam voltage differences that are at least the maintenance voltage, $V_m$, the absolute values of the shutter open and shutter closed potentials can be altered or switched in the midst of an addressing sequence over wide voltage ranges (even where voltage differences exceed $V_{at}$) with no danger of unintentional shutter motion.

The conditions of rules 3 and 4 are those that are generally targeted during the addressing sequence to ensure the bi-stable actuation of the shutter.

The maintenance voltage difference, $V_m$, can be designed or expressed as a certain fraction of the actuation threshold voltage, $V_{at}$. For systems designed for a useful degree of bi-stability the maintenance voltage can exist in a range between 20% and 80% of $V_{at}$. This helps ensure that charge leakage or parasitic voltage fluctuations in the system do not result in a deviation of a set holding voltage out of its maintenance range—a deviation which could result in the unintentional actuation of a shutter. In some systems an exceptional degree of bi-stability or hysteresis can be provided, with $V_m$ existing over a range of 2% to 98% of $V_{at}$. In these systems, however, care must be taken to ensure that an electrode voltage condition of $V<V_m$ can be reliably obtained within the addressing and actuation time available.

Figure 5A:
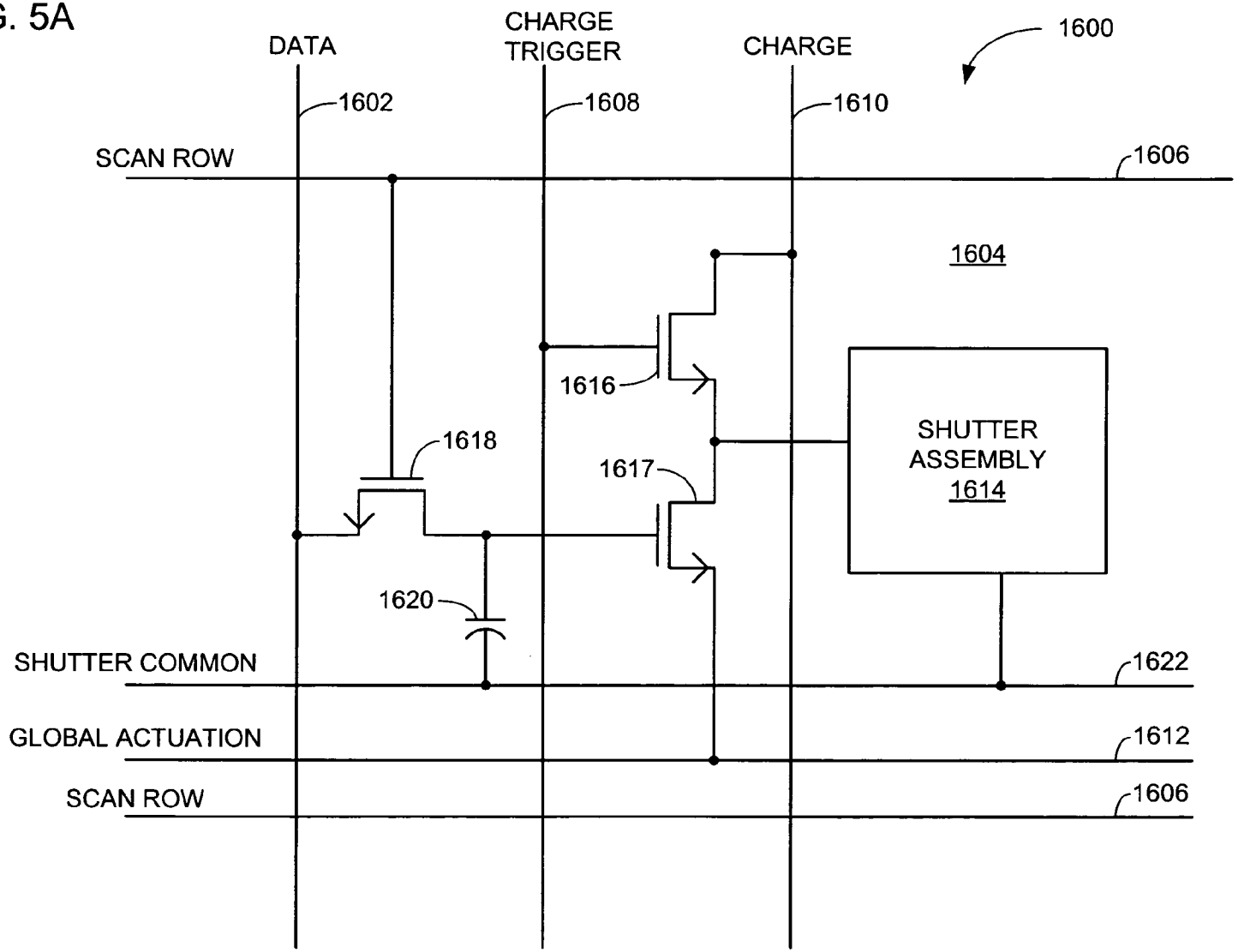
FIG. 5A is a diagram of a control matrix suitable for controlling the shutter assemblies of the display apparatus of FIG. 1A, according to an illustrative embodiment of the invention.

FIG. 5A illustrates an alternative control matrix 1600 suitable for inclusion in the display apparatus 100, according to an illustrative embodiment of the invention. Control matrix 1600 controls an array of pixels 1604 that include elastic shutter assemblies 1614. Although only one pixel 1604 is illustrated in FIG. 5A, it is understood that the control matrix extends and incorporates a large number of rows and columns of similar pixels, as is partially illustrated by the control matrix 300 of FIG. 3A. In addition, while the control matrix is described in relation to controlling elastic shutter assemblies, other MEMS modulators with alternate actuators, such as modulators 220, 250,or 270 can also be employed without departing from the scope of the invention. The control matrix 1600 includes a single data interconnect 1602 for each column of pixels 1604 in the control matrix. The actuators in the elastic shutter assemblies 1614 can be made either electrically bi-stable or mechanically bi-stable.

The control matrix 1600 includes a scan-line interconnect 1606 for each row of pixels 1604 in the control matrix 1600. The control matrix 1600 further includes a charge interconnect 1610, a charge trigger interconnect 1608, a global actuation interconnect 1612, and a shutter common interconnect 1622. These interconnects 1610, 1608, 1612 and 1622 are shared among pixels 1604 in multiple rows and multiple columns in the array. In one implementation, the interconnects 1610, 1608, 1612, and 1622 are shared among all pixels 1604 in the control matrix 1600. Each pixel 1604 in the control matrix includes a shutter charge transistor 1616, a shutter discharge transistor 1617, a shutter write-enable transistor 1618, and a data store capacitor 1620.

The control matrix 1600 of FIG. 5A, previously described in U.S. patent application Ser. No. 11/326,696, includes many circuit elements in common with those described below. The shutter assembly 1614 includes an electrostatic actuator, similar to the actuator 204 of the elastic shutter assembly 200. When a voltage difference equal to or greater than an actuation voltage, also referred to as a charging voltage or $V_{at}$, is imposed across the two terminals of the actuator, the shutter assembly can be driven into a closed state, blocking the passage of light.

In one implementation, the charge interconnect 1610 is connected to a voltage source which is maintained equal to or greater than $V_{at}$. The shutter common interconnect 1622 is maintained near to the ground potential. One terminal of the shutter actuator is connected through the shutter charge transistor 1616 to the charge interconnect 1610. The other terminal of the actuator is connected to the shutter common 1622. If charge is allowed to flow through the charge interconnect 1610 and onto the actuator of shutter assembly 1614, then a voltage of substantially $V_{at}$ will be imposed across the actuator and the shutter will be driven into its closed state. The shutter returns to its open or relaxed state when the voltage across the two terminals of the actuator falls below a maintenance voltage $V_m$, as described in relation to FIGS. 4A-4C.

The charge transistor 1616 can be turned on, and the shutter thereby actuated, when a voltage is applied to the charge trigger interconnect 1608. In order to account for a wide range of voltages that might be stored on the actuator of shutter assembly 1644, a voltage in excess of $V_{at}$, when applied to the gate of transistor 1616, is generally sufficient to turn that transistor on, while a voltage substantially near to ground will be sufficient to turn transistor 1616 off.

The pixel 1604 includes a data store capacitor 1620. As described further below, the capacitor 1620 stores, by means of stored charge, "data" instructions (e.g., open or close) that are sent by a controller, such as controller 156, to the pixel 1620 as part of a data loading or writing operation. The voltage stored on the capacitor 1620 determines, in part, whether the shutter discharge transistor 1617 can be turned on or not.

During a data load operation, each row of the array is write-enabled in an addressing sequence. The voltage sources in control matrix 1600 (not shown) apply a write-enabling voltage $V_{we}$ to the scan-line interconnect 1606 corresponding to a selected row. The application of $V_{we}$ to the scan-line interconnect 1606 for the write-enabled row turns on the write-enable transistor 1618 of the pixels 1604 in the corresponding scan line, thereby write enabling the pixels. While a selected row of pixels 1604 is write-enabled, data voltage sources apply appropriate data voltages to the data interconnect 1602 corresponding to each column of pixels 1604 in the control matrix 1600. The voltages applied to the data interconnects 1602 are thereby stored on the data store capacitors 1620 of the respective pixels 1604.

The control matrix 1600 allows for two methods for setting an image into an array of pixels 1604. According to the first method, all shutters in the array are actuated into a closed position prior to loading any data into the array. The process begins with a global charge trigger operation in which the charge trigger voltage is applied to all charge trigger interconnects 1608, turning on all transistors 1616, and $V_{at}$ is applied to all charge interconnects 1610. As a result, all shutters in the array close nearly simultaneously. The charge trigger interconnect 1608 is then grounded. The method then proceeds to a selective discharge operation where data is loaded into each row of the array sequentially. As described above, data is loaded into a pixel 1604 by storing charge on its data store capacitor 1620. Presuming that the global actuation interconnect 1612 is held near the ground potential, the voltage resulting from the storage of data on the data store capacitor 1620 of a pixel 1604 controls the discharge transistor 1617 of the pixel 1604. In pixels in which a voltage is stored on the data store capacitor 1620, the discharge transistor 1617 is turned on, allowing charge stored on the actuator of the shutter assembly 1614 to discharge through the global actuation interconnect 1612. As a result, the shutter assembly relaxes into the open state. In a pixel 1604 in which charge is not stored on its data store capacitor 1620, the charge stored on the actuators of the shutter assembly remains, keeping the shutter in the closed state. When all rows of the array have been addressed the image setting is complete.

The second method includes a three-step control process for setting an image, in which loading data into the array is separated in time from the selective discharge of the shutter assemblies 1614. In the second method, the global actuation interconnect 1612 is maintained at a potential significantly above that of the shutter common interconnect 1622, thereby preventing the turn-on of the discharge switch transistor 1617 during the addressing (i.e., data loading) process, regardless of what charge gets stored on the capacitor 1620. This method allows for a global actuation process in which all selected shutters are actuated simultaneously. In a global actuation process one image state is maintained in the array (while it is illuminated by one of the lamps 162, 164, or 166) while, simultaneously, data is loaded into data store capacitors 1620 (or other data storage elements) in the array corresponding to a subsequent image state.

The three-step process proceeds as follows. First, while one image state is being illuminated, the data for a subsequent image state is loaded or written, row by row, into the memory elements (capacitors 1620) of the array. This loading operation is often the most time-consuming of the three steps, particularly where a large number of rows (in excess of 100) need to be addressed. In the second step, the shutter assemblies are all reset to the closed state by a global charging operation, initiated by a voltage change on the charge trigger interconnect 1608. And finally the new image state, as dictated by the data stored in the capacitors 1620, is set into the array of shutter assemblies. The potential on the global actuation interconnect 1612 is brought to ground or to substantially the same potential as the shutter common interconnect 1622, thereby turning on all of the shutter discharge transistors 1617 simultaneously according to the whether a data voltage has been stored on capacitor 1620 or not. During the global actuation step, for the pixels at which a data voltage has been stored on capacitor 1620, the discharge transistor turns on, charge drains out of the actuators of shutter assembly 1614, and the shutter assembly 1614 is allowed to move or actuate into its relaxed state, for instance the shutter open state. For pixels at which no data voltage was stored on the capacitor 1620, the discharge transistor 1617 does not turn on and the shutter assembly 1614 remains charged. For those pixels a voltage remains across the actuators of shutter assemblies 1614 and those pixels remain, for instance, in the shutter closed state. During the global actuation step all pixels connected to the same global actuation interconnect, and with data stored on capacitor 1620, move into their new states at substantially at the same time.

Applying partial voltages to the data store capacitor 1620 allows partial turn-on of the discharge switch transistor 1617 during the time that the global actuation interconnect 1612 is brought to its actuation potential. In this fashion, an analog voltage is created on the shutter assembly 1614, for providing analog gray scale.

In some implementations the global actuation interconnect 1612 is connected to every shutter discharge transistor 358 in every row and column in the array of pixels. In other implementations the global actuation interconnect 1612 is connected to shutter discharge transistors within only a sub-group of pixels in multiple rows and columns (see control matrix 2740 below). Such a control matrix enables an addressing method in which images are globally set to only a fraction of the array, or a sub-group of pixels, at one time. This capability, referred to as bank-wise addressing, enhances brightness when using time division gray scale to set multiple gray scale images into the array.

In control matrix 1600, the energy for actuation of shutter assemblies 1614 derives primarily from the charge interconnect 1610 (also referred to as the pre-charge interconnect), which is shared among multiple rows and columns in the array and is attached to a voltage source at a voltage $V_{at}$. The actuation voltage $V_{at}$ can be as high as 40 volts. The control matrix 1600 reduces system power consumption by separating the energy required for shutter actuation from the energy required for addressing (i.e. loading data into) the array. The energy required for addressing is minimized in control matrix 1600 by means of an independent set of data interconnects 1602, through which is transmitted only voltages sufficient to transmit data (information) and to activate the discharge transistors 1617, i.e. voltages as low as 5 volts. The voltage changes occur at higher frequencies amongst the set of data interconnects 1602, but since the data voltage sources provide voltages that are less than those provided to the charging interconnect 1610, i.e. less than $V_{at}$, the power dissipation in control matrix 1600 is substantially reduced.

Figure 5B:
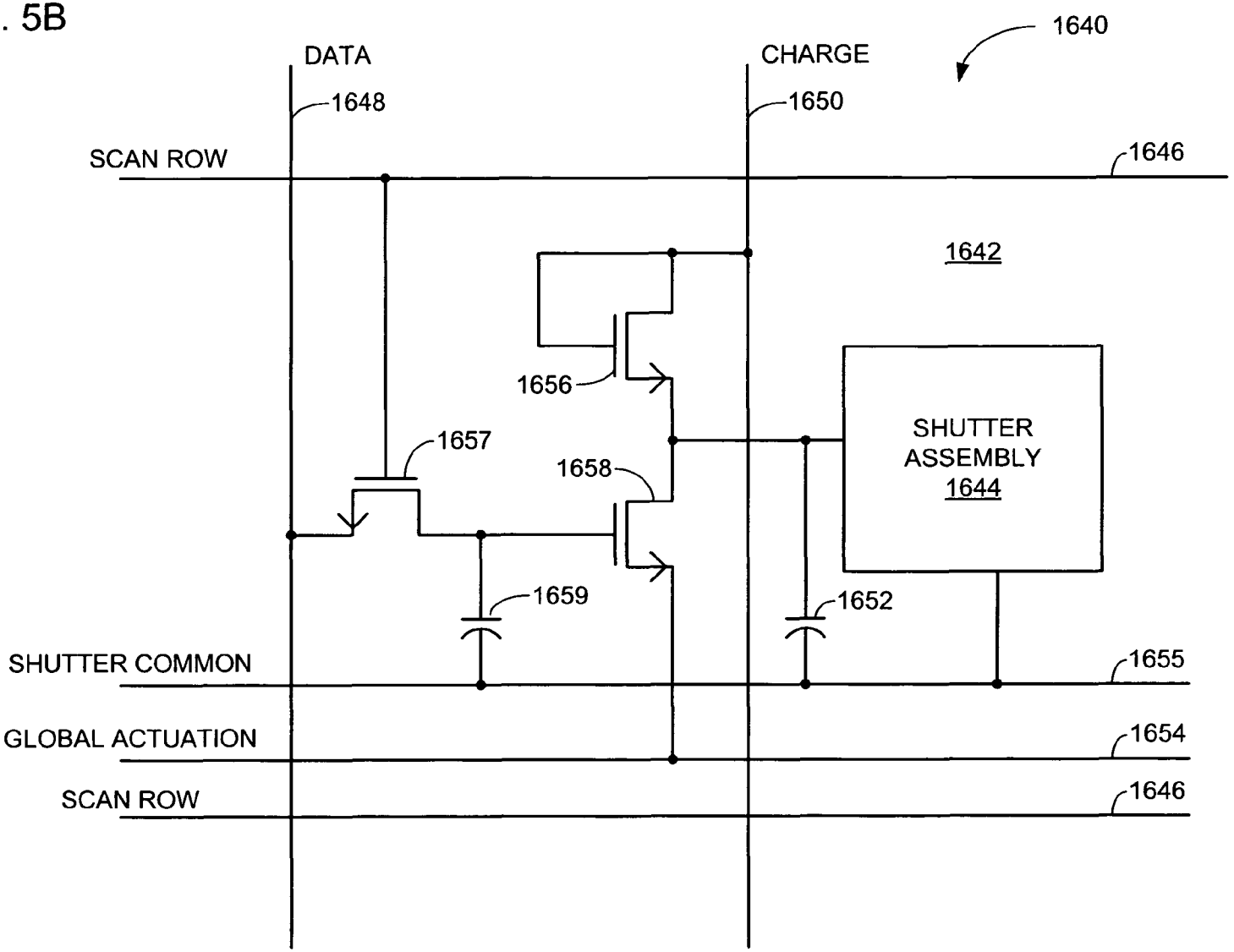
FIG. 5B is a diagram of another control matrix suitable for controlling the shutter assemblies of the display apparatus of FIG. 1A, according to an illustrative embodiment of the invention.

FIG. 5B illustrates another suitable control matrix 1640 for inclusion in the display apparatus 100, according to an illustrative embodiment of the invention. Control matrix 1640 controls an array of pixels 1642 that include elastic shutter assemblies. The control matrix 1640 includes a single data interconnect 1648 for each column of pixels 1642 in the control matrix. As such, the control matrix 1640 is suitable for controlling elastic shutter assemblies 1644, such as shutter assemblies 200, 220, 250, or 270. The actuators in the shutter assemblies 1644 can be made either electrically bi-stable or mechanically bi-stable.

The control matrix 1640 includes a scan-line interconnect 1646 for each row of pixels 1642 in the control matrix 1640. The control matrix 1640 further includes a charge interconnect 1650, and a global actuation interconnect 1654, and a shutter common interconnect 1655. These interconnects 1650, 1654 and 1655 are shared among pixels 1642 in multiple rows and multiple columns in the array. In one implementation (the one described in more detail below), the interconnects 1650, 1654, and 1655 are shared among all pixels 1642 in the control matrix 1640.

Each pixel 1642 in the control matrix includes a shutter charge transistor 1656, a shutter discharge transistor 1658, a shutter write-enable transistor 1657, and a data store capacitor 1659, as described in FIG. 5A. Control matrix 1640 also incorporates an optional voltage stabilizing capacitor 1652 which is connected in parallel with the source and drain of discharge switch transistor 1658.

By comparison to control matrix 1600, the charging transistor 1656 is wired with a different circuit connection to the charge interconnect 1650. Control matrix 1640 does not include a charge trigger interconnect which is shared among pixels. Instead, the gate terminals of the charging transistor 1656 are connected directly to the charge interconnect 1650, along with the drain terminal of transistor 1656. In operation, the charging transistors 1656 operate essentially as diodes, they can pass a current in only I direction.

At the beginning of each frame addressing cycle the control matrix 1640 applies a voltage pulse to the charge interconnect 1650, allowing current to flow through charging transistor 1656 and into the shutter assemblies 1644 of the pixels 1642. After this charging pulse, each of the shutter electrodes of shutter assemblies 1644 will be in the same voltage state. After the voltage pulse, the potential of charge interconnect 1650 is reset to zero, and the charging transistors 1656 will prevent the charge stored in the shutter assemblies 1644 from being dissipated through charge interconnect 1650. The charge interconnect 1650, in one implementation, transmits a pulsed voltage equal to or greater than $V_{at}$, e.g., 40V.

Each row is then write-enabled in sequence, as was described with respect to control matrix 1600 of FIG. 5A. While a particular row of pixels 1642 is write-enabled, the control matrix 1640 applies a data voltage to the data interconnect 1648 corresponding to each column of pixels 1642 in the control matrix 1640. The application of $V_{we}$ to the scan-line interconnect 1646 for the write-enabled row turns on the write-enable transistor 1657 of the pixels 1642 in the corresponding scan line. The voltages applied to the data interconnect 1648 is thereby caused to be stored on the data store capacitor 1659 of the respective pixels 1642.

In control matrix 1640 the global actuation interconnect 1654 is connected to the source of the shutter discharge switch transistor 1658. Maintaining the global actuation interconnect 1654 at a potential significantly above that of the shutter common interconnect 1655 prevents the turn-on of the discharge switch transistor 1658, regardless of what charge is stored on the capacitor 1659. Global actuation in control matrix 1640 is achieved by bringing the potential on the global actuation interconnect 1654 to ground or to substantially the same potential as the shutter common interconnect 1655, enabling the discharge switch transistor 1658 to turn-on in accordance to the whether a data voltage has been stored on capacitor 1659. Applying partial voltages to the data store capacitor 1659 allows partial turn-on of the discharge switch transistor 1658 during the time that the global actuation interconnect 1654 is brought to its actuation potential. In this fashion, an analog voltage is created on the shutter assembly 1644, for providing analog gray scale.

Figure 5C:
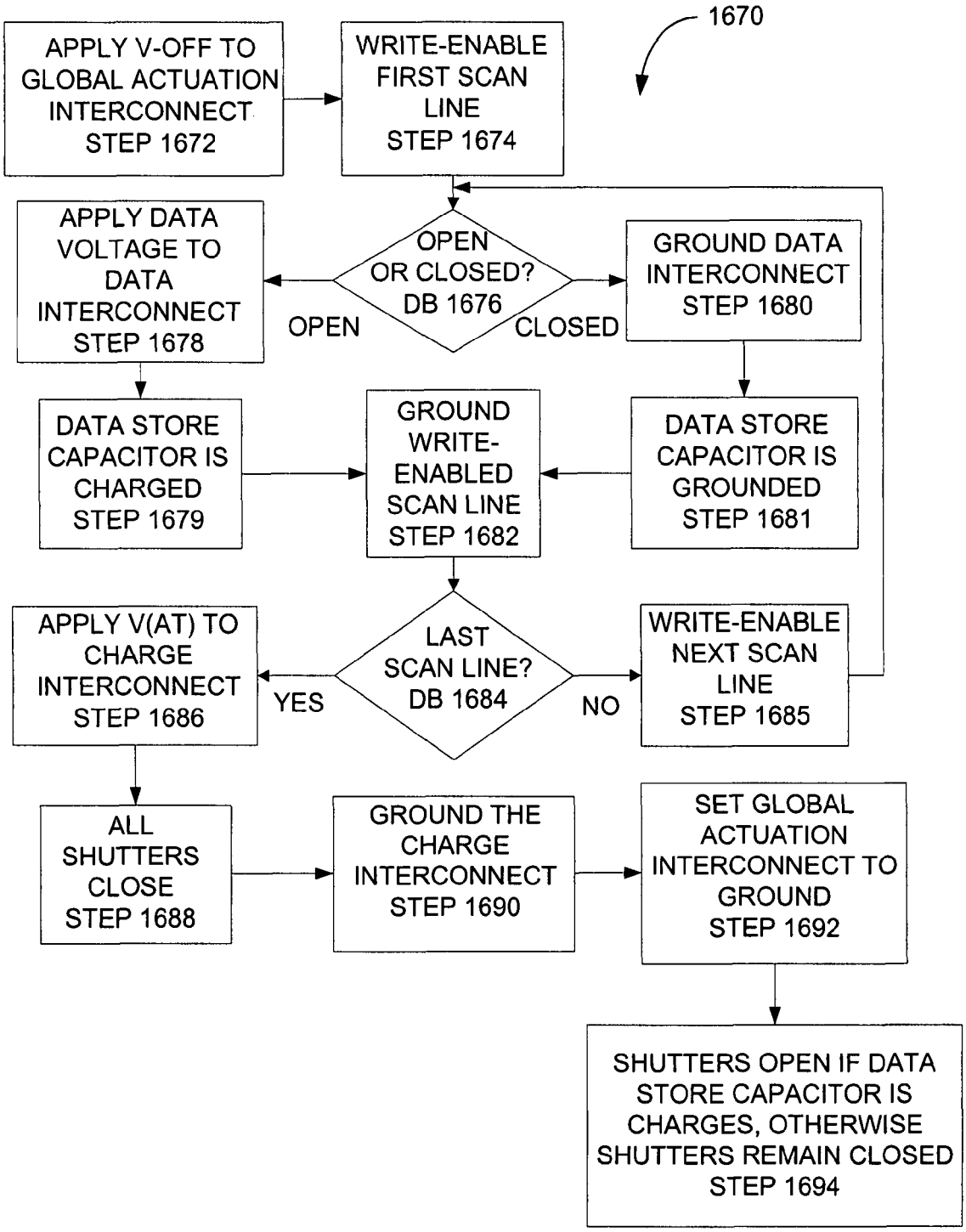
FIG. 5C is a flow chart of a method of addressing the pixels of the control matrix of FIG. 5B, according to an illustrative embodiment of the invention.

An alternative method of addressing pixels in control matrix 1640 is illustrated by the method 1670 shown in FIG. 5C. The method 1670 proceeds in three general steps. First the matrix is addressed row by row by storing data into the data store capacitors 1659. Next all actuators are actuated (or reset) simultaneously (step 1688) be applying a voltage $V_{at}$ to the charge interconnect 1650. And finally the image is set in a global actuation step 1692 by selectively activating transistors 1658 by means of the global actuation interconnect 1654.

In more detail, the frame addressing cycle of method 1670 begins when a voltage $V_{off}$ is applied to the global actuation interconnect 1654 (step 1672). The voltage $V_{off}$ on interconnect 1654 is designed to ensure that the discharge transistor 1658 will not turn on regardless of whether a voltage has been stored on capacitor 1659.

The control matrix 1640 then proceeds with the addressing of each pixel 1642 in the control matrix, one row at a time (steps 1674-1684). To address a particular row, the control matrix 1640 write-enables a first scan line by applying a voltage $V_{we}$ to the corresponding scan-line interconnect 1646 (step 1674). Then, at decision block 1676, the control matrix 1640 determines for each pixel 1642 in the write-enabled row whether the pixel 1642 needs to be open or closed. For example, if at the reset step 1688 all shutters are to be (temporarily) closed, then at decision block 1676 it is determined for each pixel 1642 in the write-enabled row whether or not the pixel is to be (subsequently) opened. If a pixel 1642 is to be opened, the control matrix 1640 applies a data voltage $V_d$, for example 5V, to the data interconnect 1648 corresponding to the column in which that pixel 1642 is located (step 1678). The voltage $V_d$ applied to the data interconnect 1648 is thereby caused to be stored by means of a charge on the data store capacitor 1659 of the selected pixel 1642 (step 1679). If at decision block 1676, it is determined that a pixel 1642 is to be closed, the corresponding data interconnect 1648 is grounded (step 1680). Although the relaxed position in this example is defined as the shutter-open position, alternative shutter assemblies can be provided in which the relaxed state is a shutter-closed position. In these alternative cases, the application of data voltage $V_d$, at step 1678, would result in the closing of the shutter.

The application of $V_{we}$ to the scan-line interconnect 1646 for the write-enabled row turns on all of the write-enable transistors 1657 for the pixels 1642 in the corresponding scan line. The control matrix 1640 selectively applies the data voltage to all columns of a given row in the control matrix 1640 at the same time while that row has been write-enabled. After all data has been stored on capacitors 1659 in the selected row (steps 1679 and 1681), the control matrix 1640 grounds the selected scan-line interconnect (step 1682) and selects a subsequent scan-line interconnect for writing (step 1685). After the information has been stored in the capacitors for all the rows in control matrix 1640, the decision block 1684 is triggered to begin the global actuation sequence.

The actuation sequence begins at step 1686 of method 1670, with the application of an actuation voltage $V_{at}$, e.g. 40 V, to the charge interconnect 1650. As a consequence of step 1686, the voltage $V_{at}$ is now imposed simultaneously across all the actuators of all the shutter assemblies 1644 in control matrix 1640. The control matrix 1640 continues to apply the voltage $V_{at}$ (step 1686) for a period of time sufficient for all actuators to actuate into an initial state (step 1688). For the example given in method 1670, step 1688 acts to reset and close all actuators. Alternatives to the method 1670 are possible, however, in which the reset step 1688 acts to open all shutters. At the next step 1690 the control matrix grounds the charge interconnect 1650. A voltage, at least greater than a maintenance voltage $V_m$, remains stored across the capacitor 1652, thereby holding the shutters in position. The electrodes on the actuators in shutter assembly 1644 provide a capacitance which also stores a charge after the charge interconnect 1650 has been grounded, useful for those embodiments in which capacitor 1652 is not included.

After all actuators have been actuated and held in their closed position by voltage in excess of $V_m$, the data stored in capacitors 1659 can now be utilized to set an image in control matrix 1640 by selectively opening the specified shutter assemblies (steps 1692 and 1694). First, the potential on the global actuation interconnect 1654 is set to substantially the same potential as the shutter common interconnect 1655 (step 1692). Step 1692 makes it possible for the discharge switch transistor 1658 to turn-on in accordance to whether a data voltage has been stored on capacitor 1659. For those pixels in which a voltage has been stored on capacitor 1659, the charge which was stored on the actuator of shutter assembly 1644 is now allowed to dissipate through the global actuation interconnect 1654. At step 1694, therefore, selected shutters are discharged through transistor 1658 and allowed to return by means of a restoring force or spring into their relaxed position. For the example given in method 1670, a discharge into the relaxed position means that the selected shutter assemblies 1644 are placed in their open position. For pixels where no voltage was stored on capacitor 1659, the transistor 1658 remains closed at step 1694, no discharge will occur and the shutter assembly 1644 remains closed.

To set an image in a subsequent video frame, the process begins again at step 1672.

In the method 1670, all of the shutters are closed simultaneously during the time between step 1688 and step 1694, a time in which no image information can be presented to the viewer. The method 1670, however, is designed to minimize this dead time (or reset time) by making use of data store capacitors 1659 and global actuation interconnect 1654 to provide timing control over the transistors 1658. By the action of step 1672, all of the data for a given image frame can be written to the capacitors 1659 during the addressing sequence (steps 1674-1685), without any immediate actuation effect on the shutter assemblies. The shutter assemblies 1644 remain locked in the positions they were assigned in the previous image frame until addressing is complete and they are uniformly actuated or reset at step 1688. The global actuation step 1692 allows the simultaneous transfer of data out of the data store capacitors 1659 so that all shutter assemblies can be brought into their next addressed image state at the same time.

As with the previously described control matrices, the activity of an attached backlight can be synchronized with the addressing of each frame. To take advantage of the minimal dead time offered in the addressing sequence of method 1670, a command to turn the illumination off can be given between step 1684 and step 1686. The illumination can then be turned-on again after step 1694. In a field-sequential color scheme, a lamp with one color can be turned off after step 1684 while a lamp with either the same or a different color is turned on after step 1694.

In other implementations it is possible to apply the method 1670 of FIG. 5C to a selected portion of the whole array of pixels, since it may be advantageous to update different areas or groupings of rows and columns in series. In this case a number of different charge interconnects 1650 and global actuation interconnects 1654 could be routed to selected portions of the array for selectively updating and actuating different portions of the array.

As described above, to address the pixels 1642 in the control matrix 1640, the data voltage $V_d$ can be significantly less than the actuation voltage $V_{at}$ (e.g., 5V vs. 40V). Since the actuation voltage $V_{at}$ is applied once a frame, whereas the data voltage $V_d$ may be applied to each data interconnect 1648 as may times per frame as there are rows in the control matrix 1640, control matrices such as control matrix 1640 may save a substantial amount of power in comparison to control matrices which require a data voltage to be high enough to also serve as the actuation voltage.

It will be understood that the embodiment of FIG. 5B assumes the use of n-channel MOS transistors. Other embodiments are possible that employ p-channel transistors, in which case the relative signs of the bias potentials $V_{at}$ and $V_d$ would be reversed.

The method 1670 assumes digital information is written into an image frame, i.e. where the shutters are intended to be either open or closed. Using the circuit of control matrix 1640, however, it is also possible to write analog information into the shutter assemblies 1644. In this case, the grounding of the scan line interconnects is provided for only a short and fixed amount of time and only partial voltages are applied through the data line interconnects 1648. The application of partial voltages to the discharge switch transistor 1658, when operated in a linear amplification mode, allows for only the partial discharge of the electrode of the shutter assembly 1644 and therefore a partial opening of the shutter.

In some implementations it is advantageous to periodically or occasionally reverse the sign of the voltages that appear across the actuators of shutter assembly 1644 without otherwise altering the method 1670 of addressing the pixels. In operation, in order to periodically reverse the polarity of voltages, the control matrix alternates between two control logics, as described in U.S. patent application Ser. No. 11/326,696. In the first control logic, at step 1686 in the addressing cycle, the control matrix 1640 closes the shutter assemblies 1644 of all pixels in the control matrix 1640 by storing $V_{at}$ across the electrodes of the shutter assembly 1644 actuator. The potential on the shutter common interconnect 1655 is held at ground.

To reverse polarities in the second control logic, the potential of the shutter common interconnect 1655 is set instead to the actuation voltage $V_{at}$. At steps 1686 and 1688, where the voltage on the charge interconnect 1650 is set to $V_{at}$, all shutters are instead allowed to relax to their open position. Therefore, in the second control logic, the logic at step 1676 is reversed: the control matrix 1640 discharges the stored $V_{at}$ from shutter assemblies that are to be closed, as opposed to those that are to remain open. At step 1692, global actuation is achieved by setting the global actuation interconnect 1654 to ground.

The control matrix 1640 can alternate between the control logics every frame or on some other periodic basis. Over time, the net potentials applied to the shutter assemblies 1644 by the charge interconnect 1650 and the shutter common interconnect 1655 average out to 0V.

Figure 6:
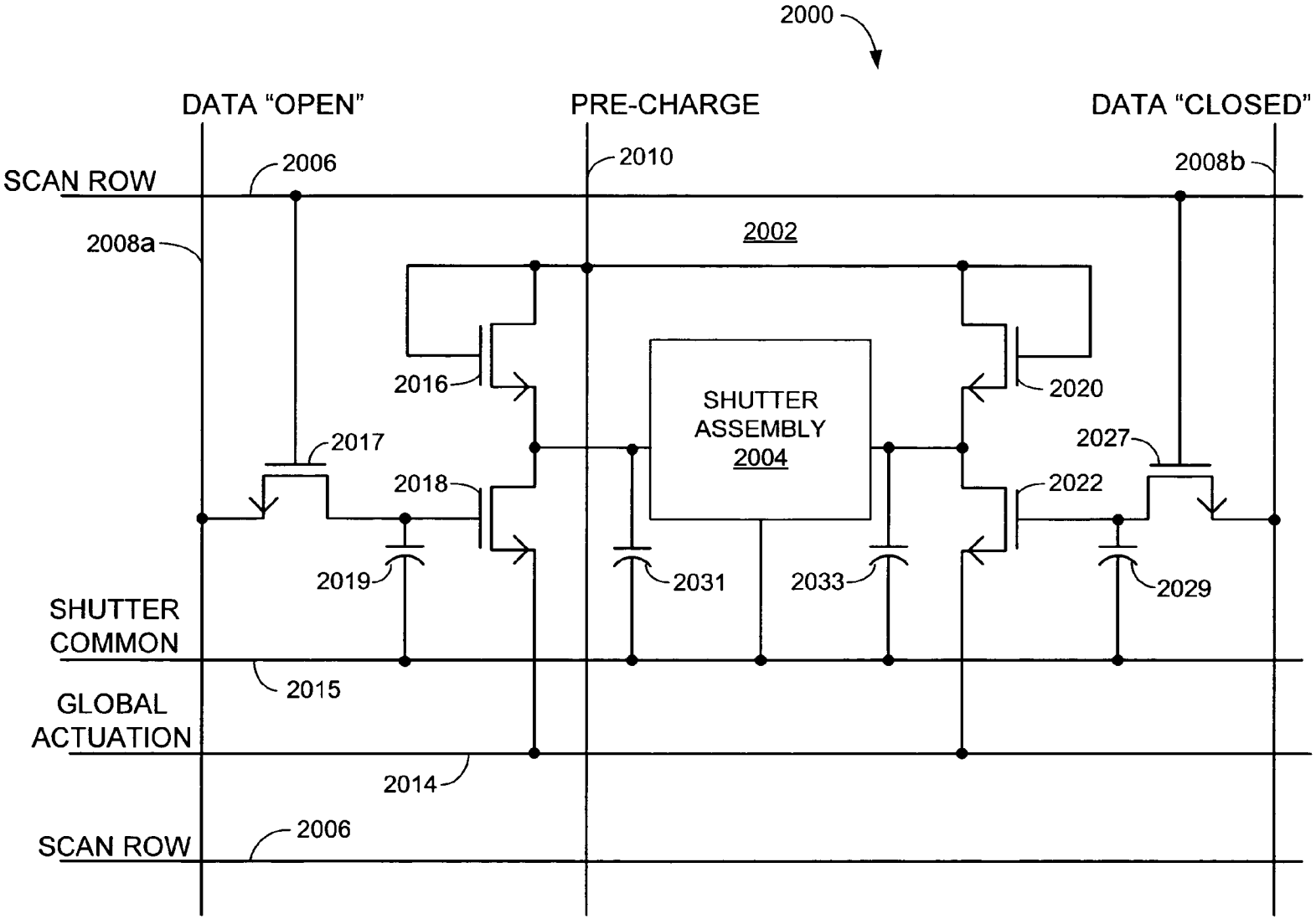
FIG. 6 is a diagram of another control matrix suitable for controlling the shutter assemblies of the display apparatus of FIG. 1A, according to an illustrative embodiment of the invention.

FIG. 6 is yet another suitable control matrix 2000 for inclusion in the display apparatus 100, according to an illustrative embodiment of the invention. Control matrix 2000 controls an array of pixels 2002 that include dual-actuator shutter assemblies 2004. Dual actuator shutter assemblies, such as shutter assembly 400, are shutter assemblies that include separate shutter-open and shutter-close actuators. The actuators in the shutter assemblies 2004 can be made either electrically bi-stable or mechanically bi-stable.

The control matrix 2000 includes a scan-line interconnect 2006 for each row of pixels 2002 in the control matrix 2000. The control matrix 2000 also includes two data interconnects, a shutter-open interconnect 2008*a* and a shutter-close interconnect 2008*b*, for each column of pixels 2002 in the control matrix 2000. The control matrix 2000 further includes a charge interconnect 2010, and a global actuation interconnect 2014, and a shutter common interconnect 2015. These interconnects 2010, 2014 and 2015 are shared among pixels 2002 in multiple rows and multiple columns in the array. In one implementation (the one described in more detail below), the interconnects 2010, 2014 and 2015 are shared among all pixels 2002 in the control matrix 2000.

Each pixel 2002 in the control matrix includes a shutter-open charge transistor 2016, a shutter-open discharge transistor 2018, a shutter-open write-enable transistor 2017, and a data store capacitor 2019 as described in FIG. 5A. Each pixel 2002 in the control matrix includes a shutter-close charge transistor 2020, and a shutter-close discharge transistor 2022, a shutter-close write-enable transistor 2027, and a data store capacitor 2029.

Control matrix 2000 also incorporates two voltage stabilizing capacitors 2031 and 2033 which connect on one side to the sources of the discharge switch transistors 2018 and 2022, respectively, and on the other side to the shutter common interconnect 2015.

By comparison to control matrix 1600 of FIG. 5A, each of the charging transistors 2016 and 2020 is wired in with a different circuit connection to the charge interconnect 2010. Control matrix 2000 does not include a charge trigger interconnect which is shared among pixels. Instead, the gate terminals of both charging transistors 2016 and 2020 are connected directly to the charge interconnect 2010, along with the drain terminal of transistors 2016 and 2020. In operation, the charging transistors operate essentially as diodes, i.e., they can pass a current in only 1 direction.

At the beginning of each frame addressing cycle the control matrix 2000 applies a voltage pulse to the charge interconnect 2010, allowing current to flow through charging transistors 2016 and 2020 and into the shutter assemblies 2004 of the pixels 2002. After this charging pulse, each of the shutter open and shutter closed electrodes of shutter assemblies 2004 will be in the same voltage state. After the voltage pulse, the potential of charge interconnect 2010 is reset to zero, and the charging transistors 2016 and 2020 will prevent the charge stored in the shutter assemblies 2004 from being dissipated through charge interconnect 2010. The charge interconnect 2010, in one implementation, transmits a pulsed voltage equal to or greater than $V_{at}$, e.g., 40V. As an immediate result of the charging operation, the shutter assemblies 2004 do not necessarily change their states. As voltages are applied to both of the actuators simultaneously, and as one of the actuators is likely already in its closed or actuated state, then the electrically bi-stable nature of the shutter assembly tends to prevent any further change of state.

Each row is then write-enabled in sequence, as was described with respect to control matrix 1600 of FIG. 5A. While a particular row of pixels 2002 is write-enabled, the control matrix 2000 applies a data voltage to either the shutter-open interconnect 2008*a* or the shutter-close interconnect 2008*b* corresponding to each column of pixels 2002 in the control matrix 2000. The application of $V_{we}$ to the scan-line interconnect 2006 for the write-enabled row turns on both of the write-enable transistors 2017 and 2027 of the pixels 2002 in the corresponding scan line. The voltages applied to the data interconnects 2008*a* and 2008*b* are thereby caused to be stored on the data store capacitors 2019 and 2029 of the respective pixels 2002. Generally, to ensure proper actuation, only one of the actuators, either the shutter-closed actuator or the shutter-open actuator, is caused to be discharged for any given shutter assembly in the array.

In control matrix 2000 the global actuation interconnect 2014 is connected to the source of the both the shutter-open discharge switch transistor 2018 and the shutter-close discharge transistor 2022. Maintaining the global actuation interconnect 2014 at a potential significantly above that of the shutter common interconnect 2015 prevents the turn-on of any of the discharge switch transistors 2018 or 2022, regardless of what charge is stored on the capacitors 2019 and 2029. Global actuation in control matrix 2000 is achieved by bringing the potential on the global actuation interconnect 2014 to substantially the same potential as the shutter common interconnect 2015, making it possible for the discharge switch transistors 2018 or 2022 to turn-on in accordance to whether a data voltage has been stored on ether capacitor 2019 or 2029. Control matrix 2000, therefore, does not depend on electrical bi-stability in the shutter assembly 2004 in order to achieve global actuation.

Applying partial voltages to the data store capacitors 2019 and 2021 allows partial turn-on of the discharge switch transistors 2018 and 2022 during the time that the global actuation interconnect 2014 is brought to its actuation potential. In this fashion, an analog voltage is created on the shutter assembly 2004, for providing analog gray scale.

In operation, in order to periodically reverse the polarity of voltages supplied to the shutter assembly 2004, the control matrix 2000 alternates between two control logics, as described in relation to method 1670 of FIG. 5C.

It will be understood that the embodiment of FIG. 6 assumes the use of n-channel MOS transistors. Other embodiments are possible that employ p-channel transistors, in which case the relative signs of the bias potentials $V_{at}$ and $V_d$ would be reversed. In alternative implementations, the storage capacitors 2019 and 2029 and write-enable transistors can be replaced with an alternative data memory circuit, such as a DRAM or SRAM circuit known in the art. In alternate implementations, semiconductor diodes and/or metal insulator metal sandwich type thin films can be substituted as switches in place of transistors in control matrix 2000. Examples of these substitutions are described in U.S. patent application Ser. No. 11/326,696.

Figure 7:
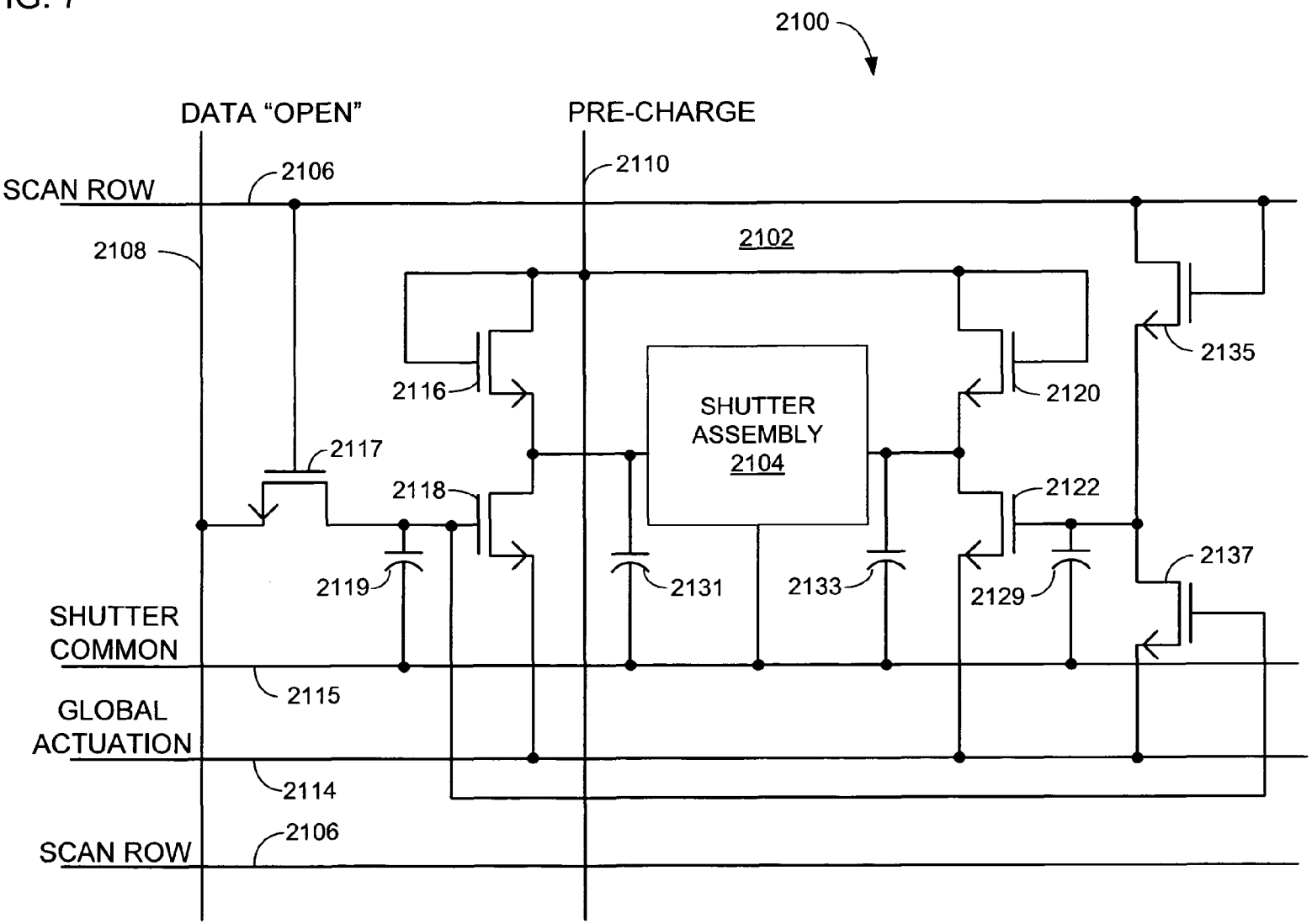
FIG. 7 is a diagram of a control matrix suitable for controlling the shutter assemblies of the display apparatus of FIG. 1A, according to an illustrative embodiment of the invention.

FIG. 7 is yet another suitable control matrix 2100 for inclusion in the display apparatus 100, according to an illustrative embodiment of the invention. Control matrix 2100 controls an array of pixels 2102 that include dual-actuator shutter assemblies 2104 (i.e., shutter assemblies with both shutter-open and shutter-close actuators). The actuators in the shutter assemblies 2104 can be made either electrically bi-stable or mechanically bi-stable.

The control matrix 2100 includes a scan-line interconnect 2106 for each row of pixels 2102 in the control matrix 2100. Despite the fact that shutter assemblies 2104 are dual-actuator shutter assemblies, the control matrix 2100 only includes a single data interconnect 2108. The control matrix 2100 further includes a charge interconnect 2110, and a global actuation interconnect 2114, and a shutter common interconnect 2115. These interconnects 2110, 2114 and 2115 are shared among pixels 2102 in multiple rows and multiple columns in the array. In one implementation (the one described in more detail below), the interconnects 2110, 2114, and 2115 are shared among all pixels 2102 in the control matrix 2100.

Each pixel 2102 in the control matrix includes a shutter-open charge transistor 2116, a shutter-open discharge transistor 2118, a shutter-open write-enable transistor 2117, and a data store capacitor 2119, as described in FIG. 5A. Each pixel 2102 in the control matrix includes a shutter-close charge transistor 2120, a shutter-close discharge transistor 2122, and a data store capacitor 2129.

In addition and in contrast to control matrices described until now, the control matrix 2100 includes a data load transistor 2135 and a data discharge transistor 2137. Control matrix 2100 also incorporates two voltage stabilizing capacitors 2131 and 2133 which connect on one side to the sources of the discharge switch transistors 2118 and 2122, respectively, and on the other side to the shutter common interconnect 2115.

The charging transistors 2116 and 2120 are wired similarly to that of the charging transistors in control matrix 2000 of FIG. 6. That is, the gate terminals of both charging transistors 2116 and 2120 are connected directly to the charge interconnect 2110, along with the drain terminal of transistors 2116 and 2120.

At the beginning of each frame addressing cycle the control matrix 2100 applies a voltage pulse to the charge interconnect 2110, allowing current to flow through charging transistors 2116 and 2120 and into the shutter assemblies 2104 of the pixels 2102. After this charging pulse, each of the shutter open and shutter closed electrodes of shutter assemblies 2104 will be in the same voltage state. After the voltage pulse, the potential of charge interconnect 2110 is reset to zero, and the charging transistors 2116 and 2120 will prevent the charge stored in the shutter assemblies 2104 from being dissipated through charge interconnect 2110. The charge interconnect 2110, in one implementation, transmits a pulsed voltage equal to or greater than $V_{at}$, e.g., 40V.

Each row is then write-enabled in sequence, as was described with respect to control matrix 1600 of FIG. 5A. While a particular row of pixels 2102 is write-enabled, the control-matrix 2100 applies a data voltage to the data interconnect 2108. The application of $V_{we}$ to the scan-line interconnect 2106 for the write-enabled row turns on the write-enable transistor 2117 of the pixels 2102 in the corresponding scan line. The voltages applied to the data interconnect 2108 is thereby caused to be stored on the data store capacitor 2119 of the respective pixels 2102. The same $V_{we}$ that is applied to the write enable transistor 2117 is applied simultaneously to both the gate and the drain of data load transistor 2135, which allows current to pass through the data load transistor 2135 depending on whatever voltage is stored on capacitor 2129.

The combination of transistors 2135 and 2137 functions essentially as an inverter with respect to the data stored on capacitor 2119. The source of data load transistor 2135 is connected to the drain of data discharge transistor 2137 and simultaneously to an electrode of the data store capacitor 2129. The gate of data discharge transistor 2137 is connected to an electrode of data store capacitor 2119. The voltage stored on capacitor 2129, therefore, becomes the complement or inverse of the voltage stored on data store capacitor 2119. For instance, if the voltage on the data store capacitor 2119 is $V_{on}$, then the data discharge transistor 2137 can switch on and the voltage on the data store capacitor 2129 can become zero. Conversely, if the voltage on data store capacitor 2119 is zero, then the data discharge transistor 2137 will switch off and the voltage on the data store capacitor 2129 will remain at its pre-set voltage $V_{we}$.

In control matrix 2100 the global actuation interconnect 2114 is connected to the source of the shutter-open discharge switch transistor 2118, the shutter-close discharge transistor 2122, and the data discharge transistor 2137. Maintaining the global actuation interconnect 2114 at a potential significantly above that of the shutter common interconnect 2115 prevents the turn-on of any of the discharge switch transistors 2118, 2122 and 2137, regardless of what charge is stored on the capacitors 2119. Global actuation in control matrix 2100 is achieved by bringing the potential on the global actuation interconnect 2114 to substantially the same potential as the shutter common interconnect 2115. During the time that the global actuation is so activated, all three of the transistors 2118, 2122, and 2137 can change their state, depending on what data voltage has been stored on capacitor 2119. Because of the operation of the inverter 2135 and 2137, only one of the discharge transistors 2118 or 2122 can be on at any one time, ensuring proper actuation of shutter assembly 2104. The presence of the inverter 2135 and 2137 helps to obviate the need for a separate shutter-close data interconnect.

Applying partial voltages to the data store capacitors 2119 and 2129 allows partial turn-on of the discharge switch transistors 2118 and 2122 during the time that the global actuation interconnect 2114 is brought to its actuation potential. In this fashion, an analog voltage is created on the shutter assembly 2104, for providing analog gray scale.

In operation, in order to periodically reverse the polarity of voltages supplied to the shutter assembly 2104, the control matrix 2100 alternates between two control logics as described in relation to method 1670 of FIG. 5C.

In alternate implementations, semiconductor diodes and/or metal insulator metal sandwich type thin films can be substituted as switches in place of transistors in control matrix 2100.

Figure 8:
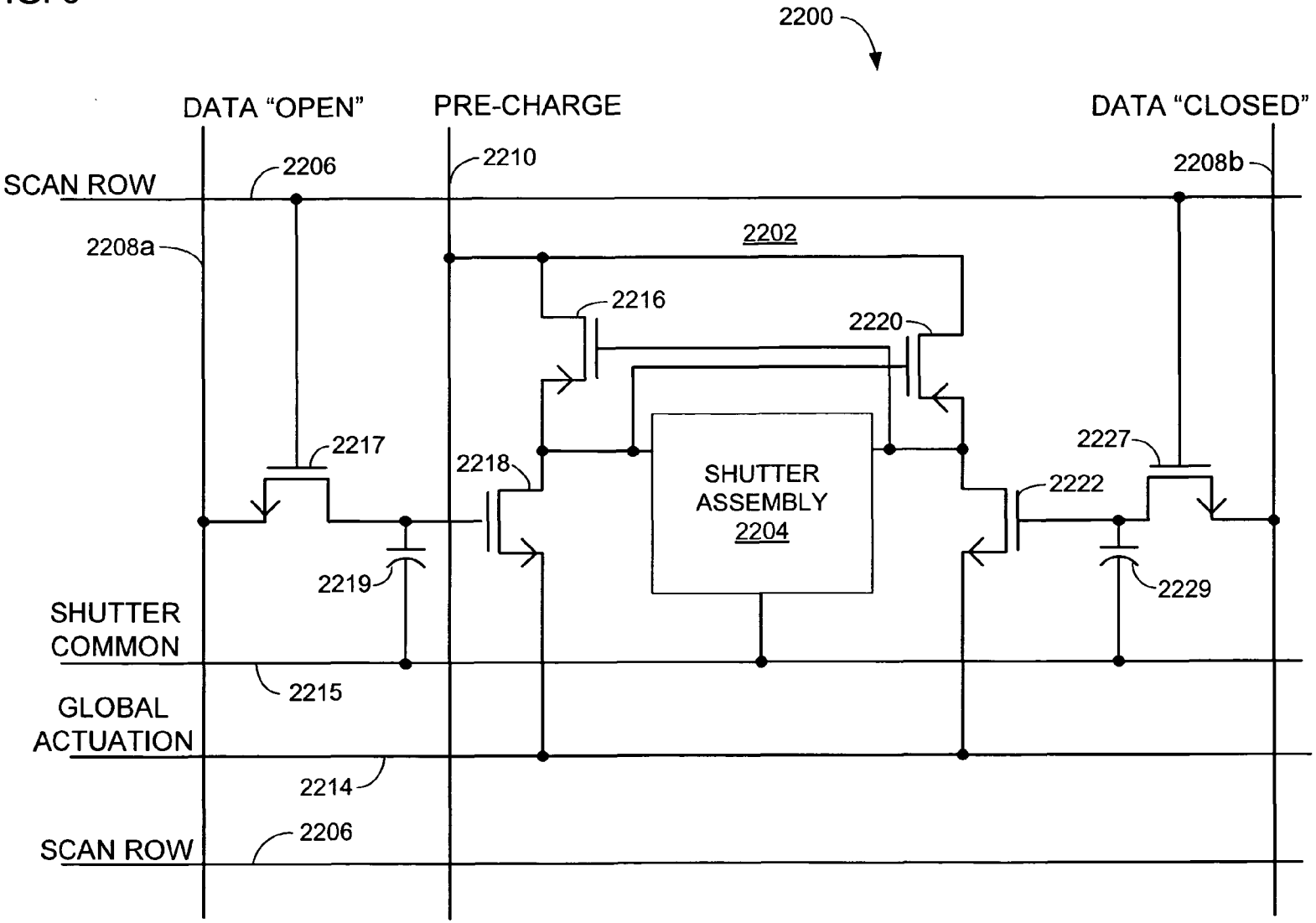
FIG. 8 is a diagram of a control matrix suitable for controlling the shutter assemblies of the display apparatus of FIG. 1A, according to an illustrative embodiment of the invention.

FIG. 8 is yet another suitable control matrix 2200 for inclusion in the display apparatus 100, according to an illustrative embodiment of the invention. Control matrix 2200 controls an array of pixels 2202 that include dual-actuator shutter assemblies 2204 (i.e., shutter assemblies with both shutter-open and shutter-close actuators). The actuators in the shutter assemblies 2204 can be made either electrically bi-stable or mechanically bi-stable.

The control matrix 2200 includes a scan-line interconnect 2206 for each row of pixels 2202 in the control matrix 2200. The control matrix 2200 also includes two data interconnects, a shutter-open interconnect 2208*a* and a shutter-close interconnect 2208*b*, for each column of pixels 2202 in the control matrix 2200. The control matrix 2200 further includes a charge interconnect 2210, a global actuation interconnect 2214, and a shutter common interconnect 2215. These interconnects 2210, 2214 and 2215 are shared among pixels 2202 in multiple rows and multiple columns in the array. In one implementation (the one described in more detail below), the interconnects 2210, 2214 and 2215 are shared among all pixels 2202 in the control matrix 2200.

Each pixel 2202 in the control matrix includes a shutter-open charge transistor 2216, a shutter-open discharge transistor 2218, a shutter-open write-enable transistor 2217, and a data store capacitor 2219 as described in FIG. 5A. Each pixel 2202 in the control matrix includes a shutter-close charge transistor 2220, and a shutter-close discharge transistor 2222, a shutter-close write-enable transistor 2227, and a data store capacitor 2229.

The control matrix 2200 makes use of two complementary types of transistors, both p-channel and n-channel transistors. It is therefore referred to as a complementary MOS control matrix or a CMOS control matrix. The charging transistors 2216 and 2220 are of the pMOS type while the discharge transistors 2218 and 2222 are of the nMOS type. In other implementations, the types of transistors can be reversed, for example nMOS transistors can be used for the charging transistors and pMOS transistors can be used for the discharge transistors. (The symbol for a pMOS transistor includes an arrow that points into the channel region, the symbol for an NMOS transistor includes an arrow that points away from the channel region.)

The CMOS control matrix 2200 does not incorporate and does not require any voltage stabilizing capacitors, such as 2031 and 2033 from control matrix 2000 of FIG. 6. Control matrix 2200 does not include a charge trigger interconnect (such as charge trigger interconnect 1608 in control matrix 1600 of FIG. 5A). By comparison to control matrix 2000, the charging transistors 2216 and 2220 are wired with different circuit connections between the charge interconnect 2210 and the shutter assembly 2204. The source of each of transistors 2216 and 2220 are connected to the charge interconnect 2210. The gate of shutter-close charge transistor 2220 is connected to the drain of a shutter-open discharge transistor 2218 and simultaneously to the shutter-open actuator of the corresponding shutter assembly 2204. The gate of shutter-open charge transistor 2216 is connected to the drain of a shutter-close discharge transistor 2222 and simultaneously to the shutter-close actuator of the corresponding shutter assembly 2204. The drain of shutter-close charge transistor 2220 is connected to the drain of a shutter-close discharge transistor 2222 and simultaneously to the shutter-close actuator of the corresponding shutter assembly 2204. The drain of shutter-open charge transistor 2216 is connected to the drain of a shutter-open discharge transistor 2218 and simultaneously to the shutter-open actuator of the corresponding shutter assembly 2204.

The operation of control matrix 2200 is distinct from that of method 1670, and simpler, since it does not require a distinct or initializing charging operation. (Charging occurs in the method 1670 between the steps 1686 and 1690.) A charging operation was utilized for control matrix 1600 when a voltage was applied to charge trigger interconnect so as to turn on the shutter charge transistors 1616. A charging operation was utilized in control matrix 2000 when a temporary voltage pulse was applied to charge interconnect 2010, allowing current to flow through the charging transistors 2016 and 2020. Instead, the charge interconnect 2210 is maintained at a steady DC voltage equal to the actuation voltage $V_{at}$, e.g. at 40 volts.

The control matrix 2200 operates as a logical flip-flop, which has only two stable states. In the first stable state the shutter-open discharge transistor 2218 is on, the shutter-closed discharge transistor 2222 is off, the shutter-open charge transistor 2216 is off, and the shutter-close charge transistor 2220 is on. In this first stable state the shutter-open actuator is discharged or set to the same potential as the global actuation interconnect 2214, while the shutter-closed actuator is held at the actuation voltage $V_{at}$. In the second stable state the shutter-open discharge transistor 2218 is off, the shutter-closed discharge transistor 2222 is on, the shutter-open charge transistor 2216 is on, and the shutter-close charge transistor 2220 is off. In this second stable state the shutter-closed actuator is discharged or set to the same potential as the global actuation interconnect 2214, while the shutter-closed actuator is held at the actuation voltage $V_{at}$. The cross-coupling of transistors 2216, 2218, 2220, and 2222 helps to ensure that if any one of these 4 transistors is on—then only the two states described above can result as a stable state. In various embodiments, the flip-flop can also be used to store pixel addressing data.

Those skilled in the art will recognize that both the shutter-open and shutter-close actuators of shutter assembly 2204 are connected to the output stage of a corresponding CMOS inverter. These inverters can be labeled as the shutter open inverter which comprises transistors 2216 and 2218 and the shutter close inverter which comprises transistors 2220 and 2222. The flip-flop operation of the switching circuit is formed from the cross-coupling of the two inverters. These inverters are also known as level shifting inverters since the input voltages, from data store capacitors 2219 and 2229, are lower than the output voltages, i.e. the $V_{at}$ which is supplied to the actuators.

The two stable actuation states of control matrix 2200 are associated with substantially zero current flow between the charge interconnect 2210 and the global actuation interconnect 2214, an important power savings. This is achieved because the shutter-open charge transistor 2216 and the shutter-close discharge transistor 2218 are made from different transistor types, pMOS or nMOS, while the shutter-close charge transistor 2220 and the shutter-close discharge transistor 2222 are also made from the different transistor types, pMOS and nMOS.

The flip-flop operation of control matrix 2200 allows for a constant voltage actuation of the shutter assembly 2204, without the need for voltage stabilizing capacitors, such as capacitor 2031 or 2033 in control matrix 2000 of FIG. 6. This is because one of the charging transistors 2216 or 2220 remains on throughout the actuation event, allowing the corresponding actuator to maintain a low impedance connection to the DC supply of the interconnect 2210 throughout the actuation event.

At the beginning of each frame addressing cycle the control matrix 2200 applies a write enable voltage to each scan-line interconnect 2206 in sequence. While a particular row of pixels 2202 is write-enabled, the control matrix 2200 applies a data voltage to either the shutter-open interconnect 2208*a* or the shutter-close interconnect 2208*b* corresponding to each column of pixels 2202 in the control matrix 2200. The application of $V_{we}$ to the scan-line interconnect 2206 for the write-enabled row turns on both of the write-enable transistors 2217 and 2227 of the pixels 2202 in the corresponding scan line. The voltages applied to the data interconnects 2208*a* and 2208*b* are thereby caused to be stored on the data store capacitors 2219 and 2229 of the respective pixels 2202. Generally, to ensure proper actuation, only one of the actuators, either the shutter-closed actuator or the shutter-open actuator, is caused to be discharged for any given shutter assembly in the array.

In control matrix 2200 the global actuation interconnect 2214 is connected to the source of the both the shutter-open discharge switch transistor 2218 and the shutter-close discharge transistor 2222. Maintaining the global actuation interconnect 2214 at a potential significantly above that of the shutter common interconnect 2215 prevents the turn-on of any of the discharge switch transistors 2218 or 2222, regardless of what charge is stored on the capacitors 2219 and 2229. Global actuation in control matrix 2200 is achieved by bringing the potential on the global actuation interconnect 2214 to substantially the same potential as the shutter common interconnect 2215, making it possible for the discharge switch transistors 2218 or 2222 to turn-on in accordance to whether a data voltage has been stored on either capacitor 2219 or 2222. Upon setting the global actuation interconnect to the same potential as the shutter common interconnect, the state of the transistors will either remain unchanged from its stable state as it was set at the last actuation event, or it will switch to the alternate stable state, in accordance to whether a data voltage has been stored on either capacitor 2219 or 2222.

The voltage stored on capacitors 2219 or 2229 is not necessarily the same as the actuation voltage as applied to the charge interconnect 2210. Therefore some optional specifications on the transistors can help to reduce any transient switching currents in control matrix 2200. For instance, it may be preferable to increase the ratio of width to length in the discharge transistors 2218 and 2222 as compared to the charge transistors 2216 and 2220. The ratio of width to length for the discharge transistors may vary between 1 to 10 while the ratio of length to width for the charge transistors may vary between 0.1 and 1.

In operation, in order to periodically reverse the polarity of voltages supplied to the shutter assembly 2204, the control matrix 2200 alternates between two control logics as described in relation to method 1670 of FIG. 5C.

Figure 9:
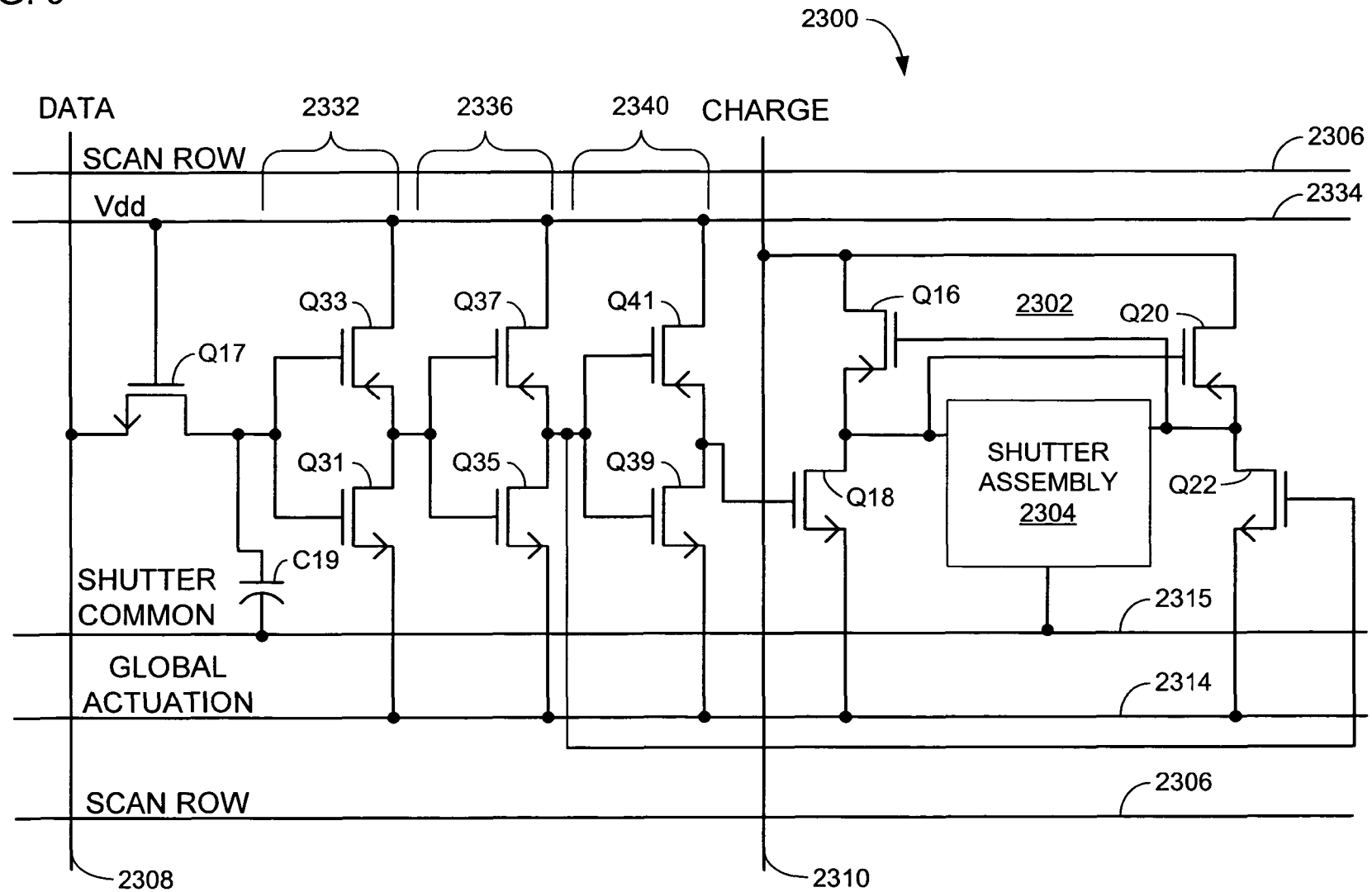
FIG. 9 is a diagram of a control matrix suitable for controlling the shutter assemblies of the display apparatus of FIG. 1A, according to an illustrative embodiment of the invention.

FIG. 9 is yet another suitable control matrix 2300 for inclusion in the display apparatus 100, according to an illustrative embodiment of the invention. Control matrix 2300 controls an array of pixels 2302 that include dual-actuator shutter assemblies 2304 (i.e., shutter assemblies with both shutter-open and shutter-close actuators). The actuators in the shutter assemblies 2304 can be made either electrically bi-stable or mechanically bi-stable.

The control matrix 2300 includes a scan-line interconnect 2306 for each row of pixels 2302 in the control matrix 2300. Despite the fact that shutter assemblies 2304 are dual-actuator shutter assemblies, the control matrix 2300 only includes a single data interconnect 2308. The control matrix 2300 further includes a charge interconnect 2310, and a global actuation interconnect 2314, and a shutter common interconnect 2315. These interconnects 2310, 2314 and 2315 are shared among pixels 2302 in multiple rows and multiple columns in the array. In one implementation (the one described in more detail below), the interconnects 2310, 2314 and 2315 are shared among all pixels 2302 in the control matrix 2300.

Each pixel 2302 in the control matrix includes a shutter-open charge transistor Q16, a shutter-open discharge transistor Q18, a shutter-open write-enable transistor Q17, and a data store capacitor C19, as described in FIG. 5A. Each pixel 2302 in the control matrix includes a shutter-close charge transistor Q20, and a shutter-close discharge transistor Q22, and a shutter-close write-enable transistor Q27.

The control matrix 2300 makes use of two complementary types of transistors, both p-channel and n-channel transistors. It is therefore referred to as a complementary MOS control matrix or a CMOS control matrix. The charging transistors Q16 and Q20, for instance, are of the pMOS type, while the discharge transistors Q18 and Q22 are of the nMOS type. In other implementations, the types of transistors employed in control matrix 2300 can be reversed, for example nMOS transistors can be used for the charging transistors and pMOS transistors can be used for the discharge transistors.

In addition to the transistors identified above, the control matrix 2300 includes a level shifting inverter 2332, comprised of transistors Q31 and Q33; it includes a transition-sharpening inverter 2336, comprised of transistors Q35 and Q37; and it includes a switching inverter 2340, comprised of transistors Q39 and Q41. Each of these inverters is comprised of complementary pairs of transistors (i.e., nMOS coupled with pMOS). The sources of transistors Q33, Q37, and Q41 are connected to a $V_{dd}$ supply interconnect 2334. The sources of transistors Q31, Q35, and Q39 are connected to the global actuation interconnect 2314.

The CMOS control matrix 2300 does not incorporate and does not require any voltage stabilizing capacitors, such as 2031 and 2033 from control matrix 2000 of FIG. 6. Control matrix 2300 does not include a charge trigger interconnect (such as charge trigger interconnect 1608 of FIG. 5A).

In a wiring similar to control matrix 2200, the transistors Q16, Q18, Q20, and Q22 are cross connected and operate as a flip flop. The sources of both transistors Q16 and Q20 are connected directly to charge interconnect 2310, which is held at a DC potential equal to the actuation voltage $V_{at}$, e.g. at 40 volts. The sources of both transistors Q18 and Q22 are connected to the global actuation interconnect 2314. The cross coupling of transistors Q16, Q18, Q20, and Q22 ensures that there are only two stable states—in which only one of the actuators in shutter assembly 2304 is held at the actuation voltage $V_{at}$, while the other actuator (after global actuation) is held at a voltage near to zero. By contrast to the operation of control matrices 1600, 1640, or 2000, the control matrix 2300 does not require a distinct charging sequence or any variation or pulsing of the voltage from charge interconnect 2310.

As was the case in control matrix 2200 of FIG. 8, the flip-flop switching circuit can be recognized as the cross coupling of two inverters, namely a shutter open inverter (transistors Q16 and Q18) and a shutter close inverter (transistors Q20 and Q22).

In either of its stable states, the flip-flop circuit formed by transistors Q16, Q18, Q20, and Q22 is associated with substantially zero DC current flow, and therefore forms a low power voltage switching circuit. This is achieved because of the use of complementary (CMOS) transistor types.

The flip-flop operation of control matrix 2300 allows for a constant voltage actuation of the shutter assembly 2304, without the need for voltage stabilizing capacitors, such as capacitor 2031 or 2033 in control matrix 2000 of FIG. 6. This is because one of the charging transistors Q16 or Q20 remains on throughout the actuation event, allowing the corresponding actuator to maintain a low impedance connection to the DC supply of the interconnect 2210 throughout the actuation event.

At the beginning of each frame addressing cycle the control matrix 2300 applies a write enable voltage to each scan-line interconnect 2306 in sequence. While a particular row of pixels 2302 is write-enabled, the control matrix 2300 applies a data voltage to the data interconnect 2308. The application of $V_{we}$ to the scan-line interconnect 2306 for the write-enabled row turns on the write-enable transistor Q17 of the pixels 2302 in the corresponding scan line. The voltages applied to the data interconnect 2308 is thereby caused to be stored on the data store capacitor 2319 of the respective pixels 2302.

The functions of the inverters with transistors Q31 through Q41 will now be explained. The level shifting inverter 2332 outputs a voltage $V_{dd}$ (derived from supply interconnect 2334), e.g. 8 volts, which is provisionally supplied to the input of the transition sharpening inverter 2336, depending on the voltage state of capacitor C19. The transition-sharpening inverter 2336 outputs the inverse or complement of its input from the voltage leveling inverter 2332, and supplies that complement voltage to both the switching inverter 2340, as well as to the gate of transistor Q22. (By complement we mean that if the output of the voltage leveling inverter is $V_{dd}$, then the output of the transition sharpening inverter will be near to zero, and vice versa.) The output of the switching inverter 2340 supplies a voltage to the gate of transistor Q18, which is again the complement of the voltage supplied from the transition-sharpening inverter 2336.

In a manner similar to the function of transistors 2135 and 2137 from control matrix 2100 of FIG. 7, the switching inverter 2340 ensures that only one of the discharge transistors Q18 or Q22 can be on at any one time, thereby ensuring proper actuation of shutter assembly 2304. The presence of the switching inverter 2340 obviates the need for a separate shutter-close data interconnect.

The level shifting inverter 2332 requires only a low voltage input (e.g. 3 volts) and outputs a complement which is shifted to the higher voltage of $V_{dd}$ (e.g. 8 volts). For instance, if the voltage on capacitor C19 is 3 volts, then the output voltage from inverter 2332 will be close to zero, while if the voltage on capacitor C19 is close to zero, then the output from the inverter 2332 will be at $V_{dd}$ (e.g. 8 volts). The presence of the level shifting inverter, therefore, provides several advantages. A higher voltage (e.g. 8 volts) is supplied as a switch voltage to discharge transistors Q18 and Q22. But the 8 volts required for such switching is derived from a power supply, interconnect 2334, which is a DC supply and which only needs to provide enough current to charge the gate capacitance on various transistors in the pixel. The power required to drive the supply interconnect 2334 will, therefore, be only a minor contributor to the power required to drive shutter assembly 2304. At the same time the data voltage, supplied by data interconnect 2308 and stored on capacitor C19, can be less than 5 volts (e.g. 3 volts) and the power associated with AC voltage variations on interconnect 2308 will be substantially reduced.

The transition-sharpening inverter 2336 helps to reduce the switching time or latency between voltage states as output to the discharge transistor Q22 and to the switching inverter 2340. Any reduction in switching time on the inputs to the CMOS switching circuit (Q16 through Q22) helps to reduce the transient switching currents experienced by that circuit.

The combination of the CMOS switching circuit, with transistors Q16 through Q22, the CMOS switching inverter 2340, and the CMOS level shifting inverter 2332 makes the control matrix 2300 an attractive low power method for driving an array of shutter assemblies 2304. Reliable actuation of even dual-actuator shutter assemblies, such as shutter assembly 2304, is achieved with the use of only a single storage capacitor, C19, in each pixel.

In control matrix 2300 the global actuation interconnect 2314 is connected to the source of transistors Q31, Q35, Q39, Q18, and Q22. Maintaining the global actuation interconnect 2314 at a potential significantly above that of the shutter common interconnect 2315 prevents the turn-on of any of the transistors Q31, Q35, Q39, Q18, and Q22, regardless of what charge is stored on the capacitor C19. Global actuation in control matrix 2300 is achieved by bringing the potential on the global actuation interconnect 2314 to substantially the same potential as the shutter common interconnect 2315. During the time that the global actuation is so activated, all of the transistors Q31, Q35, Q39, Q18, and Q22 have the opportunity to change their state, depending on what data voltage has been stored on capacitor C19.

The voltage supplied by supply interconnect 2334, $V_{dd}$, is not necessarily the same as the actuation voltage $V_{at}$, as supplied by the charge interconnect 2310. Therefore, some optional specifications on transistors Q16 through Q22 can help to reduce the transient switching currents in control matrix 2300. For instance it may be preferable to increase the width to length ratio in the discharge transistors Q18 and Q22 as compared to the charge transistors Q16 and Q20. The ratio of width to length for the discharge transistors may vary between 1 and 10 while the ratio of length to width for the charge transistors may vary between 0.1 and 1. Similarly the width to length ratio between level shifting transistors Q31 and Q33 should be similarly differentiated. For instance, the ratio of width to length for transistor Q31 may vary between 1 and 10 while the ratio of width to length for transistor Q33 may vary between 0.1 and 1.

In operation, in order to periodically reverse the polarity of voltages supplied to the shutter assembly 2304, the control matrix 2300 alternates between two control logics as described in relation to method 1670 of FIG. 5C.

Alternative embodiments to control matrix 2300 are also possible. For instance, the level shifting inverters 2332 and the transition sharpening inverter 2336 can be removed from the circuit as long as the voltage supplied by the data interconnect 2308 is high enough to switch the flip-flop circuit reliably. As this required switching voltage may be as high as 8 volts, the power dissipation for such a simplified circuit is expected to increase by comparison to control matrix 2300. The simplified circuit would, however, require less real estate and could therefore be packed to higher pixel densities.

In another alternative to control matrix 2300, the precharge circuit from control matrices 2000 and 2100 of FIGS. 6 and 7, respectively, can be substituted into control matrix 2300, in place of transistors Q16, Q18, Q20, and Q22. For such a control matrix the transition sharpening inverter 2336 would no longer be necessary. To the extent that both pMOS and nMOS remain available to this CMOS circuit, both types of transistors would still be beneficial in the level shifting inverter 2332 and in the switching inverter 2340. This circuit would thereby exhibit power dissipation advantages by comparison to control matrix 2100 of FIG. 7.

Figure 10:
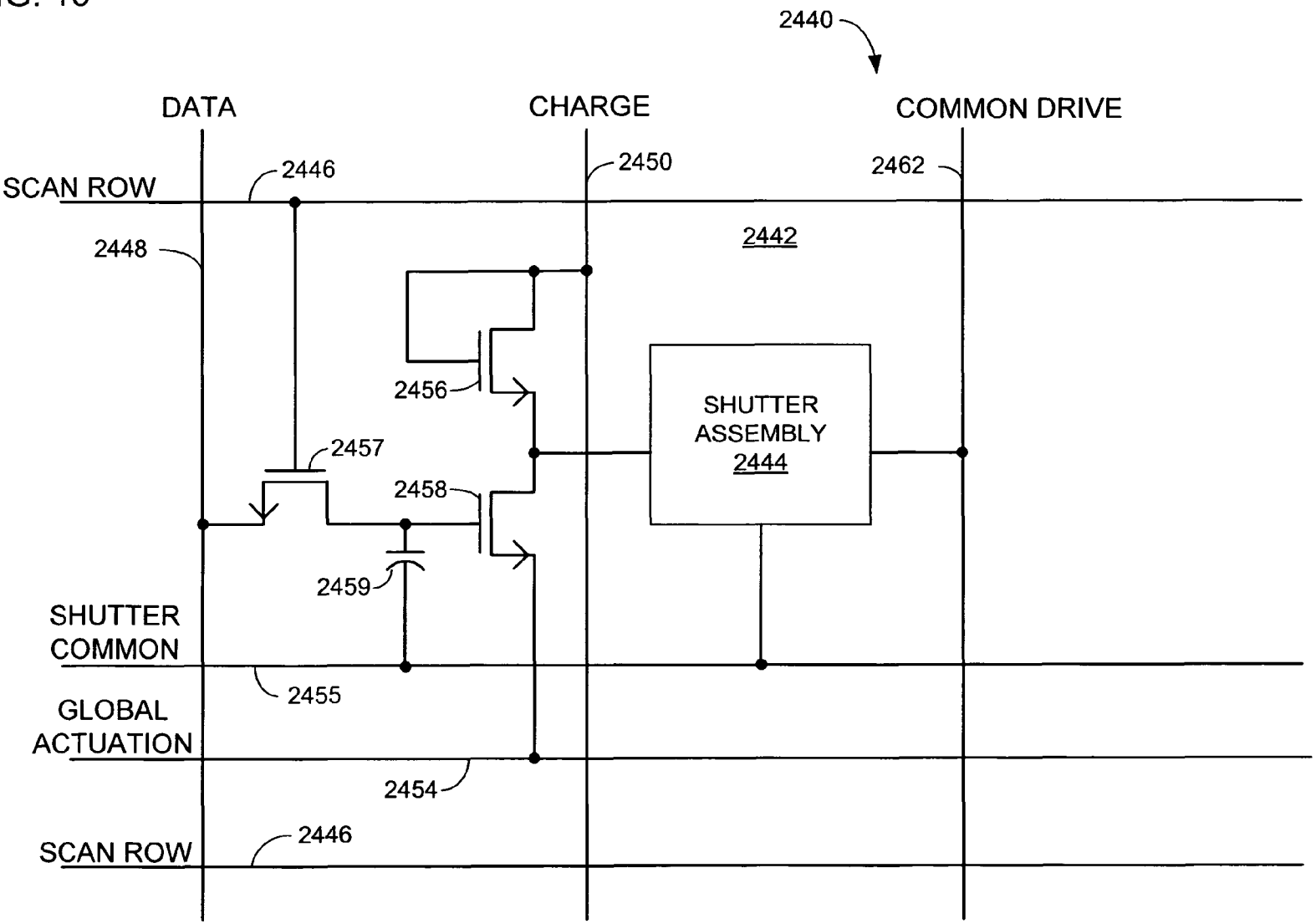
FIG. 10 is a diagram of an control matrix suitable for controlling the shutter assemblies of the display apparatus of FIG. 1A, according to an illustrative embodiment of the invention.

FIG. 10 is yet another suitable control matrix 2440 for inclusion in the display apparatus 100, according to an illustrative embodiment of the invention. Control matrix 2440 controls an array of pixels 2442 that include dual-actuator shutter assemblies 2444 (i.e., shutter assemblies with both shutter-open and shutter-close actuators). The actuators in the shutter assemblies 2444 can be made either electrically bi-stable or mechanically bi-stable.

Control matrix 2440 is substantially the same as control matrix 1640 of FIG. 5B, except for three changes. A dual-actuator shutter assembly 2444 is utilized instead of the elastic shutter assembly 1644, a new common drive interconnect 2462 is added, and there is no voltage stabilizing capacitor, such as capacitor 1652, in control matrix 2440. For the example given in control matrix 2440, the common drive interconnect 2462 is electrically connected to the shutter-open actuator of the shutter assembly 2444.

Despite the presence of a dual-actuator shutter assembly 2444, the control matrix 2440 includes only a single data interconnect 2448 for each column of pixels 2442 in the control matrix. The actuators in the shutter assemblies 2444 can be made either electrically bi-stable or mechanically bi-stable.

The control matrix 2440 includes a scan-line interconnect 2446 for each row of pixels 2442 in the control matrix 2440. The control matrix 2440 further includes a charge interconnect 2450, a global actuation interconnect 2454, and a shutter common interconnect 2455. The interconnects 2450, 2454, 2455, and 2462 are shared among pixels 2442 in multiple rows and multiple columns in the array. In one implementation (the one described in more detail below), the interconnects 2450, 2454, 2455, and 2462 are shared among all pixels 2442 in the control matrix 2440.

Each pixel 2442 in the control matrix includes a shutter charge transistor 2456, a shutter discharge transistor 2458, a shutter write-enable transistor 2457, and a data store capacitor 2459 as described in FIG. 5A. For the example given in control matrix 2440 the drain of the shutter discharge transistor is connected to the shutter-close actuator of the shutter assembly 2444.

By comparison to control matrix 1600 of FIG. 5A, the charging transistor 2456 is wired with a different circuit connection to the charge interconnect 2450. Control matrix 2440 does not include a charge trigger interconnect which is shared among pixels. Instead, the gate terminals of the charging transistor 2456 are connected directly to the charge interconnect 2450, along with the drain terminal of transistor 2456. In operation, the charging transistors operate essentially as diodes, i.e., they can pass a current in only 1 direction.

Figure 11:
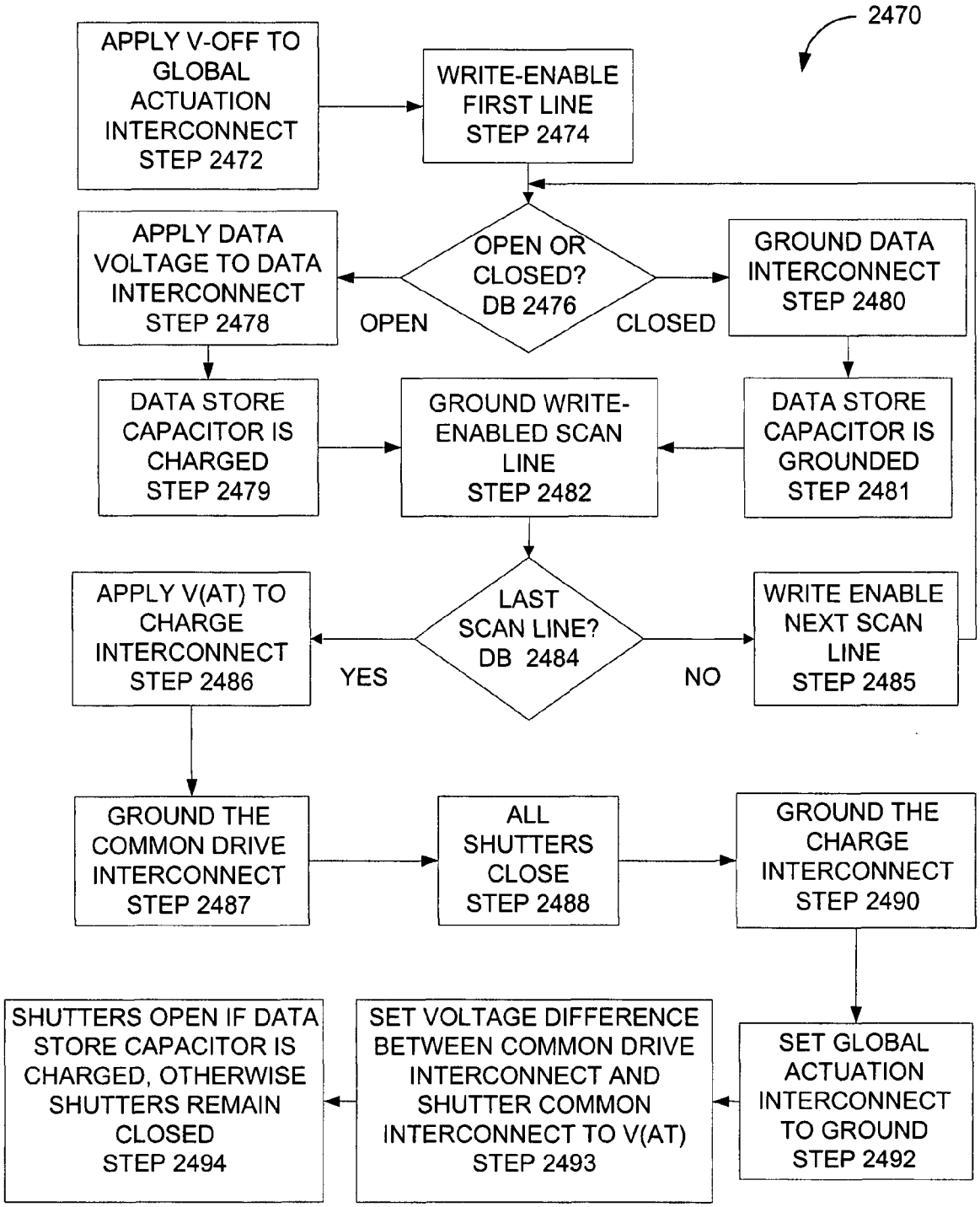
FIG. 11 is a flow chart of a method of addressing the pixels of the control matrix of FIG. 10, according to an illustrative embodiment of the invention.

A method of addressing and actuating the pixels in control matrix 2440 is illustrated by the method 2470 shown in FIG. 11. The method 2470 proceeds in three general steps. First the matrix is addressed row by row by storing data into the data store capacitors 2459. Next all actuators are actuated (or reset) simultaneously (step 2488) in part by applying a voltage $V_{at}$ to the charge interconnect 2450. And finally the image is set in steps 2492-2494 by a) selectively activating transistors 2458 by means of the global actuation interconnect 2454 and b) changing the potential difference between the common drive interconnect 2462 and the shutter common interconnect 2455 so as to be greater than an actuation voltage $V_{at}$.

In operation, in order to periodically reverse the polarity of voltages across shutter assemblies 2442, a control matrix advantageously alternates between two control logics. For reasons of clarity, the details for control method 2470 are described next with respect to only the first control logic. In this first control logic the potential of the shutter common interconnect 2455 is maintained at all times near to the ground potential. A shutter will be held in either the open or closed states by applying a voltage $V_{at}$ directly across either or both of the charge interconnect 2450 or the common drive interconnect 2462. (In the second control logic, to be described after we complete the discussion of FIG. 11, the shutter common interconnect is held at the voltage $V_{at}$, and an actuated state will be maintained by maintaining either or both of the charge interconnect 2450 or the common drive interconnect 2462 at ground.)

More specifically for the first control logic of method 2470, the frame addressing cycle of method 2470 begins when a voltage $V_{off}$ is applied to the global actuation interconnect 2454 (step 2472). The voltage $V_{off}$ on interconnect 2454 is designed to ensure that the discharge transistor 2458 will not turn on regardless of whether a voltage has been stored on capacitor 2459.

The control matrix 2440 then proceeds with the addressing of each pixel 2442 in the control matrix, one row at a time (steps 2474-2484). To address a particular row, the control matrix 2440 write-enables a first scan line by applying a voltage $V_{we}$ to the corresponding scan-line interconnect 2446 (step 2474). Then, at decision block 2476, the control matrix 2440 determines for each pixel 2442 in the write-enabled row whether the pixel 2442 needs to be open or closed. For example, if at the reset step 2488 all shutters are to be (temporarily) closed, then at decision block 2476 it is determined for each pixel 2442 in the write-enabled row whether or not the pixel is to be (subsequently) opened. If a pixel 2442 is to be opened, the control matrix 2440 applies a data voltage $V_d$, for example 5V, to the data interconnect 2448 corresponding to the column in which that pixel 2442 is located (step 2478). The voltage $V_d$ applied to the data interconnect 2448 is thereby caused to be stored by means of a charge on the data store capacitor 2459 of the selected pixel 2442 (step 2479). If at decision block 2476, it is determined that a pixel 2442 is to be closed, the corresponding data interconnect 2448 is grounded (step 2480). Although the temporary (or reset) position after step 2488 in this example is defined as the shutter-close position, alternative shutter assemblies can be provided in which the reset position after 2488 is a shutter-open position. In these alternative cases, the application of data voltage $V_d$, at step 2478, would result in the opening of the shutter.

The application of $V_{we}$ to the scan-line interconnect 2446 for the write-enabled row turns on all of the write-enable transistors 2457 for the pixels 2442 in the corresponding scan line. The control matrix 2440 selectively applies the data voltage to all columns of a given row in the control matrix 2440 at the same time while that row has been write-enabled. After all data has been stored on capacitors 2459 in the selected row (steps 2479 and 2481), the control matrix 2440 grounds the selected scan-line interconnect (step 2482) and selects a subsequent scan-line interconnect for writing (step 2485). After the information has been stored in the capacitors for all the rows in control matrix 2440, the decision block 2484 is triggered to begin the global actuation sequence.

The actuation sequence begins at step 2486 of method 2470, with the application of an actuation voltage $V_{at}$, e.g. 40 V, to the charge interconnect 2450. As a consequence of step 2486, the voltage $V_{at}$ is now imposed simultaneously across all of the shutter-close actuators of all the shutter assemblies 2444 in control matrix 2440. Next, at step 2487, the potential on the common drive interconnect 2462 is grounded. In this first control logic (with the shutter common potential 2455 held near to ground) a grounded common drive interconnect 2462 reduces the voltage drop across all of the shutter-open actuators of all shutter assemblies 2444 to a value substantially below the maintenance voltage $V_m$. The control matrix 2440 then continues to maintain these actuator voltages (from steps 2486 and 2487) for a period of time sufficient for all actuators to actuate (step 2488). For the example given in method 2470, step 2488 acts to reset and close all actuators into an initial state. Alternatives to the method 2470 are possible, however, in which the reset step 2488 acts to open all shutters. For this case the common drive interconnect 2462 would be electrically connected to the shutter-closed actuator of all shutter assemblies 2444.

At the next step 2490 the control matrix grounds the charge interconnect 2450. The electrodes on the shutter-close actuators in shutter assembly 2444 provide a capacitance which stores a charge after the charge interconnect 2450 has been grounded and the charging transistor 2456 has been turned off. The stored charge acts to maintain a voltage in excess of the maintenance voltage $V_m$ across the shutter-close actuator.

After all actuators have been actuated and held in their closed position by a voltage in excess of $V_m$, the data stored in capacitors 2459 can now be utilized to set an image in control matrix 2440 by selectively opening the specified shutter assemblies (steps 2492-2494). First, the potential on the global actuation interconnect 2454 is set to ground (step 2492). Step 2492 makes it possible for the discharge switch transistor 2458 to turn-on in accordance to whether a data voltage has been stored on capacitor 2459. For those pixels in which a voltage has been stored on capacitor 2459, the charge which was stored on the shutter-close actuator of shutter assembly 2444 is now allowed to dissipate through the global actuation interconnect 2454.

Next, at step 2493, the voltage on the common drive interconnect 2462 is returned to the actuation voltage $V_{at}$, or is set such that the potential difference between the common drive interconnect 2462 and the shutter common interconnect 2455 is greater than an actuation voltage $V_{at}$. The conditions for selective actuation of the pixels have now been set. For those pixels in which a charge (or voltage $V_d$) has been stored on capacitor 2459, the voltage difference across the shutter-close actuator will now be less than the maintenance voltage $V_m$ while the voltage across the shutter-open actuator (which is tied to the common drive 2462) will at $V_{at}$. These selected shutters will now be caused to open at step 2494. For those pixels in which no charge has been stored on capacitor 2459, the transistor 2458 remains off and the voltage difference across the shutter-close actuator will be maintained above the maintenance voltage $V_m$. Even though a voltage $V_{at}$ has been imposed across the shutter-open actuator, the shutter assembly 2444 will not actuate at step 2494 and will remain closed. The control matrix 2440 continues to maintain the voltages set after steps 2492 and 2493 for a period of time sufficient for all selected actuators to actuate during step 2494. After step 2494, each shutter is in its addressed state, i.e., the position dictated by the data voltages applied during the addressing and actuating method 2470.

To set an image in a subsequent video frame, the process begins again at step 2472.

In alternate embodiments, the positions of the steps 2486 and 2487 in the sequence can be switched, so that step 2487 occurs before step 2486.

In the method 2470, all of the shutters are closed simultaneously during the time between step 2488 and step 2494, a time in which no image information can be presented to the viewer. The method 2470, however, is designed to minimize this dead time (or reset time), by making use of data store capacitors 2459 and global actuation interconnect 2454 to provide timing control over the transistors 2458. By the action of step 2472, all of the data for a given image frame can be written to the capacitors 2459 during the addressing sequence (steps 2474-2485), without any immediate actuation effect on the shutter assemblies. The shutter assemblies 2444 remain locked in the positions they were assigned in the previous image frame until addressing is complete and they are uniformly actuated or reset at step 2488. The global actuation step 2492 allows the simultaneous transfer of data out of the data store capacitors 2459 so that all shutter assemblies can be brought into their next image state at the same time.

As with the previously described control matrices, the activity of an attached backlight can be synchronized with the addressing of each frame. To take advantage of the minimal dead time offered in the addressing sequence of method 2470, a command to turn the illumination off can be given between step 2484 and step 2486. The illumination can then be turned-on again after step 2494. In a field-sequential color scheme, a lamp with one color can be turned off after step 2484 while a lamp with either the same or a different color is turned on after step 2494.

In other implementations, it is possible to apply the method 2470 of FIG. 11 to a selected portion of the whole array of pixels, since it may be advantageous to update different areas or groupings of rows and columns in series. In this case a number of different charge interconnects 2450, global actuation interconnects 2454, and common drive interconnects 2462 could be routed to selected portions of the array for selectively updating and actuating different portions of the array.

As described above, to address the pixels 2442 in the control matrix 2440, the data voltage $V_d$ can be significantly less than the actuation voltage $V_{at}$ (e.g., 5V vs. 40V). Since the actuation voltage $V_{at}$ is applied once a frame, whereas the data voltage $V_d$ may be applied to each data interconnect 2448 as may times per frame as there are rows in the control matrix 2440, control matrices such as control matrix 2440 may save a substantial amount of power in comparison to control matrices which require a data voltage to be high enough to also serve as the actuation voltage.

It will be understood that the embodiment of FIG. 10 assumes the use of n-channel MOS transistors. Other embodiments are possible that employ p-channel transistors, in which case the relative signs of the bias potentials $V_{at}$ and $V_d$ would be reversed. In alternative implementations, the storage capacitor 2459 and write-enable transistor 2457 can be replaced with alternative data memory circuits, such as a DRAM or SRAM circuits known in the art. In alternate implementations, semiconductor diodes and/or metal insulator metal sandwich type thin films can be substituted as switches in place of transistors in control matrix 2440. Examples of these substitutions are described in U.S. patent application Ser. No. 11/326,696.

As stated above, it is advantageous to periodically or occasionally reverse the sign of the voltages that appear across the actuators of shutter assembly 2442. U.S. patent application Ser. No. 11/326,696 describes the use of two control logics to provide a periodic polarity reversal and ensure 0V DC average operation. To achieve polarity reversal in the second control logic several of the voltage assignments illustrated and described with respect to method 2470 of FIG. 11 are changed, although the sequencing of the control steps remains the same.

In the second control logic, the potential on the shutter common interconnect 2455 is maintained at a voltage near to $V_{at}$ (instead of near ground as was the case in the first control logic). In the second control logic, at step 2478, where the logic is set for the opening of a shutter assembly, the data interconnect 2448 is grounded instead of taken to $V_d$. At step 2480, where the logic is set for the closing of a shutter assembly, the data interconnect is taken to the voltage $V_d$. Step 2486 remains the same, but at step 2487 the common drive interconnect is set to the actuation voltage $V_{at}$ in the second control logic instead of to ground. At the end of step 2487 in the second control logic, therefore, each of the shutter common interconnect 2455, the common drive interconnect 2462, and the charge interconnect 2450 are set to the same voltage $V_{at}$. The image setting sequence then continues with grounding of the global actuation interconnect 2454 at step 2492—which has the effect in this second logic of closing only those shutters for which a voltage $V_d$ was stored across the capacitor 2459. At step 2493 in the second control logic the common drive interconnect 2462 is grounded. This has the effect of actuating and opening any shutters that were not otherwise actuated at step 2492. The logical state expressed at step 2494, therefore, is reversed in the second control logic, and the polarities are also effectively reversed.

The control matrix 2440 can alternate between the control logics between every frame or between alternate sub-frame images or on some other periodic basis, for instance once every second. Over time, the net potentials applied to the shutter assemblies 2444 by the charge interconnect 2450 and the shutter common interconnect 2455 average out to 0V.

Figure 12:
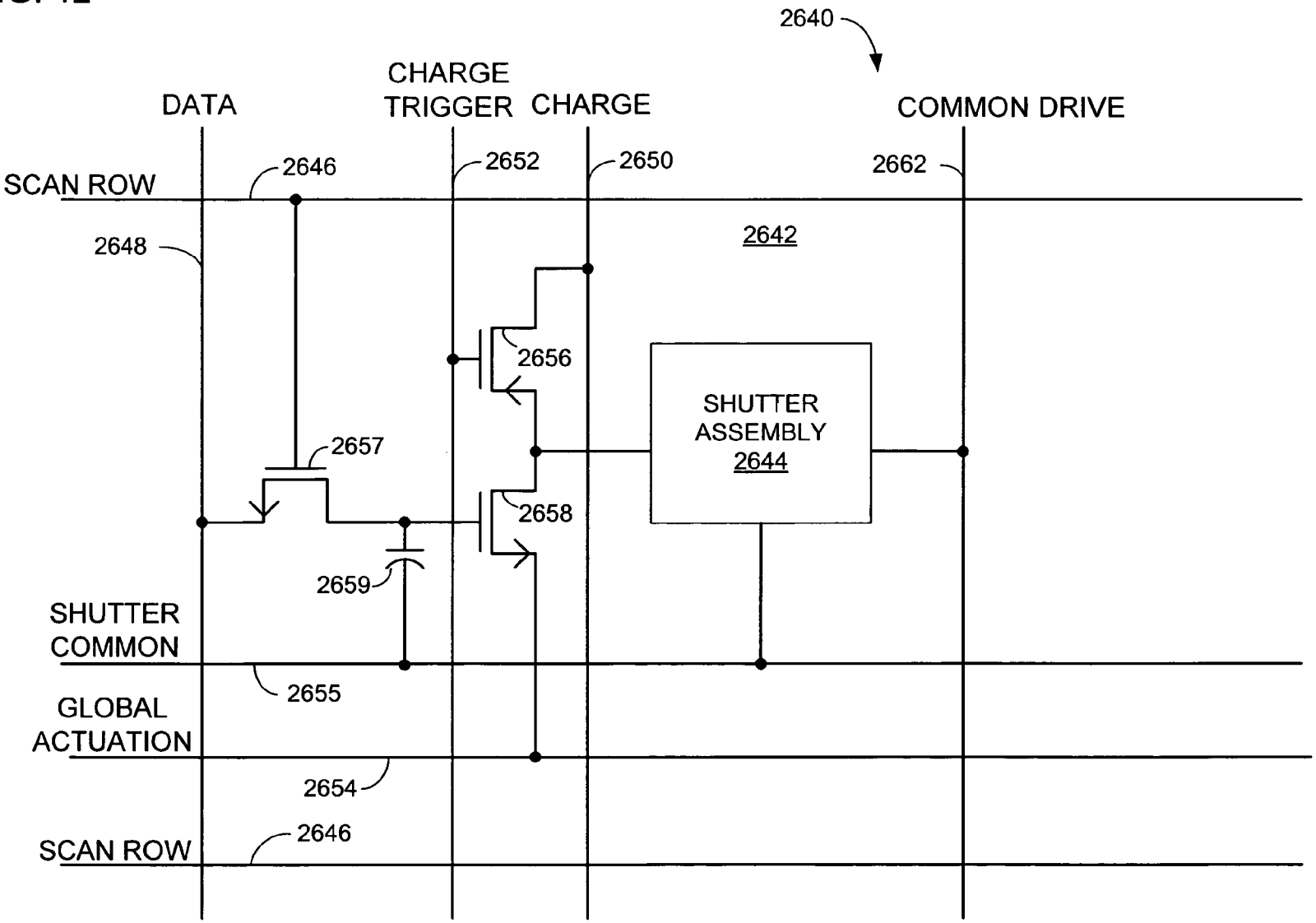
FIG. 12 is a schematic diagram of yet another suitable control matrix for inclusion in the display apparatus, according to an illustrative embodiment of the invention.

FIG. 12 is a schematic diagram of yet another suitable control matrix 2640 for inclusion in the display apparatus 100, according to an illustrative embodiment of the invention. Control matrix 2640 controls an array of pixels 2642 that include dual-actuator shutter assemblies 2644 (i.e., shutter assemblies with both shutter-open and shutter-close actuators). The actuators in the shutter assemblies 2004 can be made either electrically bi-stable or mechanically bi-stable.

Control matrix 2640 is substantially the same as control matrix 2440, with two changes: a charge trigger interconnect 2652 has been added and a pMOS transistor has been substituted for the charging transistor 2656 instead of the nMOS transistor as was indicated at 2456.

The control matrix 2640 utilizes a dual-actuator shutter assembly 2644 along with a common drive interconnect 2662. For the example given in control matrix 2640 the common drive interconnect 2662 is electrically connected to the shutter-open actuator of the shutter assembly 2644. Despite the presence of a dual-actuator shutter assembly 2644, the control matrix 2640 includes only a single data interconnect 2648 for each column of pixels 2642 in the control matrix.

The control matrix 2640 includes a scan-line interconnect 2646 for each row of pixels 2642 in the control matrix 2640. The control matrix 2640 further includes a charge interconnect 2650, a charge trigger interconnect 2652, a global actuation interconnect 2654, and a shutter common interconnect 2655. The interconnects 2650, 2654, 2655, and 2662 are shared among pixels 2642 in multiple rows and multiple columns in the array. In one implementation (the one described in more detail below), the interconnects 2650, 2654, 2655, and 2662 are shared among all pixels 2642 in the control matrix 2640.

Each pixel 2642 in the control matrix includes a shutter charge transistor 2656, a shutter discharge transistor 2658, a shutter write-enable transistor 2657, and a data store capacitor 2659 as described in FIG. 5A. For the example given in control matrix 2644 the drain of the shutter discharge transistor is connected to the shutter-close actuator of the shutter assembly 2644.

The control matrix 2640 makes use of two complementary types of transistors: both p-channel and n-channel transistors. It is therefore referred to as a complementary MOS control matrix or a CMOS control matrix. While the charging transistor 2656 is made of the pMOS type, the discharge transistor 2658 is made of the nMOS type of transistor. (In other implementations the types of transistors can be reversed, for example nMOS transistors can be used for the charging transistors and pMOS transistors can be used for the discharge transistors.) The use of a charge trigger interconnect along with the CMOS circuit helps to reduce the set of voltage variations required to achieve shutter actuation.

With the use of the charge trigger interconnect 2652, the control circuit 2640 is wired to the charging transistor 2656 in a fashion similar to that of control matrix 1600. Only the source of pMOS transistor 2656 is connected to the charge interconnect 2650 while the gate is connected to the charge trigger interconnect 2652. Throughout operation, the charge interconnect 2650 is maintained at a constant voltage equal to the actuation voltage $V_{at}$. The charge trigger interconnect 2652 is maintained at the same voltage ($V_{at}$) as that of the charge interconnect whenever the charge transistor 2656 is to be held in the off state. In order to turn-on the charge transistor 2656, the voltage on the charge trigger interconnect 2652 is reduced so that the voltage difference between charge interconnect 2650 and interconnect 2652 is greater than the threshold voltage of the transistor 2656. Threshold voltages can vary in a range from 2 to 8 volts. In one implementation where the transistor 2656 is a pMOS transistor, both the charge interconnect 2650 and the charge trigger interconnect 2652 are held at a $V_{at}$ of 40 volts when the transistor 2656 is off. In order to turn transistor 2656 on, the voltage on the charge interconnect 2650 would remain at 40 volts while the voltage on the charge trigger interconnect 2652 is temporarily reduced to 35 volts. (If an nMOS transistor were to be used at the point of transistor 2656, then the $V_{at}$ would be −40 volts and a charge trigger voltage of −35 volts would be sufficient to turn the transistor on.)

A method for addressing and actuating pixels in control matrix 2640 is similar to that of method 2470, with the following changes. At step 2486 the voltage on the charge trigger interconnect is reduced from $V_{at}$ to $V_{at}$ minus a threshold voltage. Similar to the operation of method 2470 all of the shutter-closed actuators then become charged at the same time, and at step 2488 all shutters will close while a constant voltage $V_{at}$ is maintained across the shutter close actuator. In another modification to the method 2470, at step 2490, the charge interconnect 2650 is allowed to remain at $V_{at}$ while the transistor 2656 is turned off by returning the voltage on the charge trigger interconnect 2652 to $V_{at}$. After the transistor 2656 is turned off, the actuation procedure proceeds to the global actuation step 2492.

The actuator charging process at step 2486 in method 2470 can be accomplished as described above for control matrix 2640 with nearly zero voltage change on the charge interconnect 2650 and only a minimal (threshold voltage) change required for the charge trigger interconnect 2652. Therefore the energy required to repeatedly change the voltage from Vat to ground and back is saved in this control matrix. The power required to drive each actuation cycle is considerably reduced in control matrix 2640 as compared to control matrix 2440.

In a similar fashion, the use of complementary nMOS and pMOS transistor types can be applied to the charging transistors in control matrices 1600, 1640, 2000, 2100, 2700 to reduce the power required for actuation.

Figure 13:
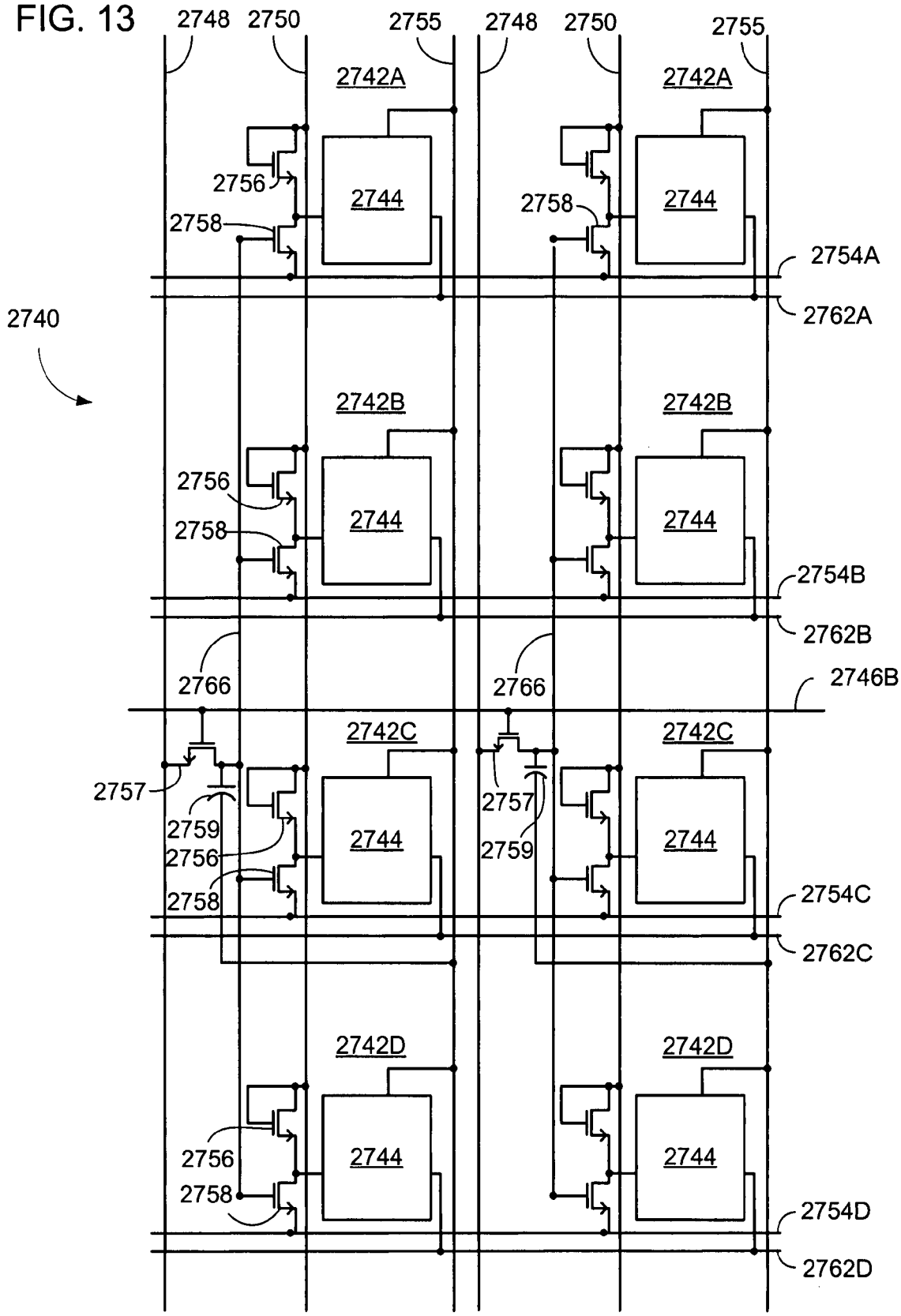
FIG. 13 is a schematic diagram of another control matrix suitable for inclusion in the display apparatus, according to an illustrative embodiment of the invention.

FIG. 13 is a schematic diagram of another control matrix 2740 suitable for inclusion in the display apparatus 100, according to an illustrative embodiment of the invention. Control matrix 2740 operates in a manner substantially similar to that of control matrix 2440, except that some of the circuit elements are now shared between multiple shutter assemblies in the array of shutter assemblies. In addition several of the common interconnects are wired into separate groups or banks, such that each of these common interconnects are shared only amongst the pixels of their particular group.

The control matrix 2740 includes an array of dual-actuator shutter assemblies 2744. Similar to the control matrix 2440, however, the control matrix 2740 includes only a single data interconnect 2748 for each column of pixels 2742 in the control matrix. The actuators in the shutter assemblies 2744 can be made either electrically bi-stable or mechanically bi-stable.

The control matrix 2740 includes one scan-line interconnect 2746 which is shared amongst four consecutive rows of pixels 2742 in the array of pixels. Each pixel in the array is also connected to a global actuation interconnect, a common drive interconnect, a charge interconnect, and a shutter common interconnect. For the embodiment illustrated in FIG. 13, however, the pixels are identified as members of four separate groups or banks which are connected in common only to certain interconnects within their particular group. The pixels 2742A, for instance, are aligned along the first row and are members of the first group in control matrix 2740. Each pixel in the group of pixels that include pixels 2742A is connected to a global actuation interconnect 2754A and a common drive interconnect 2762A. The pixels 2742B are aligned along the second row and are members of the second group in control matrix 2740. Each pixel in the group of pixels 2742B is connected to a global actuation interconnect 2754B and a common drive interconnect 2762B. Similarly the pixels 2742C in the third row are members of the third group of pixels which are connected in common to global actuation interconnect 2754C and common drive interconnect 2762C. Similarly the pixels 2742D in the third row are members of the third group of pixels which are connected in common to global actuation interconnect 2754D and common drive interconnect 2762D. The sequential pattern of rows including pixels 2742A, 2742B, 2742C, and 2742D is repeated for rows that continue both above and below the pixels illustrated in FIG. 13. Each group of four rows includes a single scan line interconnect 2746 which is shared between the four rows.

The global actuation interconnects 2754A, 2754B, 2754C, and 2754D are electrically independent of each other. A global actuation signal applied to the interconnect 2754A may actuate all pixels 2742A within that row of the array, as well as all pixels in similarly connected rows (that occur in every fourth row of the array). A global actuation signal applied to the interconnect 2754A, however, will not actuate any of the pixels in the other groups, e.g. it will not actuate the pixels 2742B, 2742C, or 2742D. In a similar fashion the common drive interconnects 2762A, 2762B, 2762C, and 2762D are electrically independent, connecting to all pixels within their particular group but not to any pixels outside of their group.

The control matrix 2740 further includes a charge interconnect 2750 and a shutter common interconnect 2755. The interconnects 2750 and 2755 are shared among pixels 2742 in multiple rows and multiple columns in the array. In one implementation (the one described FIG. 13), the interconnects 2750 and 2755 are shared among all pixels 2742 in the control matrix 2740.

Each pixel 2742 in the control matrix includes a shutter charge transistor 2756 and a shutter discharge transistor 2758. As described in FIGS. 5A and FIG. 10 the charge transistor 2756 is connected between the charge interconnect 2750 and the shutter-closed actuator of shutter assemblies 2744 in each pixel. The shutter discharge transistor 2758 is connected between the shutter assembly 2744 and the particular global actuation interconnect 2754A, 2754B, 2754C, or 2754D assigned to its group. For the example given in control matrix 2740 the common drive interconnects 2762A, 2762B, 2762C, and 2762D are electrically connected to the shutter-open actuators of the shutter assemblies 2744 within their particular groups.

Near to the intersection of each data interconnect 2748 and each scan line interconnect 2746 is a write-enable transistor 2757, and a data store capacitor 2759. The transistors 2757 and capacitor 2759 appear in each column but, like the scan line interconnect 2746, they appear only once in every four rows. The function of these circuit elements is shared between the pixels in each of the four adjacent rows. A fan-out interconnect 2766 is used to connect the charge stored on the capacitor 2759 to the gates on each of the shutter discharge transistors 2758 within the column for the four adjacent rows.

The operation of shutter assemblies 2744 is very similar to that described for control matrix 2440 in method 2470. The difference is that, for control matrix 2740, the addressing and actuating of the pixels is carried out independently and during separate time intervals for each of the four pixel banks 2742A, 2742B, 2742C, and 2742D. For the embodiment of FIG. 13 the addressing for the pixels in group 2742A would proceed by applying Voff to the global actuation interconnect 2754A and applying a write-enable voltage to each of the scan line interconnects 2746 in turn. During the time that a scan line is write-enabled the data corresponding to each of the pixels of group A assigned to a particular scan line is loaded into the capacitor 2759 by means of the data interconnect 2748 in each column. After the addressing of the scan lines in the whole array is complete, the control matrix then proceeds to an actuation sequence as described from step 2486 to step 2494 in the method 2470. Except, for control matrix 2740, the data is loaded for only one group of pixels at a time (e.g. the pixels 2742A in group A) and the actuation proceeds by activating only the global actuation interconnect (2754A) and the common drive interconnect (2762A) for that particular group of pixels.

After actuation of pixels 2742A is complete, the control matrix proceeds with the loading of data into the second group of pixels, e.g. 2742B. The addressing of the second group of pixels (group B) proceeds by use of the same set of scan line interconnects 2746, data interconnects 2748, and data store capacitors 2759 as were employed for group A. The data stored in capacitors 2759 will only affect the actuation of the pixels 2742B in group B, however, since this data can only be transferred to the shutter assemblies of their particular group after actuation by means of the global actuation interconnect for the group, 2754B. The selective actuation of each the four pixel groups is accomplished by means of the independent global actuation interconnects 2754A, 2754B, 2754C, or 2754D and independent common drive interconnects 2762A, 2762B, 2762C, or 2762D.

In order to address and actuate all pixels in the array it is necessary to address and actuate the pixels in each of the four pixel groups 2742A, 2742B, 2742C, and 2742D sequentially. Considerable space savings, however, is accomplished in the array since the write enable transistors 2757 and the data store capacitors 2759 only need to be fabricated once for each adjacent set of four rows.

For the embodiment given in FIG. 13 the pixels in the array have been broken into four groups A, B, C, and D. Other embodiments are possible, however, in which the array can be broken into only 2 groups, into 3 groups, into 6 groups, or into 8 groups. In all of these cases the pixels of a group are connected in common to their own particular global actuation interconnect and common drive interconnect. For the case of 2 groups the scan line interconnect, the write-enable transistor, and the data store capacitor would appear in every other row. For the case of 6 groups the scan line interconnect, the write-enable transistor, and the data store capacitor would appear in every sixth row.

For the embodiment given in FIG. 13 the charge interconnect 2750 and shutter common interconnect 2755 are shared among pixels 2742 in multiple rows and multiple columns in the array. In other embodiments the charge interconnects and shutter common interconnects can also be assigned and shared only among particular groups, such as groups A, B, C, and D.

It will be understood that the embodiment of FIG. 13 assumes the use of n-channel MOS transistors. Other embodiments are possible that employ p-channel transistors, in which case the relative signs of the bias potentials $V_{at}$ and $V_d$ would be reversed. In alternative implementations, the storage capacitor 2759 and write-enable transistor 2757 can be replaced with alternative data memory circuits, such as a DRAM or SRAM circuits known in the art. In alternate implementations, semiconductor diodes and/or metal insulator metal sandwich type thin films can be substituted as switches in place of transistors in control matrix 2740. Examples of these substitutions are described in U.S. patent application Ser. No. 11/326,696.

The sharing of actuation interconnects amongst distinct groups, and the sharing of scan line interconnects, write-enable transistors, and data store capacitors amongst adjacent rows has been described in an implementation particular to the control matrix 2440. Similar sharing of pixel elements, however, can be adopted with respect to a number of other control matrices, such as control matrices 1600, 1640, 2000, 2100, 2200, 2300, and 2640.

Voltage vs. Charge Actuation

As described above, in various embodiments of the invention, the MEMS-based light modulators used to form an image utilize electrostatic actuation, in which opposing capacitive members are drawn together during an actuation event. In some actuator implementations, depending on the geometry of the electrostatic members, the force drawing the capacitive members will vary in relation to the voltage applied across the electrostatic members. If the charge stored on the actuator is held constant, then the voltage and thus the force attracting the capacitive members, may decrease as the capacitive beams draw closer together. For such actuators, it is desirable to maintain a substantially constant voltage across the capacitive members to maintain sufficient force to complete actuation. For other actuator geometries (e.g., parallel plate capacitors), force is proportional to the strength of the electric field between the capacitive portions of the actuator, the electric field likewise being proportional to the amount of charge stored on the capacitive members. In such actuators, if an elastic restoring force is present which increases as capacitive members draw together, it may be necessary to increase the stored charge on the members to complete the actuation. An increase in stored charge and therefore the force of actuation can be accomplished by connecting the actuator to a source of charge, i.e. a constant voltage source.

Control matrix 2000 of FIG. 6 operates in conditions in which actuators are electrically isolated from a source of charge during actuation. Prior to actuation of either of the two actuators included in the pixel, charge yielding a voltage sufficient to initiate actuation of both actuators $V_{at}$, absent a maintenance voltage, is stored directly on each actuator. The actuators are then isolated from external voltage sources. At a later date, the charge stored on one of the actuators is discharged. The non-discharged actuator then actuates based solely on the constant charge previously stored on the actuator.

Figure 14:
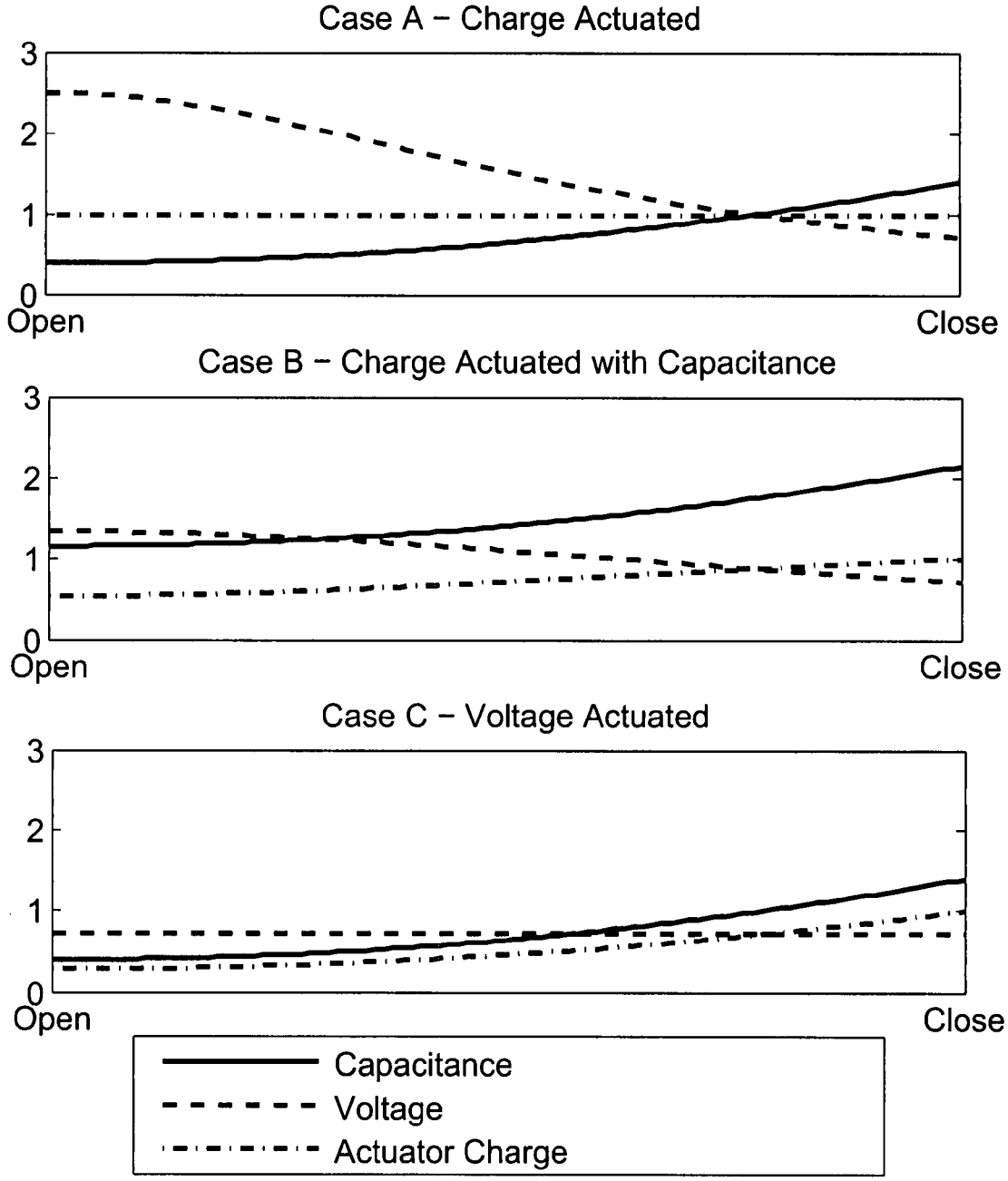
FIG. 14 includes three charts of voltage variations across portions of MEMS actuators that may result during actuation, according to various embodiments of the invention.

FIG. 14 includes three charts that illustrate the variations in electrostatic parameters that result from movement of portions of electrostatic actuators in various implementations of the invention. The chart labeled Case A in FIG. 14 illustrates the variations in parameters associated with the actuation of the actuator of a pixel from control matrix 2000 from an open position to a closed position. During actuation, since the actuator is electrically isolated, the charge remains constant. As the capacitive members draw closer together, the voltage decreases and the capacitance increases. To ensure proper actuation, the initial voltage applied to the actuator is preferably high enough such that as the voltage decreases resulting from motion of portions of the actuator, the resulting voltage is still sufficient to fully actuate the actuator.

To help ensure proper actuation without applying what might otherwise be an unnecessarily high voltage across the capacitive members of an actuator, a control matrix can incorporate a voltage regulator in electrical communication with the actuator during actuation of the actuator. The voltage regulator maintains a substantially constant voltage on the actuator during actuation. As a result, as the capacitance of the actuator increases as the capacitive elements draw closer together, additional charge flows into the capacitive members to maintain the voltage across the capacitive members, thereby maintaining the voltage level, increasing the electric field, and increasing the attractive force between the capacitive members. Thus, the voltage regulator substantially limits variations in voltage that would otherwise be caused by movement of portions of the actuators during actuation.

Voltage regulators can be included in each pixel in a control matrix, for example, as stabilizing capacitors connected to the capacitive members of the actuators. Control matrices 1640, 2000, and 2100 include such stabilizing capacitors. The impact of such a stabilizing capacitor is depicted in the chart labeled as Case B in FIG. 14. In such implementations, as the capacitive members of an actuator draw closer together, charge stored on the stabilizing capacitor flows into the capacitive member maintaining a voltage equilibrium between the stabilizing capacitor and the actuator. Thus, the voltage on the actuator decreases, but less so than in control matrices without a stabilizing capacitor. Preferably, the stabilizing capacitor is selected such that during actuation, the variation in the voltage on the actuator is limited to less than about 20% of $V_{at}$. In other implementations, a higher capacitance capacitor is selected such that during actuation, the variation in the voltage on the actuator is limited to less than about 10% of $V_{at}$. In still other implementations, the stabilizing capacitor is selected such that during actuation, the variation in the voltage on the actuator is limited to less than about 5% of $V_{at}$.

Alternatively, display drivers may serve as voltage regulators. The display drivers output a DC actuation voltage. In some implementations, the voltage may be substantially constant throughout operation of the display apparatus in which it is incorporated. In such implementations, the application of the voltage output by the display drivers is regulated by transistors incorporated into each pixel in the control matrix. In other implementations, the display drivers switch between two substantially constant voltage levels according. In such implementations, no such transistors are needed. In some implementations the pixels are connected to the display drivers by means of a voltage actuation interconnect. In some implementations, such as control matrix 2640, a voltage actuation interconnect such as interconnect 2662, can be a global common interconnect, meaning that it connects to pixels in at least two rows and two columns of the array of pixels.

Control matrices 1600, 1640, 2200, 2300, 2440, 2640, and 2740 include voltage regulators in the form of connections to voltage sources. As illustrated in Case C of FIG. 14, as the capacitive members of an electrostatic actuator connected to a voltage source draw together, the voltage across the capacitive members remains substantially constant. To maintain the constant voltage despite increasing capacitance, additional charge flows into the capacitive members as the capacitance of the actuator increases.

Cascoded Control Matrices

Figure 15:
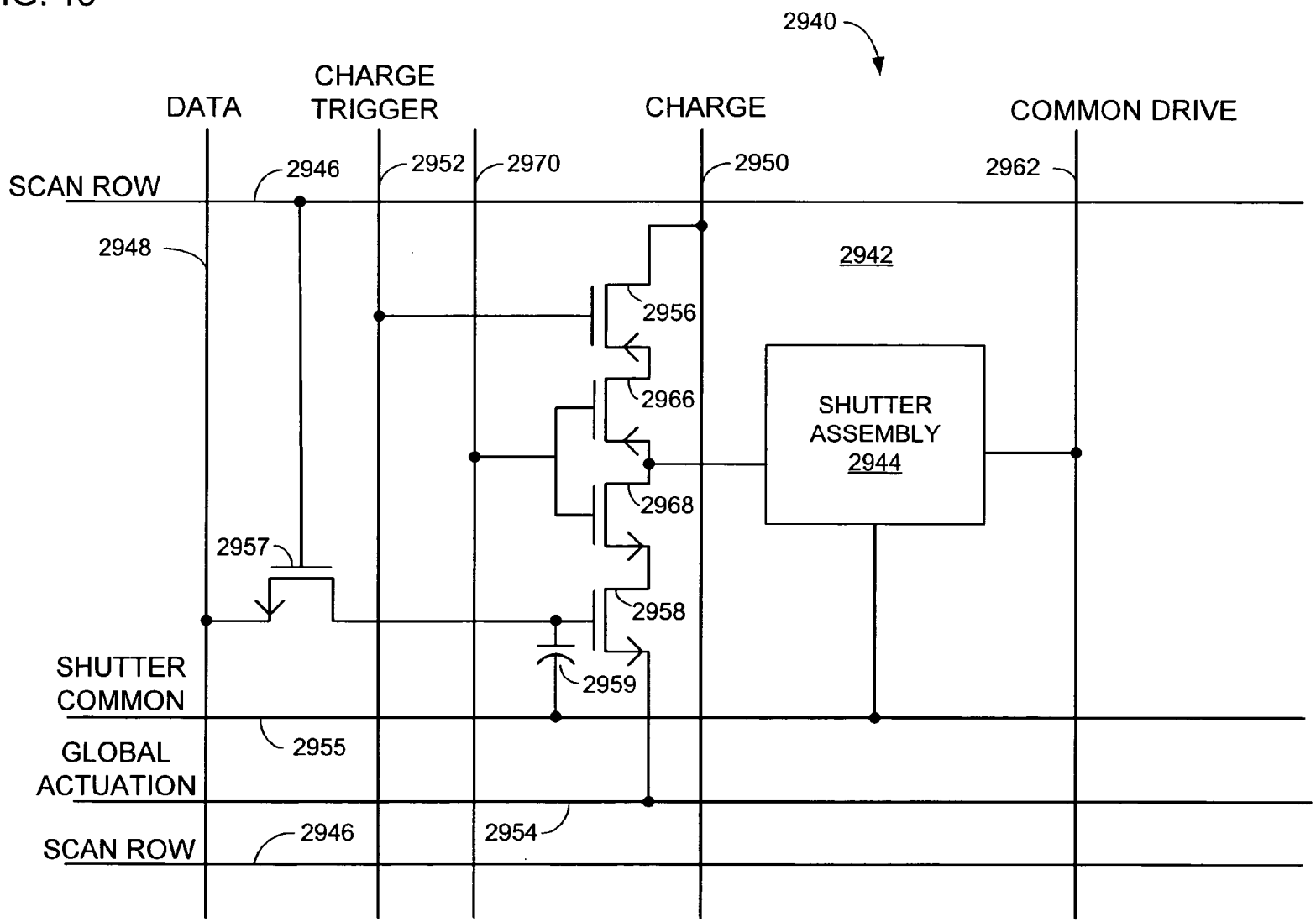
FIG. 15 is a schematic diagram of yet another suitable control matrix for inclusion in the display apparatus of FIG. 1A, according to an illustrative embodiment of the invention.

FIG. 15 is a schematic diagram of yet another suitable control matrix 2940 for inclusion in the display apparatus 100, according to an illustrative embodiment of the invention. Control matrix 2940 controls an array of pixels 2942 that include dual-actuator shutter assemblies 2944 (i.e., shutter assemblies with both shutter-open and shutter-close actuators). The actuators in the shutter assemblies 2004 can be made either electrically bi-stable or mechanically bi-stable.

Control matrix 2940 is substantially the same as control matrix 2640 with the addition of two additional transistors: 2966 and 2968. The control matrix also includes an additional common interconnect 2970.

The control matrix 2940 utilizes a dual-actuator shutter assembly 2944 along with a common drive interconnect 2962. For the example given in control matrix 2940 the common drive interconnect 2962 is electrically connected to the shutter-open actuator of the shutter assembly 2944. Despite the presence of a dual-actuator shutter assembly 2944, the control matrix 2940 includes only a single data interconnect 2948 for each column of pixels 2942 in the control matrix.

The control matrix 2940 includes a scan-line interconnect 2946 for each row of pixels 2942 in the control matrix 2940. The control matrix 2940 further includes a charge interconnect 2950, a charge trigger interconnect 2952, a global actuation interconnect 2954, and a shutter common interconnect 2955, and a switching cascode interconnect 2970. The switching cascode interconnect 2970 is connected to the gates of each of transistors 2966 and 2968. The interconnects 2950, 2954, 2955, 2962, and 2970 are shared among pixels 2942 in multiple rows and multiple columns in the array. In one implementation (the one described in more detail below), the interconnects 2950, 2954, 2955, 2962, and 2970 are shared among all pixels 2942 in the control matrix 2940.

Each pixel 2942 in the control matrix includes a shutter charge transistor 2956, a shutter discharge transistor 2958, a shutter write-enable transistor 2957, and a data store capacitor 2959 as described in FIG. 5A. For each pixel 2942 a charging cascode transistor 2966 is inserted with its source and drain connected in between the charging transistor 2956 and the actuator of shutter 2944. A discharge cascode transistor 2968 is also inserted with its source and drain connected in between the actuator of shutter 2944 and the discharge transistor 2958.

The control matrix 2940 makes use of two complementary types of transistors: both p-channel and n-channel transistors. It is therefore referred to as a complementary MOS control matrix or a CMOS control matrix. While the charging transistors 2956 and 2966 are made of the pMOS type, the discharge transistors 2958 and 2968 are made of the nMOS type of transistor. (In other implementations the types of transistors can be reversed, for example nMOS transistors can be used for the charging transistors and pMOS transistors can be used for the discharge transistors.) The use of a charge trigger interconnect along with the CMOS circuit helps to reduce the set of voltage variations required to achieve shutter actuation.

With the use of the charge trigger interconnect 2952, the control circuit 2940 is wired to the charging transistor 2956 in a fashion similar to that of control matrix 1600. Only the source of pMOS transistor 2956 is connected to the charge interconnect 2950 while the gate is connected to the charge trigger interconnect 2952. Throughout operation, the charge interconnect 2950 is maintained at a constant voltage equal to the actuation voltage $V_{at}$. In alternate implementations the interconnect 2950 is connected to either a voltage source or a current source at the periphery of the display, or more generally an energy source. The charge trigger interconnect 2952 is maintained at the same voltage ($V_{at}$) as that of the charge interconnect whenever the charge transistor 2956 is to be held in the off state. In order to turn-on the charge transistor 2956, the voltage on the charge trigger interconnect 2952 is reduced so that the voltage difference between charge interconnect 2950 and interconnect 2952 is greater than the threshold voltage of the transistor 2956. Threshold voltages can vary in a range from 2 to 8 volts. In one implementation where the transistor 2956 is a pMOS transistor, both the charge interconnect 2950 and the charge trigger interconnect 2952 are held at a $V_{at}$ of 40 volts when the transistor 2956 is off. In order to turn transistor 2956 on, the voltage on the charge interconnect 2950 would remain at 40 volts while the voltage on the charge trigger interconnect 2952 is temporarily reduced to 35 volts. (If an nMOS transistor were to be used at the point of transistor 2956, then the $V_{at}$ would be −40 volts and a charge trigger voltage of −35 volts would be sufficient to turn the transistor on.)

The addition of the charging cascode transistor 2966 helps to reduce the voltage drops experienced across either the source and drain or the gate and drain for either of transistors 2956 or 2966. The addition of the discharge cascode transistor 2968 helps to reduce the voltage drops experienced across either the source and drain or the gate and drain for either of transistors 2958 or 2968. The proper voltage applied to the switching cascode interconnect 2970 ensures that both charging transistors 2956 and 2966 turn on at substantially the same time. The same voltage helps to ensure that the discharge transistors 2958 and 2968 turn on at substantially the same time.

In operation the switching cascode interconnect 2970 is held to a constant voltage of substantially ½ of the actuation voltage $V_{at}$. During a charging operation, i.e. when the charge trigger interconnect is reduced in voltage below $V_{at}$ such that transistor 2956 is turned on, a voltage will then appear between the gate and drain of transistor 2966 such that transistor 2966 will also turn on. If the gate of transistor 2966 is held at substantially ½ of the actuation voltage $V_{at}$, then the source to drain voltage of transistor 2966 is unlikely to exceed ½ $V_{at}$ plus about a threshold voltage, even though the voltage imposed at the charge interconnect 2950 remains at $V_{at}$ (for example, 40 volts). The source to drain voltage of transistor 2956 then experiences the difference between $V_{at}$ and the voltage across transistor 2966. As a result, even though a large voltage $V_{at}$ is imposed at interconnect 2950, i.e. a voltage large enough to cause catastrophic breakdown in any one of the transistors, the control circuit 2940 is designed such that only a fraction of $V_{at}$ ever appears across any of the individual transistors, thereby protecting the circuit.

Additionally, during a discharge operation, i.e. when a charge is stored on capacitor 2959 and the global actuation interconnect is brought to zero volts, a voltage will then appear between the gate and drain of transistor 2968 such that transistor 2968 will also turn on in addition to transistor 2958. If the gate of transistor 2968 is held at substantially ½ of the actuation voltage $V_{at}$, then the source to drain voltage of transistor 2968 is unlikely to exceed ½ $V_{at}$ plus about a threshold voltage, even though the voltage difference between the actuator of shutter assembly 2944 and the global actuation interconnect can be as high as $V_{at}$ (for example, 40 volts). The source to drain voltage of transistor 2958 then experiences the difference between $V_{at}$ and the voltage across transistor 2968. As a result, even though a large voltage $V_{at}$ is dropped between the actuator and ground, i.e. a voltage large enough to cause catastrophic breakdown in any one of the transistors, the control circuit 2940 is designed such that only a fraction of $V_{at}$ ever appears across any of the individual transistors, thereby protecting the circuit.

In some circuits one of either the pMOS or the nMOS transistors may withstand greater voltages before the onset of substantial leakage or catastrophic breakdown. In such circuits it can be advantageous to apply a different voltage criterion for the switching cascode interconnect 2970. For a particular example, assume that the type of transistor (either pMOS or nMOS) employed for the discharge transistors 2958 and 2968 was more resistant to leakage or breakdown than the type used for the charging transistors 2956 and 2966. Then it would be advantageous to apply a voltage of less than ½ of $V_{at}$ to the switching cascode interconnect 2970, for instance ⅓ of $V_{at}$. In such a circuit the greatest voltage experienced by the charging cascode transistor 2966 would be ⅓ $V_{at}$ plus a threshold voltage, while the greatest voltage experienced by the discharge cascode transistor 2968 would be ⅔ $V_{at}$ plus a threshold voltage. If the discharge transistors were strong enough, then the discharge cascode transistor 2958 could be eliminated altogether, and the voltage on the switching cascode interconnect could be adjusted so that the maximum gate to drain voltage on each of the charging transistors 2956 and 2966 were almost exactly ½ of $V_{at}$. In the opposite case where the type of transistor employed for the charging transistors 2956 and 2966 are stronger than those used at the discharge transistors, the optimum voltage applied to the switching cascode interconnect 2970 would be greater than ½ of $V_{at}$.

In another variation of the control matrix 2040, the switching cascode interconnect 2970 can be replaced by two independent cascode interconnects. One of the cascode interconnects would connect to the gate of the charging cascode transistor 2966 while the other connects to the gate of the discharge cascode transistor 2968. Each of the cascode interconnects would then be held to a constant DC bias voltage, although the voltages would differ. The gate of the charging cascode transistor 2966, for instance, could be held to a voltage of less than ½ of $V_{at}$, for instance ⅓ of $V_{at}$. The gate of the discharge cascode interconnect 2968 could be held to a voltage of greater than ½ of $V_{at}$, for instance ⅔ of $V_{at}$. In a refinement, the voltages of each of the cascode interconnects can be adjusted such that the greatest voltage appearing across any of the transistors 2956, 2966, 2958, or 2968 is never greater than approximately ½ of $V_{at}$.

It would be apparent to one skilled in the art that further voltage divisions can be achieved by providing 2 or even 3 cascode transistors to either the charging or the discharge arm of each pixel in the control matrix 2940. Each of the additional cascode transistors would be regulated by a unique gate voltage.

Further variations on the circuit protection scheme of control matrix 2940 are possible. In one implementation the switching cascode interconnect 2970 is eliminated. In this implementation the gate of transistor 2966 would be connected to the charge trigger interconnect 2952, and the gate of transistor 2968 would be connected to the capacitor 2959. This is known as a "double gate" implementation, in that both charging transistors 2956 and 2966 would be connected in series while sharing the same gate voltage. Similarly in this alternate implementation both discharge transistors 2958 and 2968 would be connected in series and share the same gate voltage. In the double gate implementation the source-drain voltages are divided equally between two transistors, which reduces the voltage seen across an individual transistor, thereby reducing leakage and the possibilities of avalanche breakdown.

A method for addressing and actuating pixels in control matrix 2940 is similar to that of method 2470 of FIG. 11, with the same changes to the procedure for utilizing a charge trigger interconnect as outlined with respect to control matrix 2640. The power saving advantages outlined with respect to control matrix 2640 also apply to the control matrix 2940.

Figure 16:
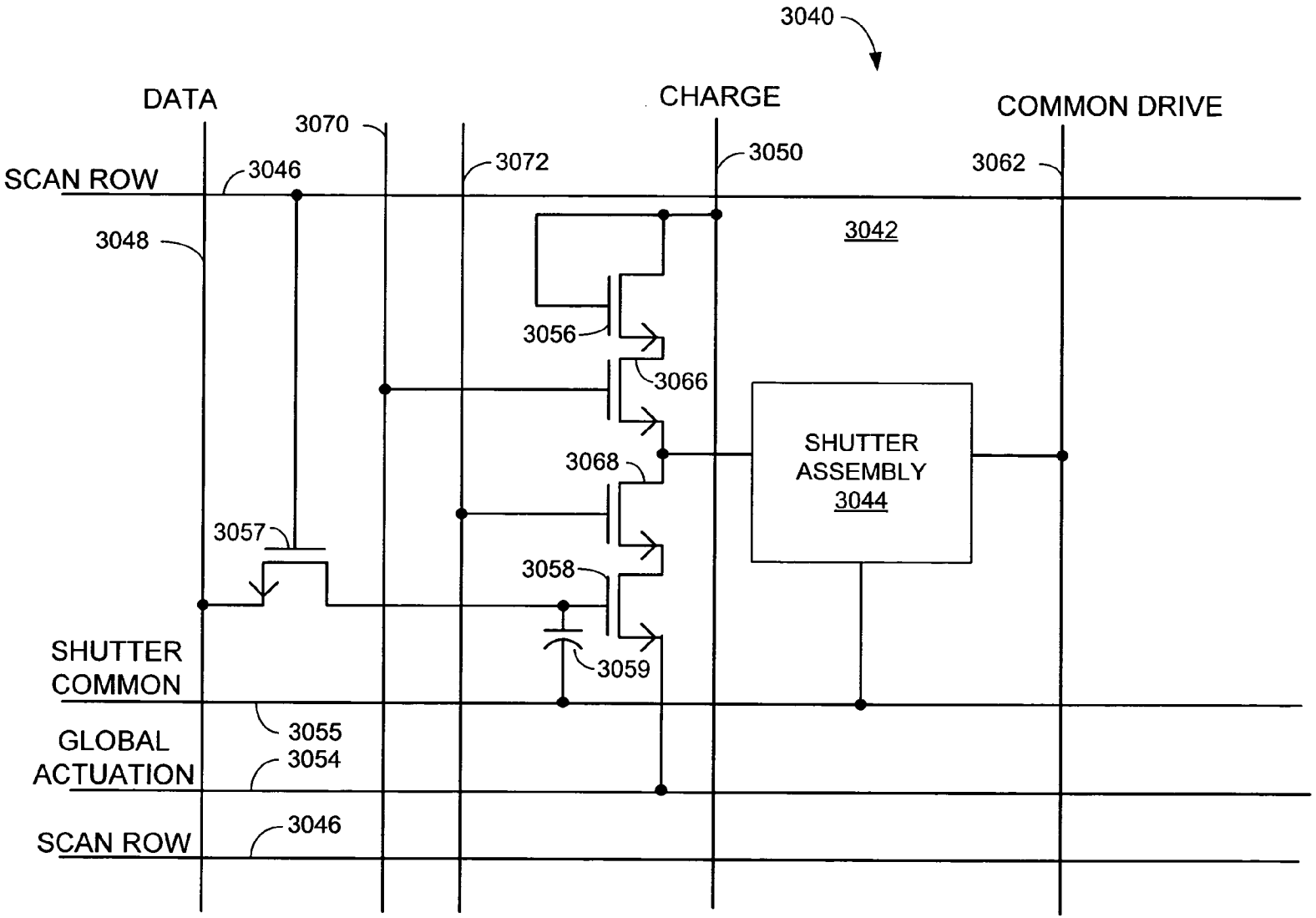
FIG. 16 is a schematic diagram of yet another suitable control matrix for inclusion in the display apparatus of FIG. 1A, according to an illustrative embodiment of the invention.

FIG. 16 is a schematic diagram of yet another suitable control matrix 3040 for inclusion in the display apparatus 100, according to an illustrative embodiment of the invention. Control matrix 3040 controls an array of pixels 3042 that include dual-actuator shutter assemblies 3044 (i.e., shutter assemblies with both shutter-open and shutter-close actuators). The actuators in the shutter assemblies 2004 can be made either electrically bi-stable or mechanically bi-stable.

Control matrix 3040 is substantially the same as control matrix 2440 with the addition of two additional transistors: 3066 and 3068. The control matrix also includes two additional common interconnects 3070 and 3072. The control matrix 3040 differs from control matrix 2940 in that a charge trigger interconnect is not employed and all of the transistors are of a similar type. All transistors in control matrix 3040 are n-channel transistors, although another useful circuit can be employed in which all the transistors are p-channel transistors. (In embodiments that employ p-channel transistors the relative polarities of the bias potentials $V_{at}$ and $V_d$ would be reversed.)

The control matrix 3040 utilizes a dual-actuator shutter assembly 3044 along with a common drive interconnect 3062. For the example given in control matrix 3040 the common drive interconnect 3062 is electrically connected to the shutter-open actuator of the shutter assembly 3044. Despite the presence of a dual-actuator shutter assembly 3044, the control matrix 3040 includes only a single data interconnect 3048 for each column of pixels 3042 in the control matrix.

The control matrix 3040 includes a scan-line interconnect 3046 for each row of pixels 3042 in the control matrix 3040. The control matrix 3040 further includes a charge interconnect 3050, a global actuation interconnect 3054, a shutter common interconnect 3055, a charging cascode interconnect 3070, and a discharge cascode interconnect 3072. The charging cascode interconnect 3070 is connected to the gate of transistor 2966. The discharge cascode interconnect 3072 is connected to the gate of transistor 2968. The interconnects 3050, 3054, 3055, 3062, 3070, ad 3072 are shared among pixels 3042 in multiple rows and multiple columns in the array. In one implementation (the one described in more detail below), the interconnects 3050, 3054, 3055, 3062, 3070, and 3072 are shared among all pixels 3042 in the control matrix 3040.

Each pixel 3042 in the control matrix includes a shutter charge transistor 3056, a shutter discharge transistor 3058, a shutter write-enable transistor 3057, and a data store capacitor 3059 as described in FIG. 5A. For each pixel 3042 a charging cascode transistor 3066 is inserted with its source and drain connected in between the charging transistor 3056 and the actuator of shutter 3044. A discharge cascode transistor 3068 is also inserted with its source and drain connected in between the actuator of shutter 3044 and the discharge transistor 3058.

By comparison to control matrix 2940 of FIG. 15, the charging transistor 3056 is wired with a different circuit connection to the charge interconnect 3050. Control matrix 3040 does not include a charge trigger interconnect which is shared among pixels. Instead, the gate terminals of the charging transistor 3056 are connected directly to the charge interconnect 3050, along with the drain terminal of transistor 3056. In operation, the charging transistor 3056 operates essentially as a diode, i.e., it can pass a current in only one direction.

The addition of the charging cascode transistor 3066 helps to reduce the voltage drops experienced across either the source and drain or the gate and drain for either of transistors 3056 or 3066. The addition of the discharge cascode transistor 3068 helps to reduce the voltage drops experienced across either the source and drain or the gate and drain for either of transistors 3058 or 3068. The charging cascode interconnect 3070 ensures that both charging transistors 3056 and 3066 turn on at substantially the same time. The discharge cascode interconnect 3070 helps to ensure that the discharge transistors 3058 and 3068 turn on at substantially the same time.

A method for addressing and actuating pixels in control matrix 3040 is similar to that of method 2470 of FIG. 11, except for addition of voltages applied at the charging cascode interconnect 3070 and the discharge cascode interconnect 3072. The variations from the method 2470 will now be described. At the beginning of the addressing cycle both of the charging cascode interconnect 3070 and the discharge cascode interconnect 3072 are held at a DC voltage equal to substantially ½ of $V_{at}$ (or, alternatively, ½ of $V_{at}$ minus a threshold voltage). At step 2486 of method 2470 an actuation voltage $V_{at}$ is applied to the charge interconnect 3050. As part of step 2486, immediately after $V_{at}$ is applied to interconnect 3050, a similar voltage of $V_{at}$ is applied to the charging cascode interconnect 3070. At step 2487 the common drive interconnect 3062 is grounded and at step 2488 all shutters actuate (close). At step 2490 in method 2470 the charge interconnect 3050 is grounded. For control matrix 3040, however, step 2490 would also include the step of returning the voltage on the charging cascode interconnect 3070 to substantially ½ of $V_{at}$ (or, alternatively, ½ of $V_{at}$ minus a threshold voltage). The return of interconnect 3070 to substantially ½ of $V_{at}$ preferably precedes the grounding of the charge interconnect 3050. The steps 2486 to 2490 complete the charging of the shutter-close actuator. The majority of charge stored on the shutter assembly 3044 will not leak out after step 2490 since both of the charging transistors 3056 and 3066 as well as the discharge transistors 3058 and 3068 are then held in their off state. By ensuring that the charging cascode transistor 3066 is turned-on only when the charging transistor 3056 is already on, the actuation voltage $V_{at}$ becomes approximately equally divided between the two charging transistors 3056 and 3066, thereby preventing the catastrophic breakdown or either one of them.

The method 2470 proceeds at step 2492 with the setting of the global actuation interconnect 3054 to ground. This makes possible the selective discharge of shutters assemblies 3044, depending on whether or not a charge has been stored on the capacitor 3059. The discharge transistors turn on at step 2492, but only if a charge is stored on capacitor 3059. Control matrix includes a discharge cascode interconnect 3072 which is held at a constant voltage equal to substantially ½ of $V_{at}$ (or, alternatively, ½ of $V_{at}$ minus a threshold voltage). Because of the ½ $V_{at}$ DC bias at the gate of cascode transistor 3068, the transistor 3068 will turn on immediately after the transistor 3058 is turned on. By ensuring that the discharge cascode transistor 3068 transitions to the on state only after the discharge transistor 3058 has turned on, the actuation voltage $V_{at}$ remains approximately equally divided between the two transistors 3058 and 3068, thereby preventing the catastrophic breakdown or either one of them. Both transistors 3058 and 3068 transition to the off state at step 2472, when the global actuation interconnect is returned to the $V_{off}$ state.

Further variations on the circuit protection scheme of control matrix 2940 are possible. In one variation the charging cascode interconnect 3070 is eliminated. The gate of transistor 3066 is instead connected directly to the source of transistor 3056. The charging cascode transistor 3066 then behaves essentially as a diode in series with the transistor 3056, dividing the source—drain voltages across two transistors instead of only one. In another variation, the gate of transistor 3066 is connected directly to the charge interconnect 3050. The control matrix thereby adapts the "double gate" structure described with respect to control matrix 2940. In another variation the discharge cascode interconnect 3072 is eliminated. The gate of transistor 3068 is instead connected directly to the actuator of shutter assembly 3044. The discharge cascode transistor 3068 thereby behaves essentially as a diode in series with transistor 3058. In another variation the gate of transistor 3068 is connected directly to the charge interconnect 3050. In such a configuration the discharge cascode transistor 3068 will turn on whenever the discharge transistor 3058 turns on.

The circuit protection schemes illustrated in FIGS. 15 and 16 can be applied to a variety of other control matrices for inclusion in the display apparatus 100, according to an illustrative embodiment of the invention. For instance both of the control matrices 15 and 16 are variations of a "common drive" type of control matrix. The common drive matrix employs dual-actuator shutter assemblies 2944 (i.e., shutter assemblies with both shutter-open and shutter-close actuators), and yet with the inclusion of the common drive interconnect 2962 only a single data interconnect 2948 is required for each column of pixels. In operation, a common drive type of control matrix employs variations of the method 2470 for addressing and actuation.

In an alternate implementation for use with dual-actuator shutter assemblies a separate shutter-open and shutter-close data interconnect can be provided for each pixel in the array. An example of the use of separate data interconnects is found in control matrix 2000 of FIG. 6. The circuit protection scheme of FIG. 16 can also be included as part of control matrix 2000. For instance charging cascode transistors can be inserted between each of the transistors 2016 and 2020 and their respective shutter actuators. Similarly discharge cascode transistors can be inserted between each of the transistors 2018 and 2022 and their respective shutter actuators. The gates of each of the charging cascode transistors would then be connected in common with a charging cascode interconnect, such as interconnect 3070, which is pulsed synchronously with the charge interconnect 2010. The gates of each of the discharge cascode transistors would then be connected in common with a discharge cascode interconnect, such as 3072, which is held at a constant voltage of about ½ $V_{at}$. A scheme where the cascode transistors are wired in a "double gate" configuration can also be applied within control control matrix 2000.

And finally, the circuit protection schemes of FIGS. 15 and 16 can be applied to control matrices that employ elastic shutter assemblies, such that only a single data interconnect is necessary. Such single-ended control matrices are exemplified by control matrices 1600 and 1640 in FIGS. 5A and 5B. For instance a charging cascode transistor can be inserted between transistor 1656 and the shutter actuator. Similarly a discharge cascode transistor can be inserted between transistors 1658 and the shutter actuator. The gate of the charging cascode transistor would then be connected in common with a charging cascode interconnect, such as interconnect 3070, which is pulsed synchronously with the charge interconnect 1650. The gate of each of the discharge cascode transistor would then be connected in common with a discharge cascode interconnect, such as 3072, which is held at a constant voltage of about ½ $V_{at}$. A scheme where the cascode transistors are wired in a "double gate" configuration can also be applied within control matrices 1600 and 1640.

As noted above, CMOS variations are possible for circuit protection in each of the control matrices 1600, 1640, and 2000. Therefore the wiring pattern of control matrix 2940, in which the cascode transistors are of the CMOS type, can be applied to these circuits. If the circuits 1640 and 2000 are wired by analogy to the control matrix 2940, for example, only a single switching cascode interconnect, such as interconnect 2970, would be needed for connection in common to both the nmos and pmos cascode transistors, such as transistors 2966 and 2968.

Generally, cascode transistors can be added to almost any control matrix appropriate to displays where the applied voltages would otherwise threaten harm to or cause excessive leakage in any individual transistor.

The invention claimed is:

1. A display apparatus comprising:

a transparent substrate, an array of pixels including a plurality of MEMS light modulators wherein each pixel includes at least one MEMS light modulator, and a control matrix including, a plurality of scan line interconnects running in a first direction, each enabling a plurality of pixels along the first direction to respond to data voltages; and a plurality of data interconnects running in a second direction perpendicular to the first direction, each providing data voltages to a plurality of pixels along the second direction; and for each pixel in the array:

a set of switches comprising a first switch and a second switch directly connected in series, wherein the first switch and second switch are formed on the transparent substrate, and wherein the first switch and second switch together connect an energy source to at least one MEMS light modulator of the respective pixel, a data switch coupled to a corresponding one of the scan line interconnects and a corresponding one of the data interconnects for controlling the state of the at least one MEMS light modulator of the respective pixel.

2. The display apparatus of claim 1, wherein the first switch comprises a first transistor and the second switch comprises a second transistor.

3. The display apparatus of claim 2, wherein the first and second transistors share a common gate voltage.

4. The display apparatus of claim 2, wherein a gate of the first transistor is substantially at a first voltage, a gate of the second transistor is substantially at a second voltage, and the first and second voltages are different for at least one moment in time.

5. The display apparatus of claim 4, wherein the second voltage is substantially equal to half of the first voltage while the first and second transistors are each in an off state.

6. The display apparatus of claim 4, comprising an interconnect for supplying the second voltage to the gate of the second transistor.

7. The display apparatus of claim 4, wherein the energy source is connected to an actuation voltage interconnect for supplying an actuation voltage to the at least one MEMS light modulator of the respective pixel.

8. The display apparatus of claim 7, wherein the second voltage is substantially equal to half of the actuation voltage while the first and second transistors are each in an off state.

9. The display apparatus of claim 7, wherein the actuation voltage interconnect is a global common interconnect for supplying the actuation voltage to multiple pixels in the array.

10. The display apparatus of claim 1, wherein the respective pixel comprises a first actuator for driving the at least one MEMS light modulator of the respective pixel into a first state.

11. The display apparatus of claim 10, comprising a second actuator, different from the first actuator, for driving the at least one MEMS light modulator of the respective pixel into a second state.

12. The display apparatus of claim 11, comprising an actuation voltage interconnect for supplying an actuation voltage to the second actuator.

13. The display apparatus of claim 11, wherein the second actuator is connected to the energy source via at least one switch.

14. A display apparatus comprising:

a transparent substrate, an array of pixels including a plurality of MEMS light modulators wherein each pixel includes at least one MEMS light modulator, and a control matrix including, a plurality of scan line interconnects running in a first direction, each enabling a plurality of pixels along the first direction to respond to data voltages; and a plurality of data interconnects running in a second direction perpendicular to the first direction, each providing data voltages to a plurality of pixels along the second direction; and for each pixel in the array:

a first switch and a second switch directly connected in series and through which current flows from at least one MEMS light modulator of the respective pixel to a current drain interconnect, wherein the first switch and second switch are formed on the transparent substrate, a data switch coupled to a corresponding one of the scan line interconnects and a corresponding one of the data interconnects for controlling the state of the at least one MEMS light modulator of the respective pixel.

15. The display apparatus of claim 14, wherein the first switch comprises a first transistor and the second switch comprises a second transistor.

16. The display apparatus of claim 15, wherein the first and second transistors share a common gate voltage.

17. The display apparatus of claim 15, wherein a gate of the first transistor is substantially at a first voltage, a gate of the second transistor is substantially at a second voltage, and the first and second voltages are different for at least one moment in time.

18. The display apparatus of claim 17, wherein the first voltage is substantially equal to half of an actuation voltage supplied to the at least one MEMS light modulator of the respective pixel while the first and second transistors are each in an off state.

19. The display apparatus of claim 17, wherein the data interconnect supplies a data voltage to the gate of the second transistor.

20. The display apparatus of claim 17, comprising a cascode interconnect for supplying the first voltage to the gate of the first transistor.

21. The display apparatus of claim 14, wherein the respective pixel comprises a first actuator for driving the at least one MEMS light modulator of the respective pixel into a first state and the control matrix comprises a first actuation voltage interconnect for supplying a first actuation voltage to the first actuator.

22. The display apparatus of claim 21, wherein the first actuation voltage interconnect is a global common interconnect for supplying the actuation voltage to multiple pixels in the array.

23. The display apparatus of claim 21, comprising a second actuator for driving the at least one MEMS light modulator of the respective pixel into a second state.

24. The display apparatus of claim 23, comprising a second actuation voltage interconnect for supplying a second actuation voltage to the second actuator.

25. The display apparatus of claim 23, wherein the second actuator is connected to the first actuation voltage interconnect via at least one switch.

26. A display apparatus, comprising:

a transparent substrate, an array of pixels including a plurality of light modulators wherein each pixel includes at least one light modulator, and a control matrix including, a plurality of scan line interconnects running in a first direction, each enabling a plurality of pixels along the first direction to respond to data voltages; and a plurality of data interconnects running in a second direction perpendicular to the first direction, each providing data voltages to a plurality of pixels along the second direction; and for each pixel in the array, a charging cascode connecting an energy source to at least one light modulator of the respective pixel, wherein the charging cascode comprises a first switch and a second switch directly connected in series, a discharging cascode through which current flows from the at least one light modulator of the respective pixel to a current drain interconnect, wherein the charging and discharging cascodes are connected to a common interconnect, and wherein the charging and discharging cascode are formed on the transparent substrate, and a data switch coupled to a corresponding one of the scan line interconnects and a corresponding one of the data interconnects for controlling the state of the at least one light modulator of the respective pixel.

27. The display apparatus of claim 26, wherein the discharging cascode comprises a third switch and a fourth switch directly connected in series.

28. The display apparatus of claim 27, wherein the first switch comprises a first transistor connecting the energy source and the second switch, the second switch comprises a second transistor connecting the first switch and the at least one light modulator of the respective pixel, the third switch comprises a third transistor connecting the at least one light modulator of the respective pixel and the fourth switch, and the fourth switch comprises a fourth transistor connecting the third switch and the current drain interconnect.

29. The display apparatus of claim 28, wherein a gate of the second transistor and a gate of the third transistor are connected to the common interconnect.

30. The display apparatus of claim 28, wherein the first and second transistors are of a transistor type different from that of the third and fourth transistors.

31. The display apparatus of claim 30, wherein each of the first, second, third, and fourth transistors are all the same one of NMOS type or PMOS type.

32. The display apparatus of claim 26, wherein the control matrix comprises a CMOS control matrix.

33. The display apparatus of claim 26, wherein the energy source is connected to an actuation voltage interconnect for supplying an actuation voltage to the at least one light modulator of the respective pixel.

34. The display apparatus of claim 33, wherein the common interconnect is at a voltage that is substantially half of the actuation voltage.

35. The display apparatus of claim 33, wherein the actuation voltage interconnect is a global common interconnect for supplying the actuation voltage to multiple pixels in the array.

36. The display apparatus of claim 26, wherein the plurality of light modulators comprises a plurality of MEMS light modulators wherein each pixels includes at least one MEMS light modulator.

37. The display apparatus of claim 36, wherein the respective pixel comprises a first actuator for driving at least one MEMS light modulator of the respective pixel into a first state.

38. The display apparatus of claim 37, comprising a second actuator for driving the at least one MEMS light modulator of the respective pixel into a second state.

39. The display apparatus of claim 38, comprising a second actuation voltage interconnect for supplying a second actuation voltage to the second actuator.

40. The display apparatus of claim 38, wherein the second actuator is connected to the first actuation voltage interconnect via at least one switch.

41. The display apparatus of claim 1, wherein the energy source provides a voltage of at least 40 Volts.

42. The display apparatus of claim 41, wherein the voltage across each of the first and second switches is less than 40 Volts.

43. The display apparatus of claim 28, wherein the energy source provides a voltage of at least 40 Volts.

44. The display apparatus of claim 43, wherein the voltage across each of the first, second, third, and fourth transistors is less than 40 Volts.

* * * * *